US011298943B2

(12) United States Patent
Kitamura et al.

(10) Patent No.: US 11,298,943 B2
(45) Date of Patent: Apr. 12, 2022

(54) INK JET RECORDING SYSTEM

(71) Applicant: Keyence Corporation, Osaka (JP)

(72) Inventors: Atsushi Kitamura, Osaka (JP); Takanori Ando, Osaka (JP); Minoru Taneda, Osaka (JP); Mamoru Idaka, Osaka (JP)

(73) Assignee: KEYENCE CORPORATION, Osaka (JP)

( * ) Notice: Subject to any disclaimer, the term of this patent is extended or adjusted under 35 U.S.C. 154(b) by 0 days.

(21) Appl. No.: 16/987,541

(22) Filed: Aug. 7, 2020

(65) Prior Publication Data

US 2021/0178767 A1 Jun. 17, 2021

(30) Foreign Application Priority Data

Dec. 12, 2019 (JP) ..... JP2019-224104

(51) Int. Cl.
*B41J 2/165* (2006.01)
*B41J 2/17* (2006.01)

(52) U.S. Cl.
CPC ..... *B41J 2/16552* (2013.01); *B41J 2/1721* (2013.01); *B41J 2002/1657* (2013.01); *B41J 2002/16573* (2013.01)

(58) Field of Classification Search
CPC ..... B41J 2/16552; B41J 2/1721; B41J 2002/16573; B41J 2002/1657
See application file for complete search history.

(56) References Cited

U.S. PATENT DOCUMENTS

2009/0189960 A1* 7/2009 Matsuda ..... B41J 2/18 347/77
2020/0101741 A1* 4/2020 Arima ..... B41J 2/16552

FOREIGN PATENT DOCUMENTS

JP 2012134432 A * 7/2012
JP 2015136934 A 7/2015

OTHER PUBLICATIONS

U.S. Appl. No. 16/987,531, filed Aug. 7, 2020 (165 pages).

* cited by examiner

*Primary Examiner* — Sharon Polk
(74) *Attorney, Agent, or Firm* — Kilyk & Bowersox, P.L.L.C.

(57) ABSTRACT

To prevent a printing head not placed on a cleaning placing unit from being cleaned and prevent contamination of an ambient environment by cleaning liquid. An ink jet recording system includes a placement detecting unit configured to detect that a printing head 1 is placed on a cleaning placing unit 200. The placement detecting unit is configured to, when detecting that the printing head 1 is placed, transmit a signal based on placement confirmation for the printing head 1 to a controller connected to the printing head 1 placed on the cleaning placing unit 200.

10 Claims, 49 Drawing Sheets

PROCESS C

INK JET RECORDING SYSTEM

CROSS-REFERENCE TO RELATED APPLICATIONS

The present application claims foreign priority based on Japanese Patent Application No. 2019-224104, filed Dec. 12, 2019, the contents of which are incorporated herein by reference.

BACKGROUND OF THE INVENTION

1. Field of the Invention

The present disclosure relates to an ink jet recording system.

2. Description of Related Art

There has been known an ink jet recording apparatus for performing printing on work.

For example, JP-A-2015-136934 (Patent Literature 1) discloses an ink jet recording apparatus of a so-called continuous type that circulates ink to an apparatus inside even when not performing printing on work. The ink jet recording apparatus includes a printing head for ejecting ink droplets and a controller connected to the printing head. The ink jet recording apparatus also includes a cleaning stand. An ink jet recording system is configured by the printing head, the controller, and the cleaning stand.

The printing head houses, on the inside, a printing nozzle that ejects ink or a solvent, a charging electrode that charges particulate ink (ink droplets) ejected from the printing nozzle, and a deflection electrode that deflects a flying direction (a traveling direction) of the ink charged by the charging electrode. The printing head is configured to eject, to the outside, the ink deflected by the deflection electrode and perform printing. The ink droplets not used for the printing are collected from a gutter of the printing head.

The controller includes an ink supply unit including an ink supply path or the like for supplying the ink to the printing nozzle and a control unit that controls the units.

When the ink jet recording apparats disclosed in Patent Literature 1 is shifted from a state in which the circulation of the ink is stopped to an operation state, start processing for controlling the ink supply unit to thereby eject pressurized ink from the printing nozzle and achieve a printing executable state is executed.

In the start processing, the printing head is placed on the cleaning stand, cleaning liquid is jetted from a cleaning nozzle, which is provided separately from the printing nozzle in the printing head, toward the printing nozzle, and the printing nozzle and the periphery of the printing nozzle are automatically cleaned, whereby solids of the ink adhering to a hole of the printing nozzle and an opening of the gutter are removed. During the cleaning, the cleaning liquid leaks from the printing head. However, the leaking cleaning liquid is collected by the cleaning stand.

SUMMARY OF THE INVENTION

Incidentally, a plurality of ink jet recording apparatuses such as a first ink jet recording apparatus and a second ink jet recording apparatus are sometimes introduced into a site where printing is executed. Since the ink jet recording apparatuses include printing heads, controllers, and cleaning stands, a first printing head, a second printing head, and the like are present as the printing heads, a first controller, a second controller, and the like are present as the controllers, and a first cleaning stand, a second cleaning stand, and the like are present as the cleaning stands.

In such a site, it is likely that automatic cleaning of the printing heads is performed by mistake. That is, although a user intends to place the first printing head connected to the first controller on the first cleaning stand in order to clean the first printing head, if the user places the second printing head connected to the second controller on the first cleaning stand by mistake, the first printing head is not placed on the first cleaning stand. When the automatic cleaning is performed in this state, since nothing receives the cleaning liquid leaking from the first printing head, it is likely that the cleaning liquid contaminates an ambient environment or volatilizes to cause an unpreferable environment.

The present invention has been devised in view of such points, and an object of the present invention is to prevent a printing head not placed on a cleaning placing unit (cleaning stand unit) from being cleaned and prevent contamination of an ambient environment due to cleaning liquid.

In order to achieve the object, according to a first aspect of the present disclosure, an ink jet recording system includes: an ink jet recording apparatus including a printing head configured to house, on an inside, a nozzle that ejects ink, a charging electrode that charges particulate ink ejected from the nozzle, and a deflection electrode that deflects a flying direction of the ink charged by the charging electrode and eject, to an outside, the ink deflected by the deflection electrode and a controller including an ink supply unit connected to the printing head and configured to supply the ink to the printing head, a solvent supply unit connected to the printing head and configured to supply a solvent to the printing head, and a control unit configured to control ink supply from the ink supply unit to the printing head and control solvent supply from the solvent supply unit to the printing head, the ink jet recording apparatus performing printing on work using the ink supplied from the ink supply unit; a cleaning placing unit disposed in a place different from a setting place of the printing head at a time when the printing is performed by the ink jet recording apparatus, the printing head being placed on the cleaning placing unit when the printing head is cleaned using the solvent supplied from the solvent supply unit; and a placement detecting unit configured to be capable of detecting that the printing head is placed on the cleaning placing unit and, when detecting that the printing head is placed, send a signal based on placement confirmation for the printing head to the control unit connected to the printing head placed on the cleaning placing unit.

With this configuration, when the printing head is placed on the cleaning placing unit, the placement detecting unit detects that the printing head is placed. When the placement detecting unit detects that the printing head is placed, the signal based on the placement confirmation for the printing head is sent to the control unit connected to the printing head placed on the cleaning placing unit. Consequently, since the control unit can confirm that the printing head connected to the control unit is placed on the cleaning placing unit, the control unit can determine that the cleaning of the printing head can be performed. Therefore, since the printing head placed on the cleaning placing unit can be cleaned, the solvent leaking from the printing head can be received by the cleaning placing unit. Contamination of an ambient environment is prevented.

When a site where a plurality of ink jet recording apparatuses, that is, a first ink jet recording apparatus and a second ink jet recording apparatus are introduced is assumed, it is conceivable that, although a user intends to clean a first printing head connected to a first controller, actually, the user places a second printing head connected to a second controller on a first cleaning placing unit. In this case, since the first printing head is not placed on the first cleaning placing unit, a signal based on placement confirmation for the first printing head is not sent to a control unit of the first printing head. Consequently, the first controller can determine that the first printing head connected to the first controller is not placed on the cleaning placing unit. Therefore, it is possible to prevent the first printing head from being cleaned and prevent cleaning liquid from leaking from the first printing head.

Note that the placement detecting unit may be provided in the printing head or may be provided in the cleaning placing unit. The signal based on the placement confirmation for the printing head may be a signal indicating that the printing head is placed on the cleaning placing unit or may be a signal indicating that the placed printing head is connected to the controller. The controller may determine whether the printing head is placed on the cleaning placing unit.

The placement detecting unit can be configured by various sensors or can be configured by detecting means such as contacts and energization terminals respectively provided in the printing head and the cleaning placing unit to perform energization only when the printing head is placed on the cleaning placing unit. In this case, the placement of the printing head on the cleaning placing unit can be detected by energization between the contacts.

In a second aspect of the present disclosure, the controller may include a cleaning operation unit configured to, when the control unit receives the signal based on the placement confirmation for the printing head sent by the placement detecting unit, perform a cleaning operation for the printing head placed on the cleaning placing unit. The placement detecting unit may send the signal based on the placement confirmation for the printing head to the control unit as a permission signal for permitting the cleaning operation by the cleaning operation unit.

With this configuration, when the signal based on the placement confirmation for the printing head is received, the cleaning of the printing head can be automatically performed.

In a third aspect of the present disclosure, the placement detecting unit may send the signal based on the placement confirmation for the printing head to the control unit as a non-permission signal for not permitting the printing on the work by the printing head and the control unit.

In a fourth aspect of the present disclosure, the cleaning operation unit may be configured to prohibit the cleaning operation for the printing head when the signal based on the placement confirmation for the printing head is not received.

That is, not receiving the signal based on the placement confirmation for the printing head means that the printing head is not placed on the cleaning placing unit. In this case, since the cleaning operation for the printing head is prohibited, the printing head not placed on the cleaning placing unit is not cleaned by mistake.

In a fifth aspect of the present disclosure, the placement detecting unit may be configured to send the signal based on the placement confirmation for the printing head to the control unit via a cable that connects the printing head and the controller.

With this configuration, a control signal of the controller is sent to the printing head via the cable and the printing head is controlled. The cable can be used as means for sending the signal based on the placement confirmation for the printing head. Therefore, a system configuration can be simplified.

In a sixth aspect of the present disclosure, the printing head and the controller may be connected by a cable, the controller and the cleaning placing unit may be connected by a wired or wireless signal line different from the cable, and the placement detecting unit may be configured to send the signal based on the placement confirmation for the printing head to the control unit via the signal line.

In a seventh aspect of the present disclosure, the controller and the cleaning placing unit may be connected by a wired or wireless signal line capable of transmitting identification information of the controller to the cleaning placing unit and may be configured to send the signal based on the placement confirmation for the printing head and the identification information of the controller acquired in advance via the signal line to the control unit.

With this configuration, the identification information of the controller can be acquired beforehand. Since the identification information of the controller is sent to the control unit, the control unit can determine matching of the sent identification information and identification information of the control unit. When the identification information matches, the control unit can determine that the printing head is the printing head connected to the control unit. When the identification information does not match, the control unit can determine that the printing head is not the printing head connected to the control unit. Consequently, it is possible to more accurately determine possibility of the cleaning operation.

The identification information of the controller can be information specific to the controller such as a serial number of the controller, can be formed by, for example, numbers, characters, and signs, may be formed by any one of the numbers, the characters, the signs, and the like, or may be formed by combining any two of the numbers, the characters, the signs, and the like. The identification information of the controller and the signal based on the placement confirmation for the printing head may be simultaneously sent or may be sent at different timings.

In an eighth aspect of the present disclosure, the signal based on the placement confirmation for the printing head and the identification information of the controller may be sent to the control unit via the signal line.

With this configuration, the signal based on the placement confirmation for the printing head and the identification information of the controller can be sent to the control unit using the signal line for acquiring the identification information of the controller. Therefore, the system configuration can be simplified.

In a ninth aspect of the present disclosure, when the identification information of the printing head placed on the cleaning placing unit is acquired and the signal based on the placement confirmation for the printing head is sent, identification information of the printing head may also be sent to the control unit.

With this configuration, since the identification information of the printing head placed on the cleaning placing unit is sent to the control unit, it is possible to determine whether the printing head and the controller are connected to each other. Consequently, the possibility of the cleaning operation can be more accurately performed.

The identification information of the printing head can be information specific to the printing head such as a serial number of the printing head, can be formed by, for example, numbers, characters, and signs, may be formed by any one of the numbers, the characters, the signs, and the like, or may be formed by combining any two of the numbers, the characters, the signs, and the like. The identification information of the printing head and the signal based on the placement confirmation for the printing head may be simultaneously sent or may be sent at different timings.

In a tenth aspect of the present disclosure, the control unit and the cleaning placing unit may be communicably connected, the cleaning placing unit and the printing head may be communicably connected, the printing head and the control unit may be communicably connected, the control unit may transmit authentication information to the cleaning placing unit, the cleaning placing unit may transmit the authentication information transmitted from the control unit to the printing head, the printing head may transmit the authentication information transmitted from the cleaning placing unit to the control unit, and the control unit may execute, based on the authentication information transmitted to the cleaning placing unit and the authentication information received from the printing head, authentication processing for authenticating whether the printing head is connected to the control unit.

With this configuration, when the controller, the cleaning placing unit, and the printing head are regularly combined, the authentication information transmitted by the controller is transmitted to the control unit via the cleaning placing unit and the printing head. Therefore, it is authenticated in the authentication processing that the printing head is connected to the controller. On the other hand, when the controller, the cleaning placing unit, and the printing head are not regularly combined, reception itself of the authentication information is sometimes not performed and, in the authentication processing, inconsistency sometimes occurs between the authentication information transmitted by the control unit and the authentication information received from the printing head. Consequently, it can be determined that the controller, the cleaning placing unit, and the printing head are not regularly combined. Therefore, the possibility of the cleaning operation can be more accurately determined.

For example, the authentication information may be a serial number of the controller, may be a random number, or may be date and time information.

As explained above, with the ink jet recording system, it is possible to prevent the printing head not placed on the cleaning placing unit from being cleaned. Therefore, it is possible to prevent contamination of an ambient environment by the solvent.

DESCRIPTION OF EMBODIMENTS

Embodiments of the present invention are explained in detail below with reference to the drawings. Note that the following explanation of preferred embodiments is essentially only illustration and is not intended to limit the present invention and applications or uses of the present invention.

That is, in this specification, an industrial ink jet printer is explained as an example of an ink jet recording apparatus. However, a technique disclosed herein can be applied to, irrespective of names such as the ink jet recording apparatus and the industrial ink jet printer, apparatuses in general that use ink jet for flying particulate ink and impacting the ink on work.

In this specification, printing by the ink jet recording apparatus is explained. However, the "printing" includes all machining processes applied with ink jet such as printing of characters and marking of figures.

Overall Configuration

Figure 1:
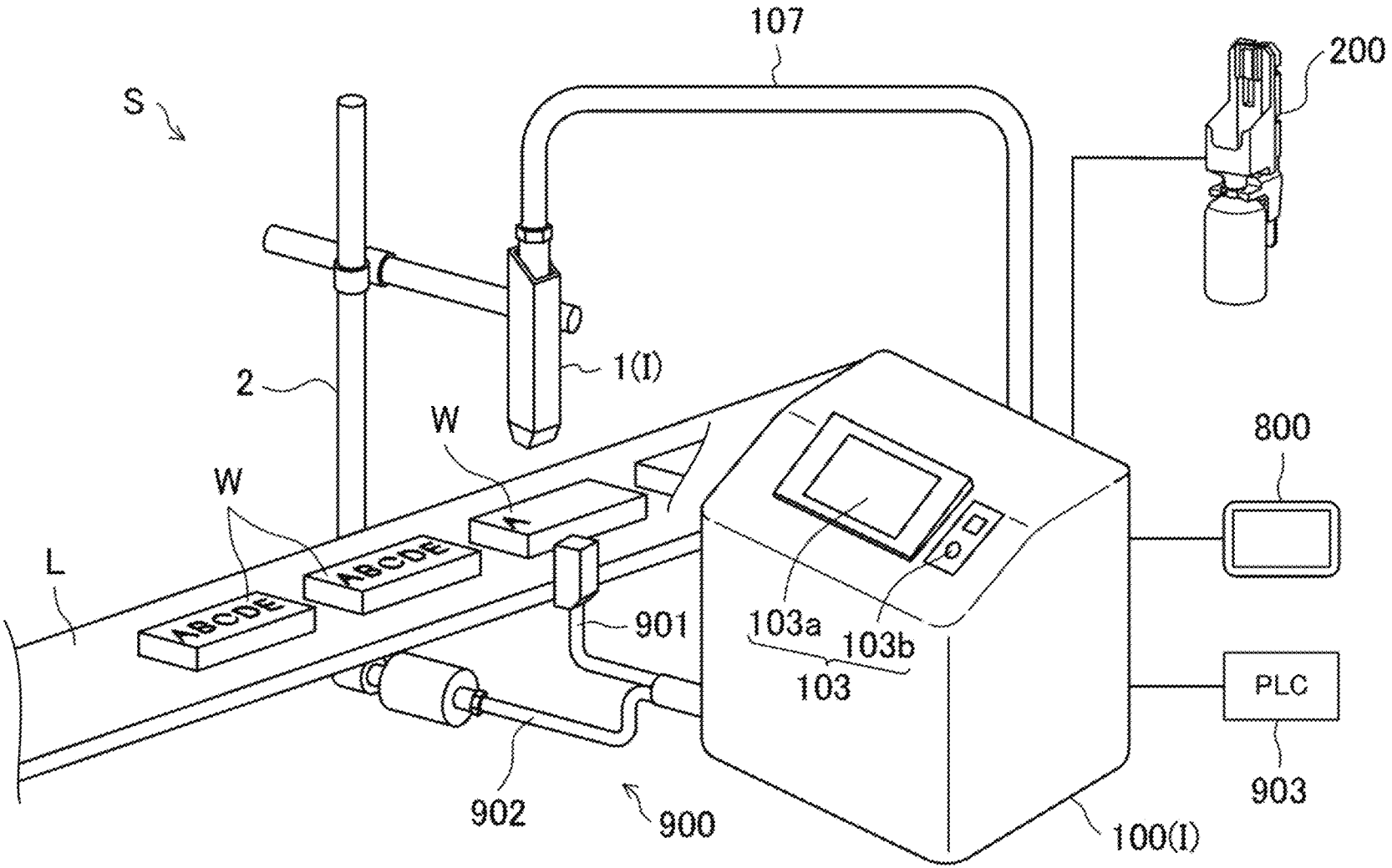
FIG. 1 is a diagram illustrating an overall configuration of an ink jet recording system.
Figure 2:
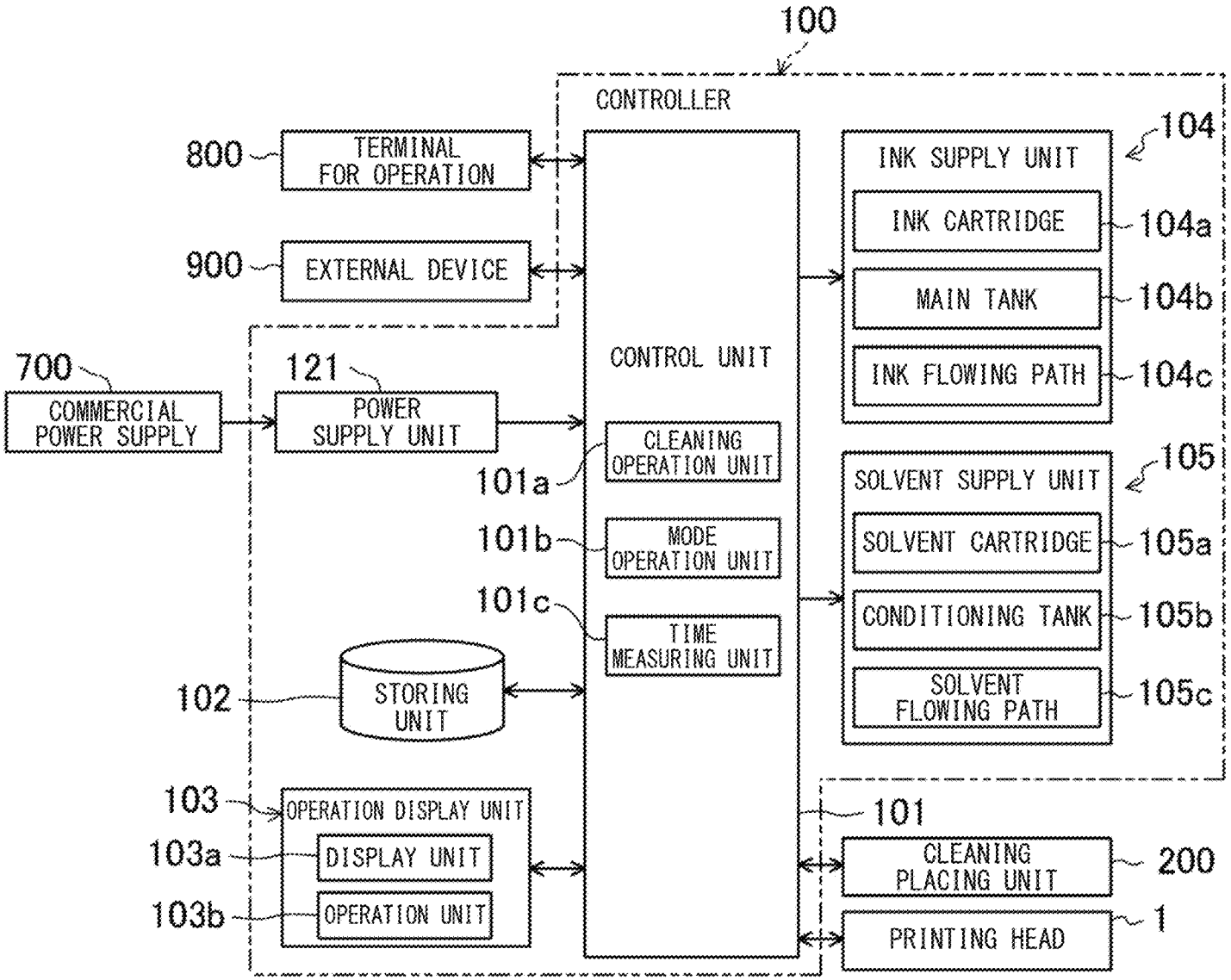
FIG. 2 is a block diagram illustrating a schematic configuration of an ink jet recording apparatus.
Figure 3:
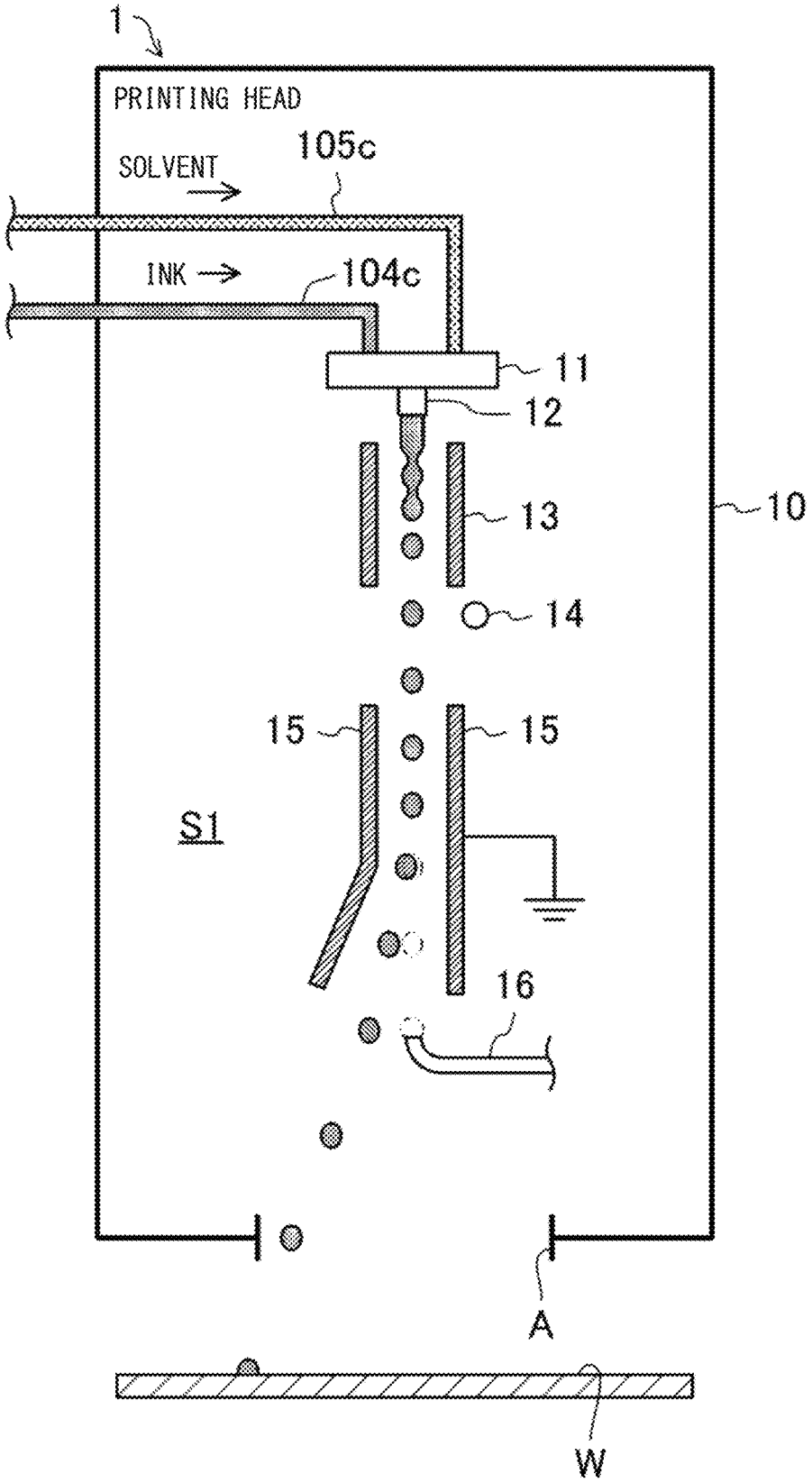
FIG. 3 is a diagram illustrating a schematic configuration of a printing head.
Figure 4:
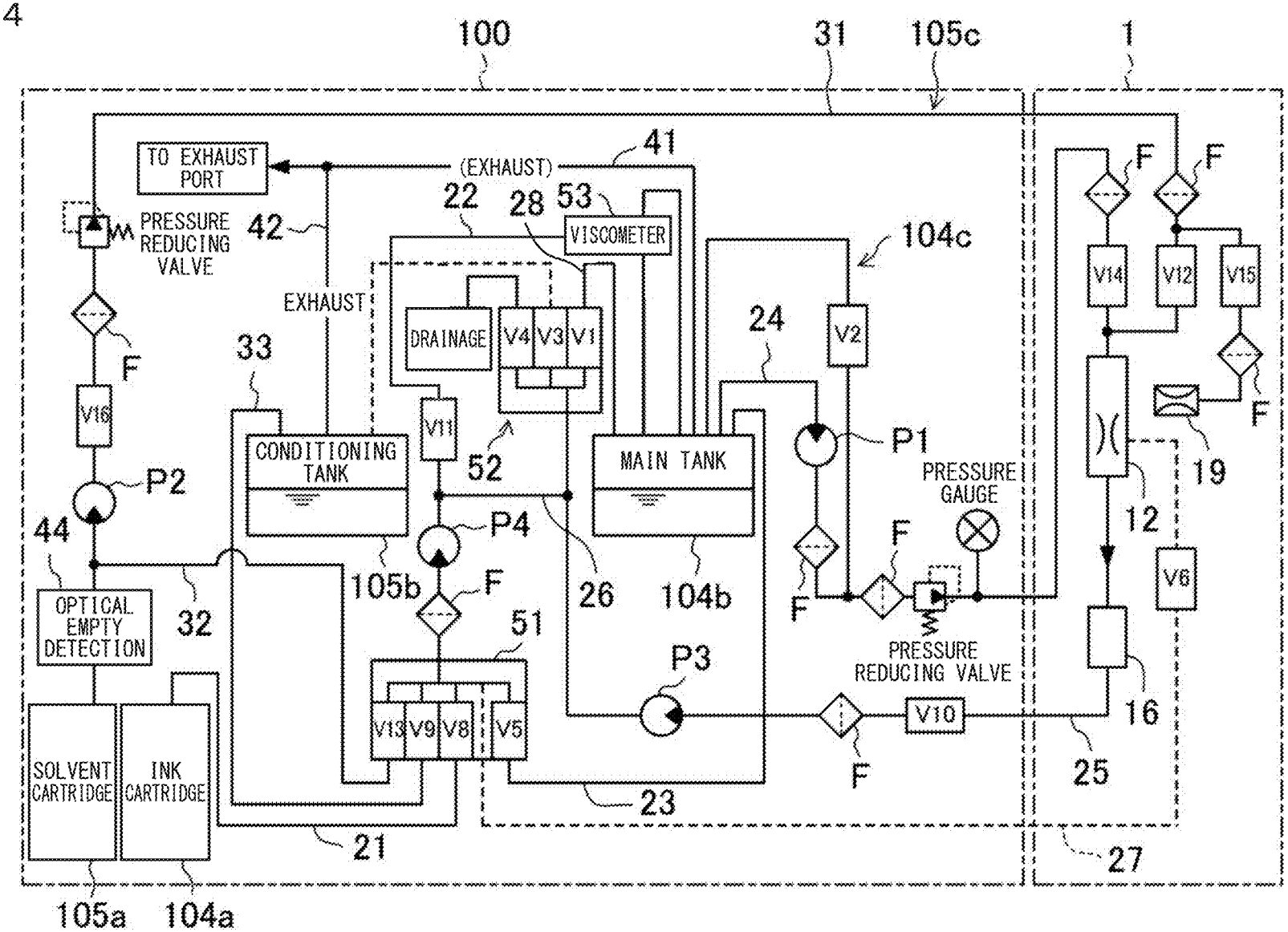
FIG. 4 is a diagram illustrating paths of ink and a solvent in the ink jet recording apparatus.

FIG. 1 is a diagram illustrating an overall configuration of an ink jet recording system S. FIG. 2 is a diagram illustrating a schematic configuration of an ink jet recording apparatus I. FIG. 3 is a diagram illustrating a schematic configuration of a printing head 1 in the ink jet recording apparatus I. FIG. 4 is a diagram illustrating paths of ink and a solvent in the ink jet recording apparatus I. The automatic printing system S illustrated in FIG. 1 is set in a conveyance line L of a factory or the like and is configured to apply, in order, printing to works W flowing in the conveyance line L. Note that an application target of the present disclosure is not limited to the automatic printing system S. The present disclosure can also be applied to a printing system that uses a method other than an automatic method. The conveyance line L can be configured by a belt conveyor or the like.

Specifically, the automatic printing system S includes the ink jet recording apparatus I that impacts particulate ink (ink droplets) on the work W to perform printing, a terminal for operation 800 and an external device 900 connected to the ink jet recording apparatus I, and a cleaning placing unit 200 that is connected to the ink jet recording apparatus I and performs cleaning of the printing head 1. Note that the terminal for operation 800 and the external device 900 are not essential.

The ink jet recording apparatus I illustrated in FIGS. 1 to 3 includes the printing head 1 that ejects ink droplets from a nozzle 12 and impacts the ink droplets on the work W and a controller 100 that supplies a control signal, ink, and a solvent to the printing head 1. The controller 100 supplies the control signal to the printing head 1 to control a trajectory of the ink droplets. Consequently, an impacting position of the ink droplets on the work W is adjusted and desired printing is realized.

In particular, the ink jet recording apparatus I according to this embodiment is configured as an ink jet printer of a so-called continuous type (a continuous ink jet printer: CIJ). That is, in the ink jet recording apparatus I, in order to prevent clogging (in particular, clogging of the nozzle 12) due to volatility of the ink, even when printing is not executed, the ink is always circulating on the inside of the ink jet recording apparatus I if the ink jet recording apparatus I is in an operation state. By adopting the continuous type, it is possible to use quick-drying ink without causing clogging by the ink.

The ink jet recording apparatus I according to this embodiment can clean units of the printing head 1 such as the nozzle 12 by feeding the solvent to the printing head 1. The solvent used for the cleaning is collected according to necessity and can be reused in order to adjust the concentration (viscosity) of the ink.

In order to realize the circulation of the ink, the printing head 1 includes, in addition to the nozzle 12 that ejects the ink or the solvent, a gutter 16 that collects the ink or the solvent ejected from the nozzle 12 (see FIG. 3). The ink or the solvent fed into the printing head 1 from the controller 100 is ejected from the nozzle 12 and collected by the gutter 16. The ink or the solvent collected in this way is fed back to the controller 100 and reused. By repeatedly performing such a process, the ink can be circulated.

The terminal for operation 800 includes, for example, a central processing unit (CPU) and a storage device and is connected to the controller 100. The terminal for operation 800 functions as a terminal for setting machining conditions in printing and indicating information relating to the printing to a user.

The machining conditions set by the terminal for operation 800 are output to the controller 100 and stored in a storing unit 102 of the controller 100. In addition to the storing unit 102 of the controller 100 or instead of the storing unit 102, the terminal for operation 800 may store the machining conditions.

Note that the machining conditions according to this embodiment include, in addition to content of a character string or the like that should be printed, conditions and parameters (hereinafter referred to as "cleaning setting" as well) relating to stop processing explained below.

Note that, for example, the terminal for operation 800 can be incorporated in and integrated with the controller 100. In this case, a name such as control unit is used rather than a name "terminal for operation".

The external device 900 is connected to the controller 100 according to necessity. In an example illustrated in FIGS. 1 and 2, a work detection sensor 901, a conveyance speed sensor 902, and a programmable logic controller (PLC) 903 are provided as the external device 900.

Specifically, the work detection sensor 901 detects presence or absence of the work W in the conveyance line L and outputs a signal (a detection signal) indicating a result of the detection to the controller 100. The detection signal output from the work detection sensor 901 functions as a trigger (a printing trigger) for starting printing.

The conveyance speed sensor 902 is configured from, for example, a rotary encoder and can detect conveyance speed of the work W. The conveyance speed sensor 902 outputs a signal (a detection signal) indicating a result of the detection to the controller 100. The controller 100 controls, based on the detection signal input from the conveyance speed sensor 902, for example, timing for ejecting ink droplets from the printing head 1.

As illustrated in FIG. 2, the PLC 903 is electrically connected to the controller 100. The PLC 903 is used in order to control the ink jet recording system S according to a predetermined sequence.

Besides the devices and the apparatuses explained above, apparatuses for performing operation and control and a computer, a storage device, a peripheral device, and the like for performing other various kinds of processing can also be connected to the ink jet recording apparatus I. The connection in this case may be, for example, a serial connection such as IEEE1394, RS-232, RS-422, and USB or parallel connection. Alternatively, electric, magnetic, or optical connection can also be adopted via a network such as 10BASE-T, 100BASE-TX, or 1000BASE-T. Besides wired connection, a wireless LAN such as IEEE802 or wireless connection using a radio wave, an infrared ray, optical communication, or the like such as Bluetooth (registered trademark) may be adopted. Further, as a storage medium used in a storage device for performing exchange of data, saving of various settings, and the like, for example, various memory cards, a magnetic disk, a magneto optical disk, a semiconductor memory, and a hard disk can be used.

Controller 100

The controller 100 is configured to be able to electrically control the printing head 1 and supply ink for printing and a solvent for diluting the ink to the printing head 1.

Specifically, the controller 100 according to this embodiment includes, as components relating to electric control, the storing unit 102 that stores the machining conditions, a control unit 101 that controls the units of the controller 100 and the printing head 1, an operation display unit 103 that receives operation by the user and displays information to the user, and a power supply unit 121 that leads electric power supplied from the outside to the control unit 101.

The controller 100 includes, as components relating to the supply of the ink and the like, an ink supply unit 104 that supplies the ink to the nozzle 12 of the printing head 1 and a solvent supply unit 105 that supplies the solvent to the nozzle 12 and the ink supply unit 104.

The control unit 101 may be configured as a unit separate from the ink supply unit 104 and the solvent supply unit 105. The storing unit 102 may also be configured as a unit separate from the ink supply unit 104 and the solvent supply unit 105. The operation display unit 103 may also be configured as a unit separate from the ink supply unit 104 and the solvent supply unit 105. In these cases, the components can be combined as the controller 100.

Storing Unit 102

The storing unit 102 is configured to store machining conditions set via the operation display unit 103 explained below or the terminal for operation 800 and output, based on a control signal from the outside, the stored machining conditions to the control unit 101.

Specifically, the storing unit 102 is configured using a volatile memory, a nonvolatile memory, a hard disk drive (HDD), a solid state drive (SSD), or the like and can temporarily or continuously store information indicating the machining conditions. Note that, when the terminal for operation 800 is incorporated in the controller 100, the terminal for operation 800 may be used as the storing unit 102 as well.

Control Unit 101

The control unit 101 controls, based on the machining conditions stored in the storing unit 102, at least the ink supply unit 104 and the solvent supply unit 105 in the controller 100 and the nozzle 12, a charging electrode 13, and a deflection electrode 15 in the printing head 1. The control unit 101 controls the units, whereby printing on the work W is carried out at predetermined timing.

Specifically, the control unit 101 includes, for example, a CPU, a memory, and an input and output bus and generates a control signal based on a signal indicating information input via the operation display unit 103 or the terminal for operation 800 and a signal indicating the machining conditions read from the storing unit 102. The control unit 101 outputs the control signal generated in that way to the units of the controller 100 and the ink jet recording apparatus I to thereby control printing on the work W.

For example, when printing on the work W, the control unit 101 reads printing content on the work W stored in the storing unit 102 and generates a control signal based on the printing content. The control unit 101 outputs the control signal to the charging electrode 13 to set a flying direction of ink droplets to realize an impacting position corresponding to the printing content.

Operation Display Unit 103

As illustrated in FIG. 1, the operation display unit 103 can be provided in, for example, a housing configuring the controller 100. However, the operation display unit 103 may be configured separately from the housing and set in a place different from the housing. The operation display unit 103 includes a display unit **103*a* that displays various kinds of information relating to the ink jet recording apparatus I and an operation unit 103*b* including, for example, a touch operation panel, buttons, and switches. The display unit 103*a* is configured by, for example, a liquid crystal display panel or an organic EL display panel, controlled by the control unit 101**, and configured to be capable of displaying a user interface and the like explained below as well.

When the user operates the operation unit **103*b* of the operation display unit 103, information concerning the operation is input to the control unit 101. The control unit 101 can detect what kind of operation is performed. For example, by operating the operation unit 103*b*, the user can switch power ON/OFF and the like of the ink jet recording apparatus I and perform input and the like of various settings and information. Note that, when the terminal for operation 800 is incorporated in the controller 100, the terminal for operation 800 may also be used as the operation display unit 103. The display unit 103*a* of the operation display unit 103 is a notifying unit that notifies various kinds of information to the user. The operation unit 103*b*** is an input unit capable of inputting various kinds of information.

Like the terminal for operation 800 explained above, the operation display unit 103 can also set machining conditions in printing. The machining conditions set by the operation display unit 103 are output to the controller 100 and stored in the storing unit 102 of the controller 100. The following explanation is based on the premise that the user operates the operation display unit 103. However, the terminal for operation 800 can also be used instead of the operation display unit 103.

Ink Supply Unit 104

The ink supply unit 104 includes, as main components, an ink cartridge 104*a* storing ink for filling, a main tank 104*b* to which the ink is supplied from the ink cartridge 104*a*, and an ink flowing path 104*c*. The ink cartridge 104*a*, the main tank 104*b*, and the printing head 1 are connected in terms of fluid via the ink flowing path 104*c*.

Among the components, the ink cartridge 104*a* is configured to be detachably attachable to the controller 100. The ink can be filled in the main tank 104*b* by replacing the ink cartridge 104*a*.

In this way, the ink jet recording apparatus I according to this embodiment is configured as an ink jet printer of a so-called "cartridge type". However, the ink jet recording apparatus I is not limited to this configuration. For example, a manually openable and closable tank may be provided. The ink jet recording apparatus I may be configured to fill the ink in the tank.

The main tank 104*b* is a container that stores the ink supplied to the nozzle 12. Specifically, the main tank 104*b* is configured to store the ink, the concentration (the viscosity) of which is adjusted by the solvent. In order to realize such a configuration, a path for solvent supply is connected to a path leading from the ink cartridge 104*a* to the main tank 104*b*.

The ink flowing path 104*c* is a path for supplying the ink to the printing head 1 and includes, for example, a path for feeding the ink into the nozzle 12 and a path for feeding back the ink from the gutter 16. The path for feeding the ink into the nozzle 12 connects the ink cartridge 104*a*, the main tank 104*b*, and the nozzle 12. The path for feeding back the ink from the gutter 16 connects the gutter 16 and the main tank 104*b*. The ink can be circulated between the printing head 1 and the controller 100 by these paths.

As explained below, a plurality of electromagnetic valves such as a first valve V1 and a plurality of pumps such as an ink pump P1 are provided in the ink flowing path 104*c*. The electromagnetic valves can open and close according to a control signal output from the control unit 101 and control a flow of the ink. On the other hand, the pumps can pressure-feed the ink according to a control signal output from the control unit 101 and control the flow of the ink like the electromagnetic valves.

Solvent Supply Unit 105

The solvent supply unit 105 includes, as main components, a solvent cartridge 105*a* that stores a solvent for filling, a conditioning tank 105*b* that stores the solvent used for cleaning, and a solvent flowing path 105*c*. The solvent cartridge 105*a*, the conditioning tank 105*b*, and the printing head 1 are connected in terms of fluid via the solvent flowing path 105*c*. The solvent flowing path 105*c*, in which the solvent flows, includes a plurality of paths. A part of the paths is also used as the path for feeding back the ink from the gutter 16.

The solvent cartridge 105*a* is configured to be detachably attachable to the controller 100. The solvent can be filled in the controller 100 by replacing the solvent cartridge 105*a*. A solvent tank may be provided instead of the solvent cartridge 105*a*. Note that the solvent supply unit 105 has a function of detecting whether the solvent in the solvent cartridge 105*a* is exhausted or the solvent is scarce. The solvent stored in the solvent cartridge 105*a* is used for concentration adjustment for the ink and used as a cleaning agent for cleaning, for example, the path in which the ink flows.

The conditioning tank 105*b* is configured to store the solvent used for the cleaning. As explained above, the solvent ejected from the nozzle 12 is collected by the gutter 16 like the ink. Accordingly, the path for feeding back the ink from the gutter 16 is also used as a path for feeding back the solvent.

The solvent flowing path 105*c* includes a path for supplying the solvent to the printing head 1, the main tank 104*b*, and the like and includes, for example, a path for feeding the solvent into the nozzle 12 and a path for feeding back the solvent from the gutter 16. The path for feeding the solvent into the nozzle 12 connects the solvent cartridge 105*a* and the nozzle 12. The path for feeding back the solvent from the gutter 16 also functions as the path for feeding back the ink as explained above.

As explained below, a plurality of electromagnetic valves such as a sixteenth valve V16 and a plurality of pumps such as a solvent pump P2 are provided in the solvent flowing path 105*c*. The electromagnetic valves can open and close according to a control signal output from the control unit 101 and control a flow of the solvent. On the other hand, the pumps can pressure-feed the solvent according to a control signal output from the control unit 101 and control the flow of the solvent like the electromagnetic valves.

Note that the classifications of the solvent flowing path 105*c* and the ink flowing path 104*c* are only classifications for convenience made for simplifying explanation. The solvent flowing path 105*c* and the ink flowing path 104*c* are substantially inseparable because the solvent flowing path 105*c* and the ink flowing path 104*c* are connected to each other or one also functions as the other.

Power Supply Unit 121

The power supply unit 121 is interposed between a commercial power supply 700 and the control unit 101. The power supply unit 121 can relay electric power supplied from the commercial power supply 700 and supply the electric power to the control unit 101.

Other Components

A connection cable 107 obtained by binding and coating an electric wire for transmitting and receiving a control signal, a tube for feeding and receiving the ink (specifically, a tube defining the ink flowing path 104*c*), and a tube for feeding and receiving the solvent (specifically, a tube defining the solvent flowing path 105*c*) is provided in the controller 100. The connection cable 107 has flexibility and is connected to the upper end portion of the printing head 1 (see FIG. 1). The controller 100 and the printing head 1 are connected electrically and in terms of fluid via the connection cable 107.

Printing Head 1

The printing head 1 ejects, as particulate ink droplets, the ink, the concentration of which is adjusted based on a control signal supplied from the controller 100, the ink, and the solvent. By deflecting a flying direction of the ink droplets ejected in that way and impacting the deflected ink droplets on the surface of the work W, the printing head 1 can execute printing on the work W.

Specifically, as illustrated in FIG. 3, the printing head 1 according to this embodiment includes a vibrator 11 that vibrates ink, the nozzle 12 that ejects the ink vibrated by the vibrator 11, the charging electrode 13 that charges particulate ink ejected from the nozzle 12, a charging detection sensor 14 that monitors a charging state of the ink, the deflection electrode 15 that deflects a flying direction of the ink charged by the charging electrode 13, and the gutter that collects the ink undeflected by the deflection electrode 15 or a solvent ejected from the nozzle 12.

The printing head 1 includes a housing 10 that houses the vibrator 11, the nozzle 12, the charging electrode 13, the charging detection sensor 14, the deflection electrode 15, and the gutter 16 on the inside and defines a flying space S1 for ink droplets. The printing head 1 can eject the ink droplets deflected by the deflection electrode 15 to the outside of the housing 10 via the flying space S1.

Figure 5:
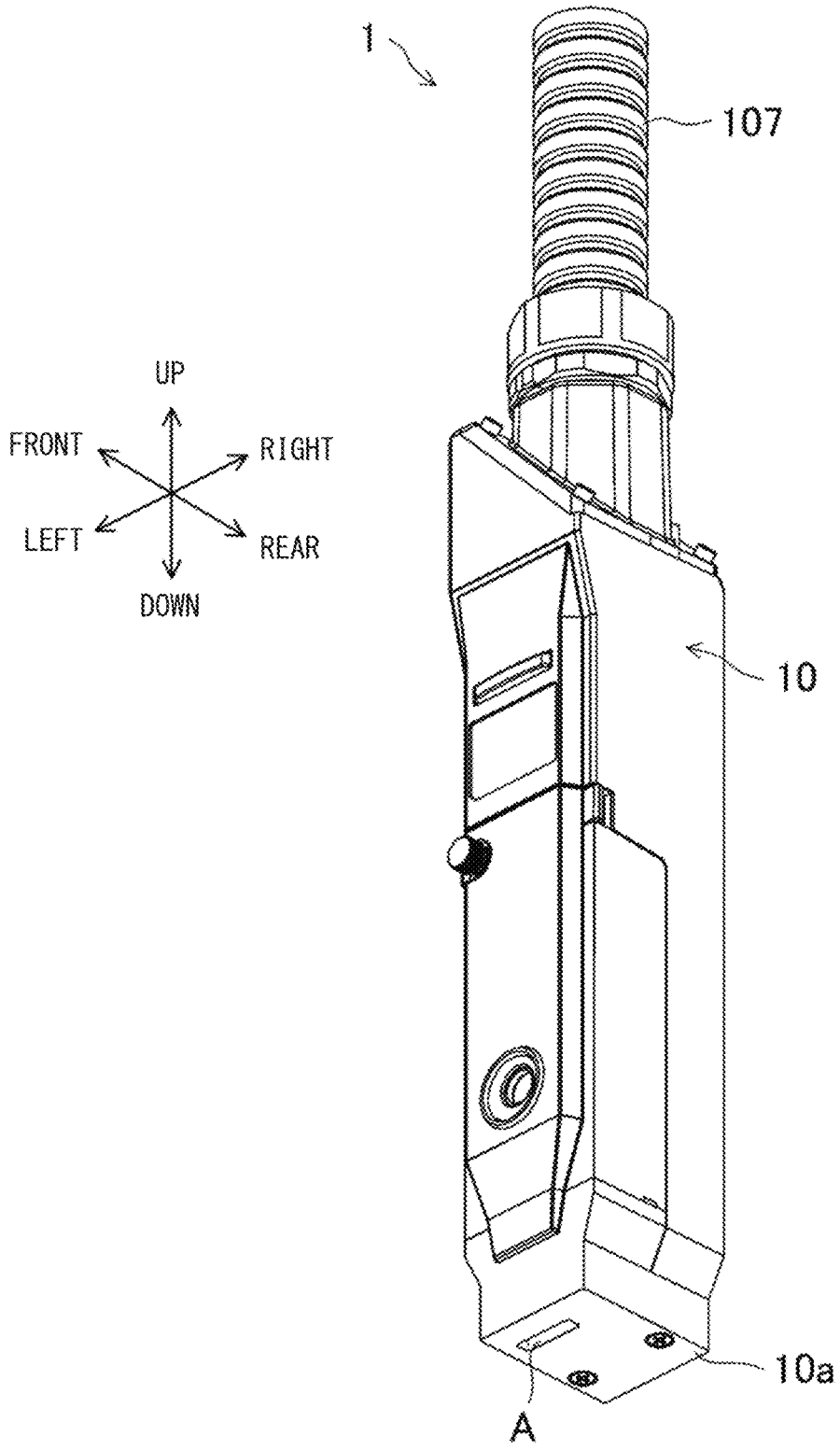
FIG. 5 is a perspective view of the printing head viewed from below.

As illustrated in FIG. 5, an ejection port A for ejecting the ink deflected by the deflection electrode 15 to the outside is opened on the lower surface of the housing 10 forming the outer shape of the printing head 1. The ink is ejected toward below the housing 10 from the ejection port A.

As illustrated in FIG. 1, the printing head 1 during printing is supported by, for example, a supporting member 2. The printing head 1 supported by the supporting member 2 is disposed such that the ejection port A of the printing head 1 is opposed to a printing surface of the work W from an upward direction. This place is an example of a setting place of the printing head 1 at the time when printing is performed by the ink jet recording apparatus I.

The units forming the printing head 1 are explained below in order. Note that, in the following explanation, an "up-down" direction indicates a direction along the vertical direction. For example, a paper surface upward direction of FIG. 3 is equivalent to an "upward direction" and a paper surface downward direction of FIG. 3 is equivalent to a "downward direction". In the other figures, a direction corresponding to this direction is referred to as "up-down direction".

Vibrator 11

As illustrated in FIG. 3, the vibrator 11 is disposed near the upper end in the flying space S1 of the housing 10. A device (for example, a piezo element) for giving up-down vibration to the ink (vibrating the ink) is incorporated in the vibrator 11 according to this embodiment. The vibrator is configured such that the ink is supplied via the connection cable 107. The vibrator 11 can vibrate the ink supplied in that way. The ink vibrated by the vibrator 11 is supplied to the nozzle 12.

Although not illustrated, the vibrator 11 according to this embodiment is grounded.

Nozzle 12

As illustrated in FIG. 3, the nozzle 12 is connected to the lower end portion of the vibrator 11 and disposed in a posture with an opening end (an ink jetting opening) of the nozzle 12 directed downward. The ink vibrated by the vibrator 11 can be ejected from the opening end of the nozzle 12. For example, a suction path 27 functioning as a return path for depressurizing the inside of the printing head 1 during a stop is connected to the nozzle 12 (see FIG. 4). The solvent can also be sucked from the nozzle 12 through the suction path 27.

The ink ejected from the nozzle 12 without being vibrated by the vibrator 11 flows as an axial so-called "ink axis". On the other hand, the vibrated ink is granulated immediately after being ejected from the nozzle 12 to be so-called "ink droplets". The ink ejected from the nozzle 12 is axial immediately after being ejected from the nozzle 12 but changes to be particulate as the ink moves further away from the nozzle 12. A position where the ink changes to be particulate is called breakpoint. The ink (the ink droplets) ejected from the nozzle 12 passes through the charging electrode 13 explained below.

Note that the solvent supplied to clean the printing head 1 passes through the vibrator 11 and the nozzle 12 in order and is ejected from the distal end portion of the nozzle 12. The solvent ejected in that way axially flows and passes through the charging electrode 13.

Charging Electrode 13

As illustrated in FIG. 3, the charging electrode 13 is configured by a pair of metal plates having conductivity and is disposed below the nozzle 12. The pair of metal plates configuring the charging electrode 13 is fixed to the housing 10 in a posture in which the longitudinal direction of the metal plates is set along the up-down direction and a posture in which the metal plates face each other in the horizontal direction. An interval between the pair of metal plates is set larger than a particle diameter of the ink ejected from the nozzle 12. The ink ejected from the nozzle 12 passes between the pair of metal plates.

Potential (positive potential) is applied to the charging electrode 13 according to this embodiment when at least a printing operation is executed. Consequently, it is possible to cause a potential difference between the vibrator 11 and the charging electrode 13 and electrify the ink droplets passing through the charging electrode 13. In order to electrify the ink droplets, the charging electrode 13 according to this embodiment is disposed near the breakpoint where the ink ejected from the nozzle 12 is granulated.

Pulse potential controllable by the controller 100 is applied to the charging electrode 13. When a relatively high voltage is applied to the charging electrode 13, a charging amount (the magnitude of negative charge) of the ink droplets is larger compared with when a voltage lower than the relatively high voltage is applied. When the charging amount is large, the ink droplets are greatly deflected by the deflection electrode 15 compared with when the charge amount is small. The controller 100 can control a deflection amount of the ink droplets by adjusting the magnitude of the pulse potential. The ink droplets charged by the charging electrode 13 pass the side of the charging detection sensor 14 and reach the deflection electrode 15.

The solvent ejected from the nozzle 12 passes the side of the charging detection sensor 14 and reaches the deflection electrode 15 without being charged.

Charging Detection Sensor 14

As illustrated in FIG. 3, the charging detection sensor 14 is disposed below the charging electrode 13. Specifically, the charging detection sensor 14 is disposed not to cross a trajectory of flying of the ink droplets below the metal plates (in an example illustrated in FIG. 3, the metal plate on the paper surface right side) configuring the charging electrode 13. By disposing the charging detection sensor 14 in this way, it is possible to avoid collision of the ink droplets and the charging detection sensor 14.

The charging detection sensor 14 according to this embodiment is connected to a circuit board provided on the inside of the housing 10. The charging detection sensor 14 can detect a charging state of the ink droplets passing the side of the charging detection sensor 14. A result of the detection by the charging detection sensor 14 is output to the control unit 101 as a detection signal. The control unit 101 can determine, based on the detection signal, whether the ink droplets are appropriately charged.

Deflection Electrode 15

As illustrated in FIG. 3, the deflection electrode 15 is configured by a pair of metal plates having conductivity (so-called "counter electrodes") and is disposed below the charging electrode 13 and the charging detection sensor 14. The pair of metal plates are fixed to the housing 10 in a posture in which the longitudinal direction of the metal plates is set along substantially the up-down direction and a posture in which the metal plates face each other in the horizontal direction. The ink droplets passing between the pair of metal plates configuring the charging electrode 13 pass between the pair of metal plates configuring the deflection electrode 15.

A voltage controllable by the controller 100 is applied to the deflection electrode 15. Consequently, a potential difference occurs between the pair of metal plates configuring the deflection electrode 15. A flying direction of the ink droplets can be deflected by the potential difference according to a charging amount of the ink droplets. The flying direction of the ink droplets can be deflected along an arranging direction of the pair of metal plates configuring the deflection electrode 15.

That is, the flying direction of the ink droplets can be controlled via the voltages respectively applied to the charging electrode 13 and the deflection electrode 15. The ink droplets, the flying direction of which is controlled, include the ink droplets deflected by the deflection electrode 15 and the ink droplets not deflected (undeflected) by the deflection electrode 15. The ink droplets deflected by the deflection electrode 15 are involved in the printing on the work W. The ink droplets deflected by the deflection electrode 15 are ejected from the ejection port A provided on the lower surface of the housing 10 and are impacted on the work W.

On the other hand, the ink droplets undeflected by the deflection electrode 15 are not involved in the printing on the work W. Such ink droplets or axial ink not granulated in the first place reaches the inside of the gutter 16 as indicated by a chain line in FIG. 3. Similarly, the solvent used for the cleaning of the nozzle 12 and the like in the printing head 1 and passed through the deflection electrode 15 also reaches the inside of the gutter 16.

Gutter 16

As illustrated in FIG. 3, the gutter 16 is configured by a bent pipe, an opening end of which is directed upward, and is disposed below the deflection electrode 15. The gutter according to this embodiment can collect the ink not involved in the printing on the work W and the solvent passed through the nozzle 12 (specifically, the solvent ejected from the nozzle 12).

Specifically, in this embodiment, the opening end (the upstream end) of the gutter 16 and the opening end of the nozzle 12 are disposed to face each other. The opening end of the nozzle 12 is located right above the opening end of the gutter 16. By disposing the opening ends in this way, fluid flowing along the vertical direction from the opening end of the nozzle 12 can be received from the opening end of the gutter 16.

The ink or the solvent collected by the gutter 16 is fed back to the controller 100 through the ink flowing path 104*c*, the solvent flowing path 105*c*, or the like and stored in the main tank 104*b* or the conditioning tank 105*b*.

In the following explanation, in order to explain the collection of the ink or the solvent by the gutter 16 in detail, configurations relating to the ink flowing path 104*c* and the solvent flowing path 105*c* are explained with reference to FIG. 4. Note that components denoted by a sign F in FIG. 4 illustrate filters. In the following explanation, explanation about the disposition, the configuration, and the like of the filters F is omitted.

About the Paths for the Ink and the Solvent

As explained above, the controller 100 according to this embodiment includes the ink flowing path 104*c* for supplying the ink to the printing head 1 and the solvent flowing path 105*c* for supplying the solvent to the printing head 1, the main tank 104*b*, and the like.

Specifically, the ink flowing path 104*c* includes, as paths relating to the supply of the ink to the nozzle 12, a first ink path 21 that connects the ink cartridge 104*a* and a first dividing unit 51, a sixth ink path 26 that connects the first dividing unit 51 (specifically, a halfway part in a second ink path 22) and a second dividing unit 52, an eighth ink path 28 that connects the second dividing unit 52 and the main tank 104*b*, and a fourth ink path 24 that connects the main tank 104*b* and the nozzle 12. The sixth ink path 26 according to this embodiment is connected to the second dividing unit 52 via a fifth ink path 25 explained below.

The ink flowing path 104*c* includes, as paths relating to viscosity measurement by a viscometer 53, a second ink path 22 that connects the first dividing unit 51 and the main tank 104*b* and in which the viscometer 53 is interposed and a third ink path 23 that is provided independently from the second ink path 22 and connects the main tank 104*b* and the first dividing unit 51.

The ink flowing path 104*c* includes, as a path relating to the collection of the ink by the gutter 16, a fifth ink path 25 that connects the gutter 16 and the main tank 104*b*.

In the second ink path 22, a circulation pump P4, an eleventh valve V11, and the viscometer 53 are provided in order. In the fourth ink path 24, the ink pump P1, a pressure reducing valve, a pressure gauge, and a fourteenth valve V14 are provided in order. In the fifth ink path 25, a tenth valve V10, a gutter pump P3, and the second dividing unit 52 are provided in order.

On the other hand, the solvent flowing path 105*c* includes, as a path relating to the supply of the solvent to the nozzle 12, a first solvent path 31 that connects the solvent cartridge 105*a* and the nozzle 12.

The solvent flowing path 105*c* may include, as a path relating to concentration (viscosity) adjustment for the ink by the solvent stored in the solvent cartridge 105*a* (a partial element of a path that connects the solvent cartridge 105*a* and the main tank 104*b*), a second solvent path 32 that connects a halfway part in the first solvent path 31 and the first dividing unit 51.

The solvent flowing path 105*c* may include, as a path relating to concentration adjustment by the solvent stored in the conditioning tank 105*b* (a partial element of a path that connects the main tank 104*b* and the conditioning tank 105*b*), a third solvent path 33 that connects the first dividing unit 51 and the conditioning tank 105*b*.

The fifth ink path 25 illustrated as the ink flowing path 104*c* relates to the collection of the solvent by the gutter 16. As explained above, the classifications of the "ink flowing path 104*c*" and the "solvent flowing path 105*c*" are only classifications for convenience.

In the first solvent path 31, an optical empty detecting mechanism 44, the solvent pump P2, the sixteenth valve V16, and a twelfth valve V12 are provided in order. A cleaning nozzle 19 functioning as a solvent jetting unit is connected to the first solvent path 31. The cleaning nozzle 19 is a nozzle for cleaning the vibrator 11 in the printing head 1, the distal end portion of the nozzle 12, the charging electrode 13, the deflection electrode 15, and the like by jetting the solvent thereto. The cleaning nozzle 19 can jet the solvent used as the cleaning liquid. A fifteenth valve V15 is provided halfway between the cleaning nozzle 19 to the first solvent path 31.

The first dividing unit 51 includes a fifth valve V5 that opens and closes between the third ink path 23 and the second ink path 22, an eighth valve V8 that opens and closes between the first ink path 21 and the second ink path 22, a ninth valve V9 that opens and closes between the third solvent path 33 and the second ink path 22, and a thirteenth valve V13 that opens and closes between the second solvent path 32 and the second ink path 22.

The second dividing unit 52 includes a first valve V1 that opens and closes between the sixth ink path 26 and the eighth ink path 28, a third valve V3 that opens and closes between the sixth ink path 26 and the conditioning tank 105*b*, and a fourth valve V4 that opens and closes between the sixth ink path 26 and a waste liquid tank (in FIG. 4, illustrated as "waste liquid").

The control unit 101 can configure a desired path in the controller 100 by outputting control signals to the valves provided in the paths and outputting control signals to the valves forming the first dividing unit 51 and the second dividing unit 52.

For example, by opening the eighth valve V8 and the first valve V1, it is possible to supply the ink from the ink cartridge 104*a* to the main tank 104*b*. By opening the fifth valve V5 and the eleventh valve V11, it is possible to circulate the ink among the second ink path 22, the main tank 104*b*, and the third ink path 23 and measure the viscosity of the ink with the viscometer 53, although this is not an original circulation operation.

The same applies to the paths relating to the solvent. For example, by opening the third valve V13 and the first valve V1, it is possible to supply the solvent stored in the solvent cartridge 105*a* to the main tank 104*b* and adjust the concentration of the ink stored in the tank. By opening the ninth valve V9 and the first valve V1, the solvent mixed with the ink stored in the conditioning tank 105*b* is supplied to the main tank 104*b* passing through the third solvent path 33, the first dividing unit 51, the sixth ink path 26, the second dividing unit 52, and the eighth ink path 28.

The controller 100 also includes a path relating to a flow of the air. For example, a first exhaust pipe 41 communicating with a not-illustrated exhaust port is connected to the main tank 104*b*. Similarly, a second exhaust pipe 42 communicating with the exhaust port is connected to the conditioning tank 105*b*.

As another example of the path relating to the flow of the air, the controller 100 includes the suction path 27 that connects the nozzle 12 and the first dividing unit 51. A sixth valve V6 is provided in the suction path 27. By opening the sixth valve V6 and the fifth valve V5, it is possible to cause the nozzle 12 to communicate with the atmosphere via the suction path 27, the first dividing unit 51, the sixth ink path 26, the second dividing unit 52, the eighth ink path 28, the main tank 104*b*, and the first exhaust pipe 41. Consequently, it is possible to adjust a jetting pressure of the ink droplets ejected from the nozzle 12.

When printing is carried out, by opening the fourteenth valve V14, the ink is supplied from the main tank 104*b* via the fourth ink path 24. The ink supplied in that way changes to particulate ink droplets and is ejected from the nozzle 12.

In the ink (the ink droplets) ejected from the nozzle 12, the ink involved in the printing is ejected from the printing head 1 as explained with reference to FIG. 3. On the other hand, the ink not involved in the printing and the solvent used for the cleaning of the nozzle 12 and the like are collected by the gutter 16 and fed back to the controller 100 through the fifth ink path 25.

In that case, the ink that should be fed back to the main tank 104*b* is supplied from the first dividing unit 51 to the main tank 104*b* via the sixth ink path 26, the first valve V1 in the second dividing unit 52, and the eighth ink path 28. On the other hand, the solvent that should be fed back to the conditioning tank 105*b* is supplied from the fifth path 25 to the conditioning tank 105*b* via the third valve V3 in the second dividing unit 52.

The collection of the ink or the solvent by the gutter is performed, for example, in relation to the start processing and the stop processing for the ink jet recording apparatus I. The "start processing" means processing executed before the printing is started when a power supply of the ink jet recording apparatus I is turned on. On the other hand, the "stop processing" means processing executed before the operation of the ink jet recording apparatus I is stopped when the power supply of the ink jet recording apparatus I is turned off.

Specifically, the ink jet recording apparatus I according to this embodiment does not immediately start the printing even if a power switch is turned on. The ink jet recording apparatus I executes predetermined start processing before starting the printing. In the start processing, the ejection of the ink is started after the printing head 1 is cleaned using the solvent. The ink ejected immediately after the start of the start processing forms the ink axis explained above and is collected by the gutter 16.

Similarly, when the power switch is about to be turned off, the ink jet recording apparatus I according to this embodiment does not immediately stop the operation of the ink jet recording apparatus I. The ink jet recording apparatus I executes predetermined stop processing including nozzle cleaning before stopping the operation. In the stop processing, by ejecting the solvent from the nozzle 12, the ink remaining in the nozzle 12 can be cleaned and collected. The ink discharged from the nozzle 12 according to the ejection of the solvent is collected by the gutter 16 like the ink axis in the start processing.

Note that the "power switch" in this embodiment includes, in addition to a physical push button, switches configured on a touch operation panel displayed on the operation display 103 or the like. OFF operation of the power switch indicates, in addition to operation for physically pressing the push button, shutdown operation instructed through the terminal for operation 800, the operation display unit 103, and the like. The same applies to ON operation of the power switch.

The start processing and the stop processing for the ink jet recording apparatus I are explained in detail below.

Basic Operation of the Ink Jet Recording Apparatus I

Figure 6:
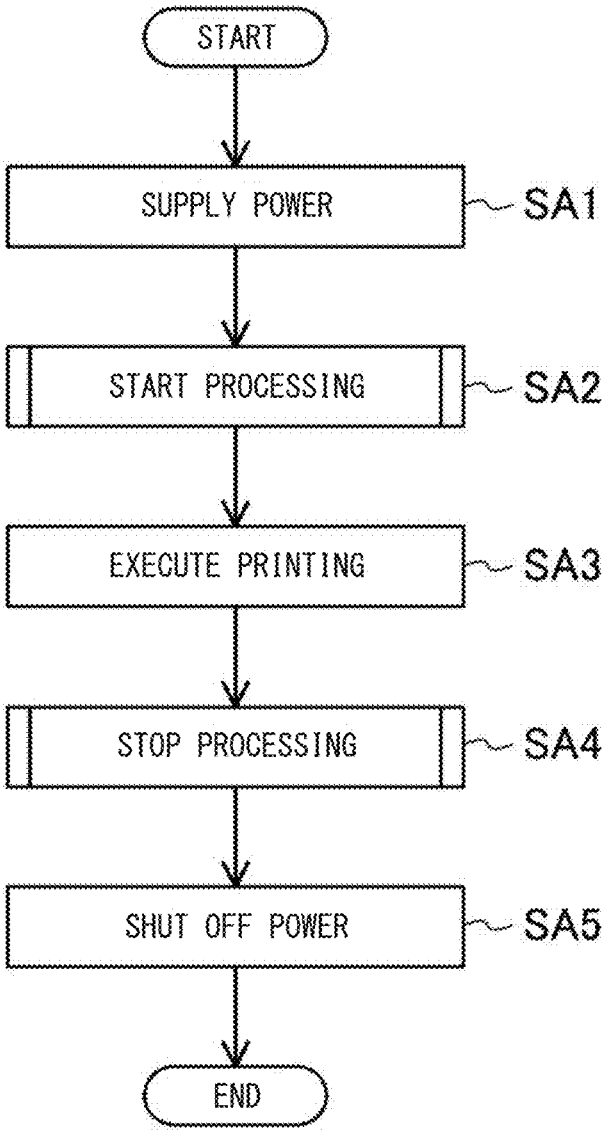
FIG. 6 is a flowchart illustrating a basic operation of the ink jet recording apparatus.

FIG. 6 is a flowchart illustrating a basic operation of the ink jet recording apparatus I. The flowchart illustrates a basic operation of the ink jet recording apparatus I such as the start processing.

First, in step SA1 in FIG. 6, the power switch of the ink jet recording apparatus I is switched from OFF to ON and the ink jet recording apparatus I is turned on.

In step SA2 following step SA1, the control unit 101 executes the start processing.

Figure 7:
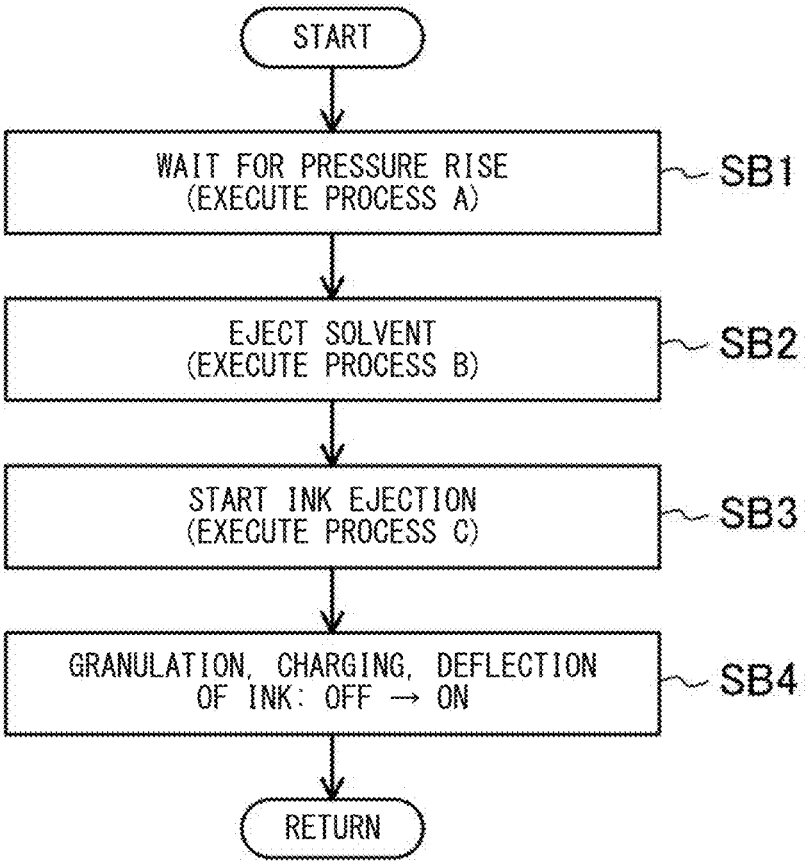
FIG. 7 is a flowchart illustrating start processing for the ink jet recording apparatus.

FIG. 7 is a flowchart illustrating the start processing for the ink jet recording apparatus I. The flowchart illustrates details of step SA2 in FIG. 6. That is, four steps SB1, SB2, SB3, and SB4 in FIG. 7 configure step SA2 in FIG. 6.

Figure 8:
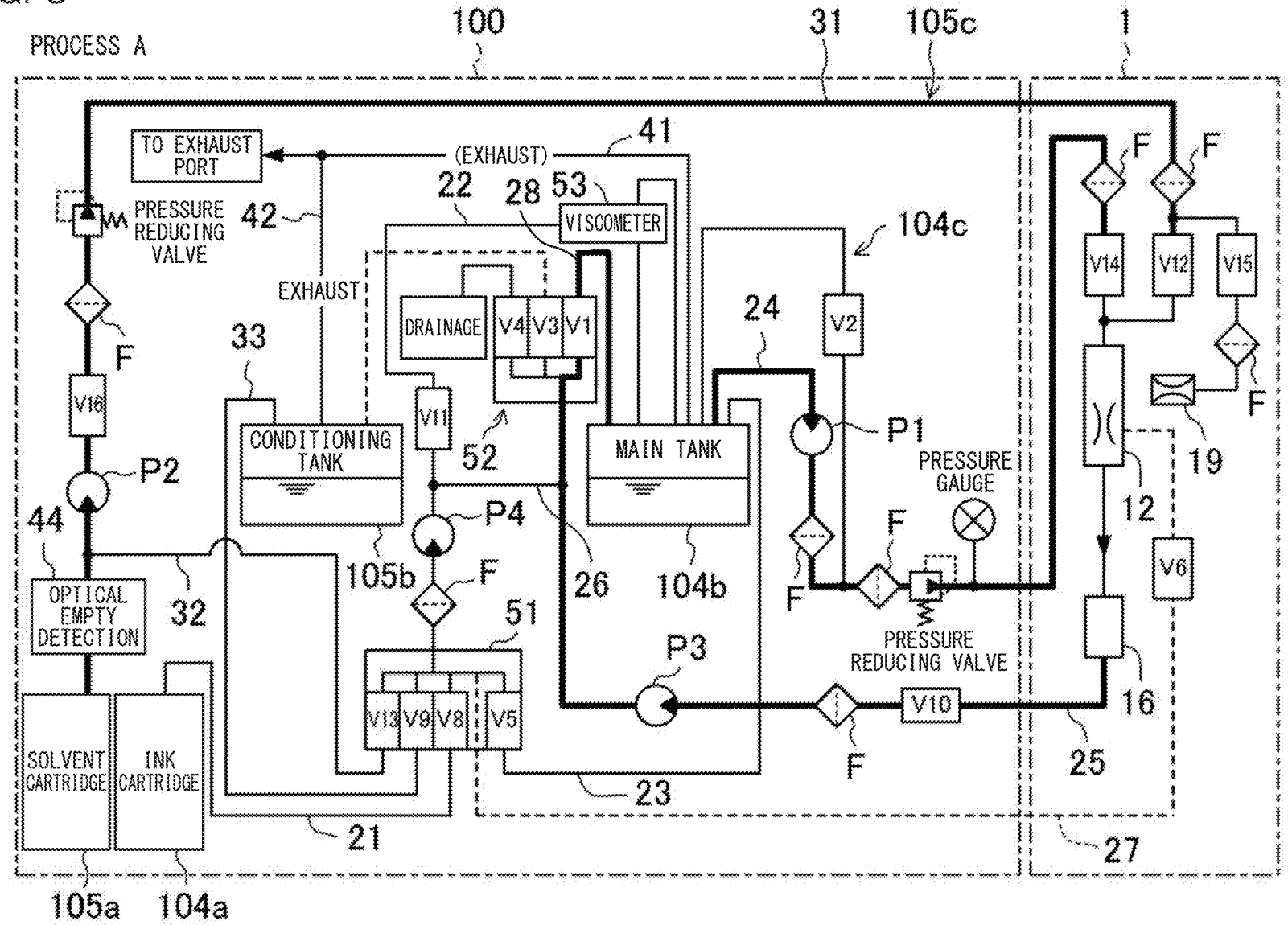
FIG. 8 is a diagram for explaining a process A in the start processing.
Figure 9:
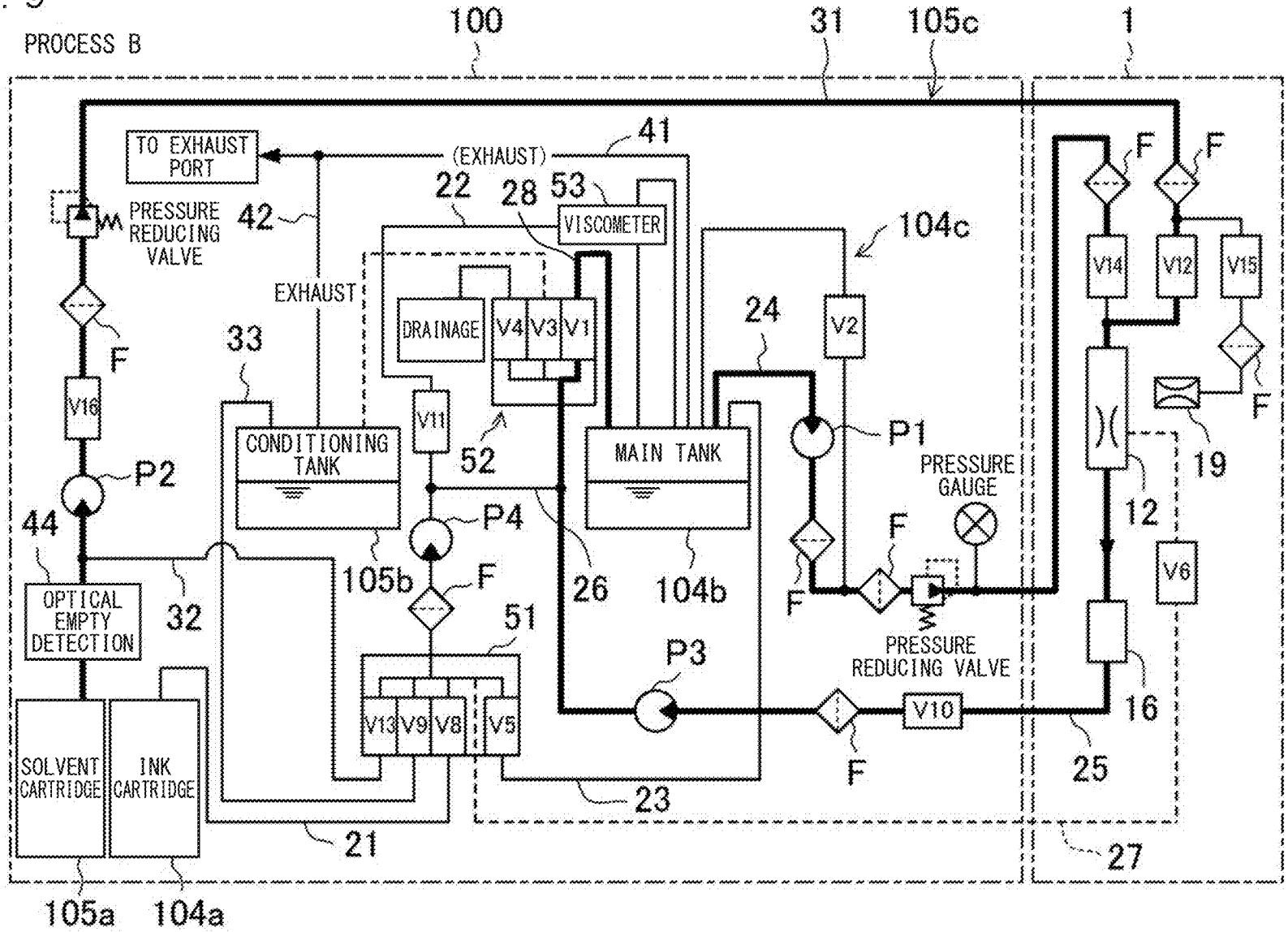
FIG. 9 is a diagram for explaining a process B in the start processing.
Figure 10:
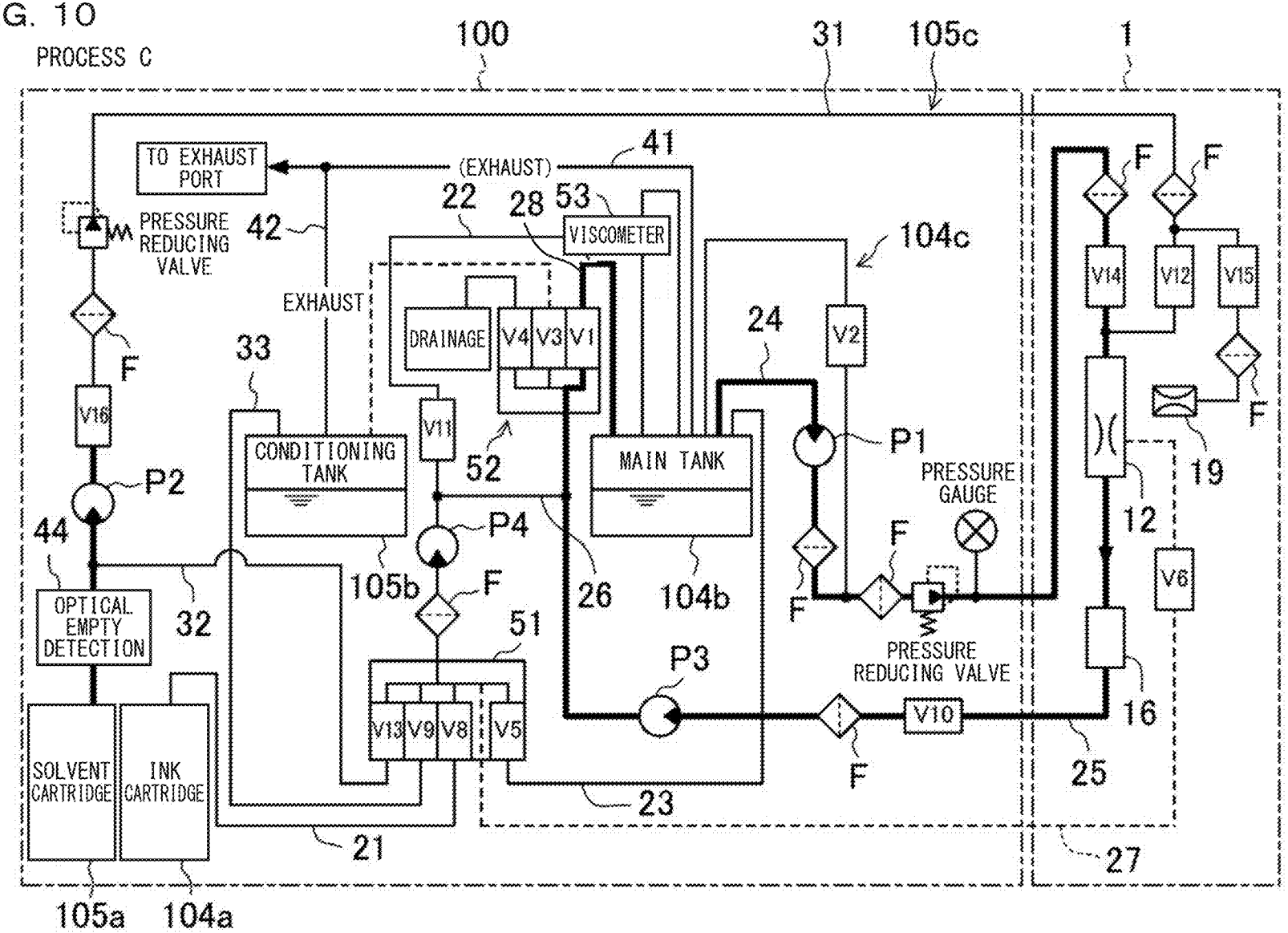
FIG. 10 is a diagram for explaining a process C in the start processing.

FIG. 8 is a diagram for explaining a process A in the start processing. FIG. 9 is a diagram for explaining a process B in the start processing. FIG. 10 is a diagram for explaining a process C in the start processing.

In step SB1, the control unit 101 executes the process A and pressurizes the paths of the ink and the solvent in the ink jet recording apparatus I. In the process A, in order to prepare the solvent, the control unit 101 puts the twelfth valve V12 on standby in a closed state in a state in which the sixteenth valve V16 is opened. The solvent pump P2 operates in the state, whereby the solvent stored in the solvent cartridge 105*a* is supplied to near the twelfth valve V12 via the first solvent path 31 (see a thick line in FIG. 8).

In order to prepare the ink, the control unit 101 puts the fourteenth valve V14 on standby in a closed state. In that state, the ink pump P1 operates, whereby the pressure of the ink in the fourth ink path 24 rises (see a thick line in FIG. 8).

In order to prepare the gutter 16, the control unit 101 puts the tenth valve V10 and the first valve V1 on standby in an open state. In the state, the gutter pump P3 operates, whereby the ink or the solvent collected by the gutter 16 can be fed back to the main tank 104*b* via the fifth ink path 25 and the second dividing unit 52 (see a thick line in FIG. 8).

In the process A, a detection signal of the pressure gauge is input to the control unit 101. The control unit 101 stays on standby based on the detection signal until the pressure of the fourth ink path 24 rises to a specified value or more.

In step SA2 following step SA1, the control unit 101 executes the process B and ejects the solvent from the nozzle 12. In the process B, the control unit 101 opens the twelfth valve V12, whereby the solvent is sucked and ejected from the nozzle 12. The solvent ejected in that way is collected by the gutter 16. Since the process B is executed for a short period of one second or less, a small amount of the solvent is ejected compared with the other steps. Accordingly, the solvent ejected in the process B is fed back from the fifth ink path 25 to the main tank 104*b* via the first valve V1 (see a thick line in FIG. 9).

Note that, when a large amount of the solvent is jetted in the process B, the third valve V3 is opened rather than the first valve 1. The solvent is fed back from the fifth ink path 25 to the conditioning tank 105*b*.

In step SA3 following step SA2, the control unit 101 executes the process C and ejects the ink from the nozzle 12. In the process C, in order to eject the ink, the control unit 101 closes the twelfth valve V12 and opens the fourteenth valve V14. Consequently, axial ink (an ink axis) is ejected from the nozzle 12. The ink ejected in that way is collected by the gutter 16. The ink collected in that way is fed back from the fifth ink path 25 to the main tank 104*b* via the first valve V1 (see a thick line in FIG. 10).

In step SA4 following step SA3, the control unit 101 starts vibration of the ink ejected from the nozzle 12 and voltage application to the charging electrode 13 and the deflection electrode 15. Consequently, it is possible to granulate, charge, and deflect the ink.

When the processing illustrated in step SA4 ends, the processing is returned from the control process illustrated in FIG. 7 to the control process illustrated in FIG. 6. The control unit 101 executes step SA3 following step SA2.

In step SA3, the control unit 101 impacts particulate ink (ink droplets) on the work W to perform printing on the work W.

When a printing operation on the work W is started, as illustrated in FIG. 3, the ink vibrated by the vibrator 11 is ejected from the nozzle 12. The ink is supplied from the ink supply unit 104 of the controller 100 as appropriate. The ink ejected from the nozzle 12 starts granulation immediately after the ejection and is charged by the charging electrode 13 at a stage where the ink is granulated. The ink droplets charged by the charging electrode 13 pass through the deflection electrode 15 after a charging state of the ink droplets is detected by the charging detection sensor 14.

The ink droplets, a flying direction of which is deflected by the deflection electrode 15, pass the flying space S1 in the housing 10 and are ejected to the outside of the printing head 1. The ink droplets ejected from the printing head 1 are impacted on the surface of the work W and form characters or figures as illustrated in FIG. 1. Impacting positions of the ink droplets are controlled via a charging amount of the ink droplets and an applied voltage to the deflection electrode 15.

As explained above, the ink jet recording apparatus I according to this embodiment is configured as the ink jet printer of the continuous type. Therefore, in a printable state after the start processing (an operation state of the ink jet recording apparatus I), even when printing is not executed, the ink is continuously ejected from the nozzle 12. The ink ejected at this time is not deflected (in other words, "undeflected") by the deflection electrode 15. The undeflected ink is not involved in the printing, collected by the gutter 16, circulates in the apparatus, and is reused.

It is conceived that the printing is smoothly completed and the ink jet recording apparatus I is normally shut down. Specifically, it is assumed that, in step SA3, the power switch of the ink jet recording apparatus I is about to be switched from ON to OFF.

In this case, in step SA4, the control unit 101 executes the stop processing. The stop processing is illustration of a "cleaning operation" in this embodiment. A cleaning operation unit 101*a* of the control unit 101 executes the cleaning operation.

Figure 11:
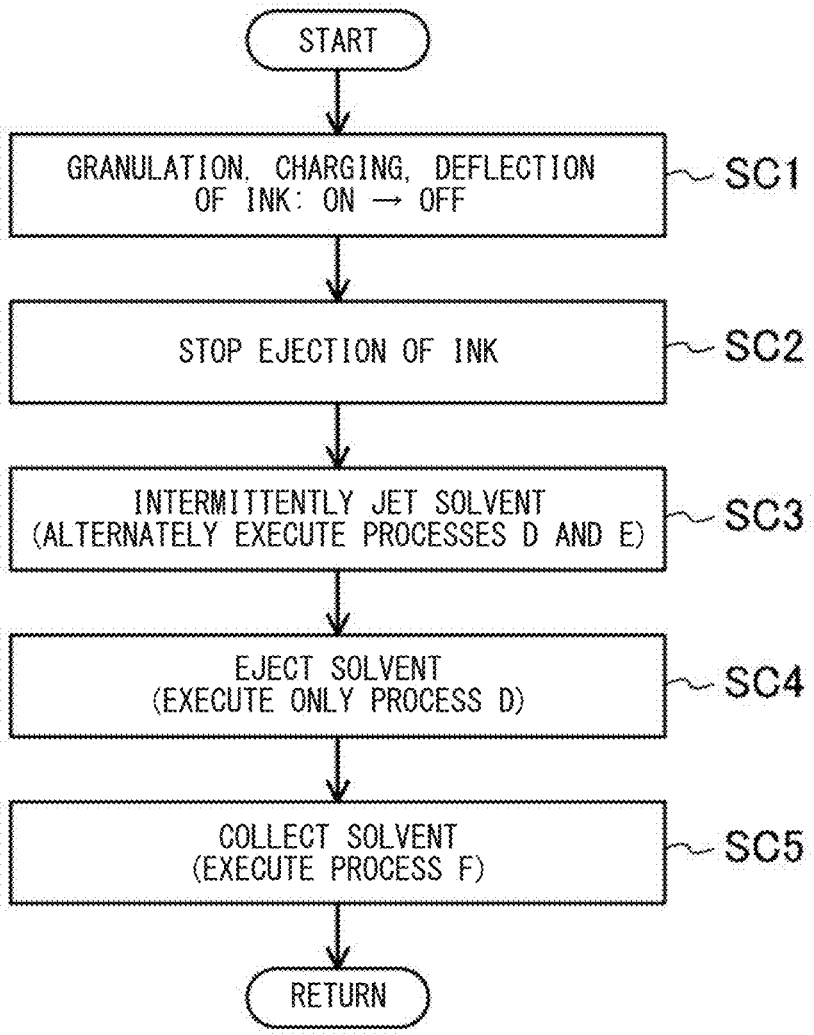
FIG. 11 is a flowchart illustrating stop processing for the ink jet recording apparatus.

FIG. 11 is a flowchart illustrating the stop processing for the ink jet recording apparatus I. The flowchart illustrates details of step SA4 in FIG. 6. That is, five steps SC1 to SC5 in FIG. 11 configure step SA4 in FIG. 6.

Figure 12:
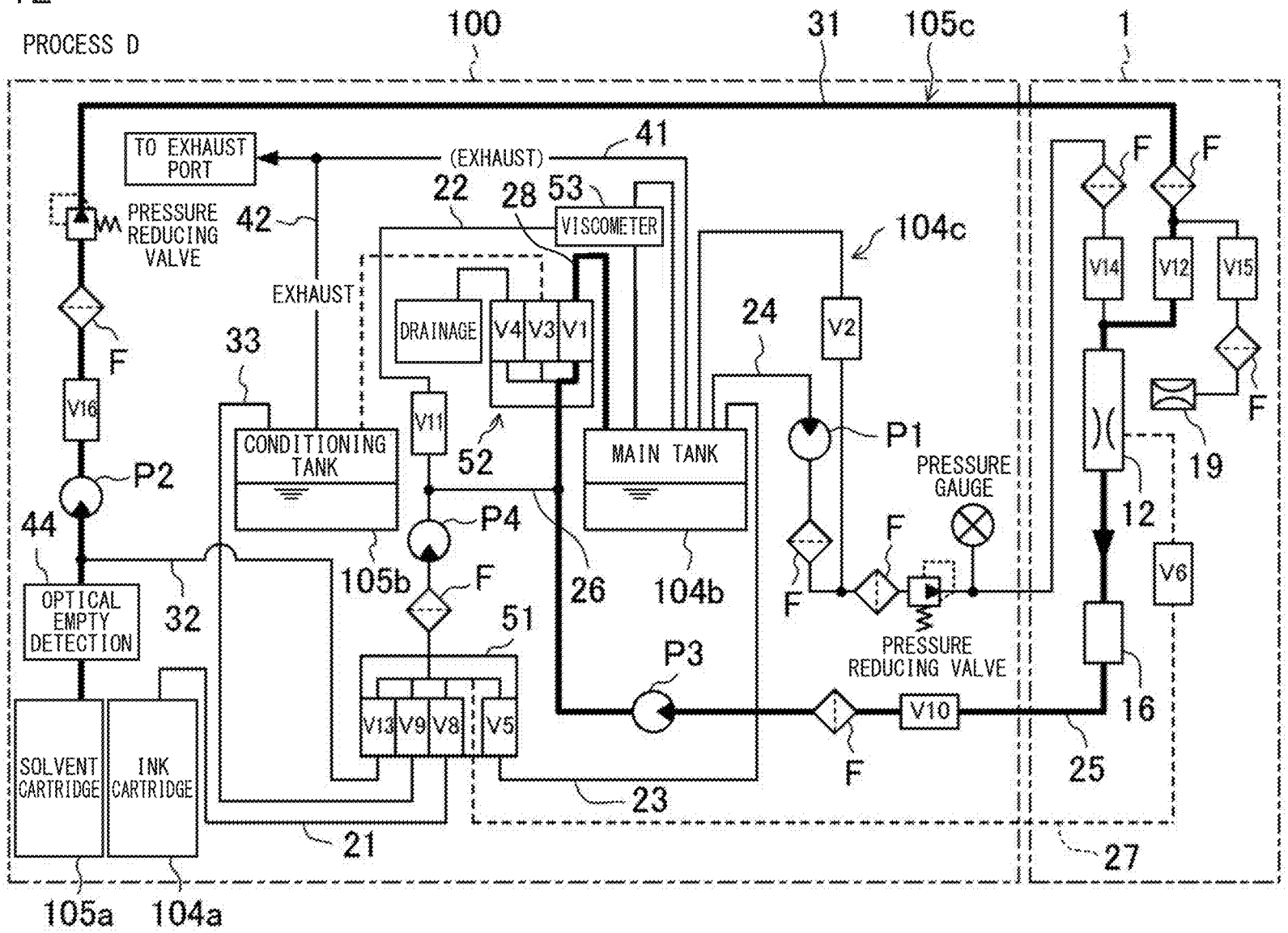
FIG. 12 is a diagram for explaining a process D in the stop processing.
Figure 13:
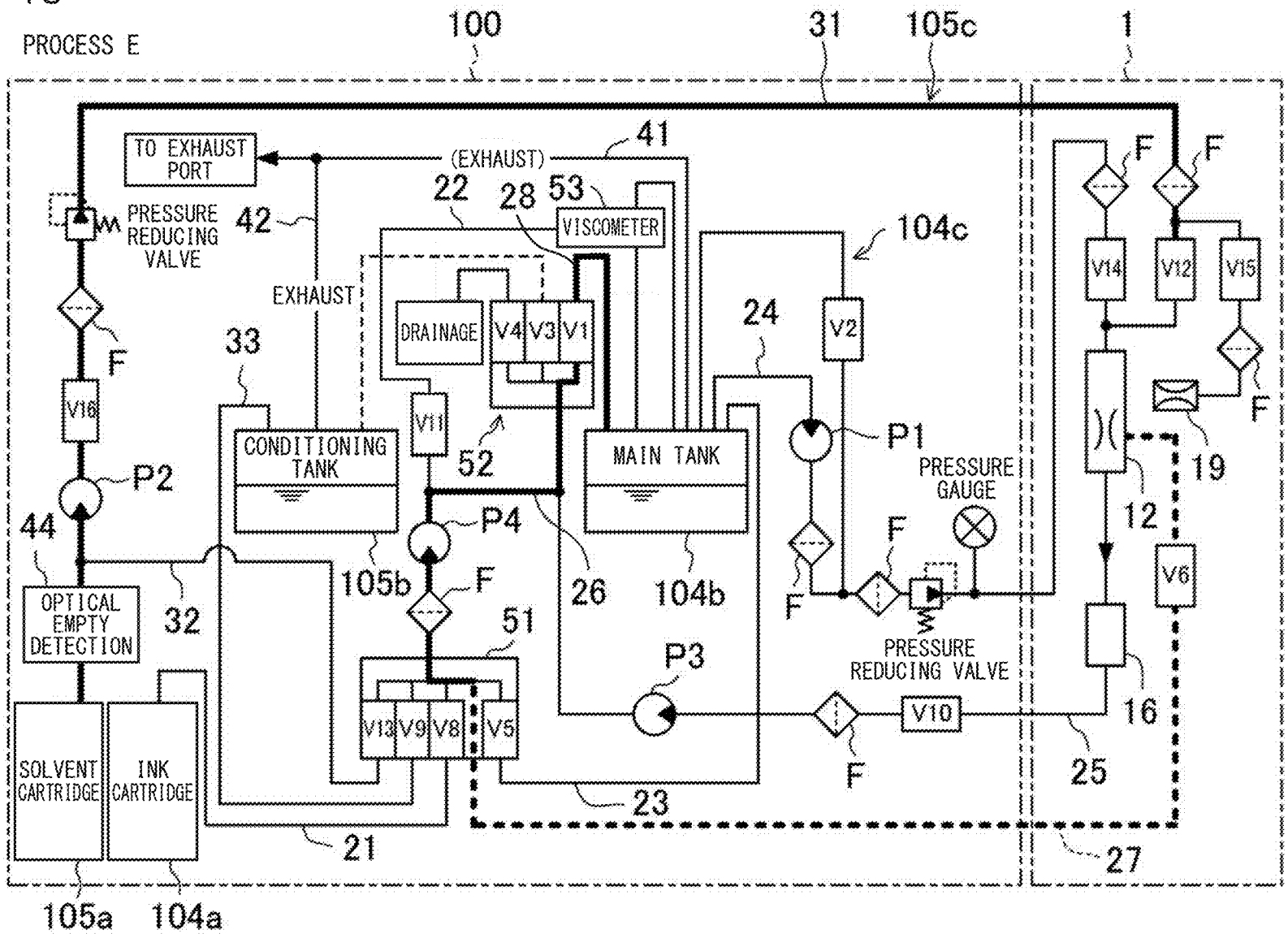
FIG. 13 is a diagram for explaining a process E in the stop processing.
Figure 14:
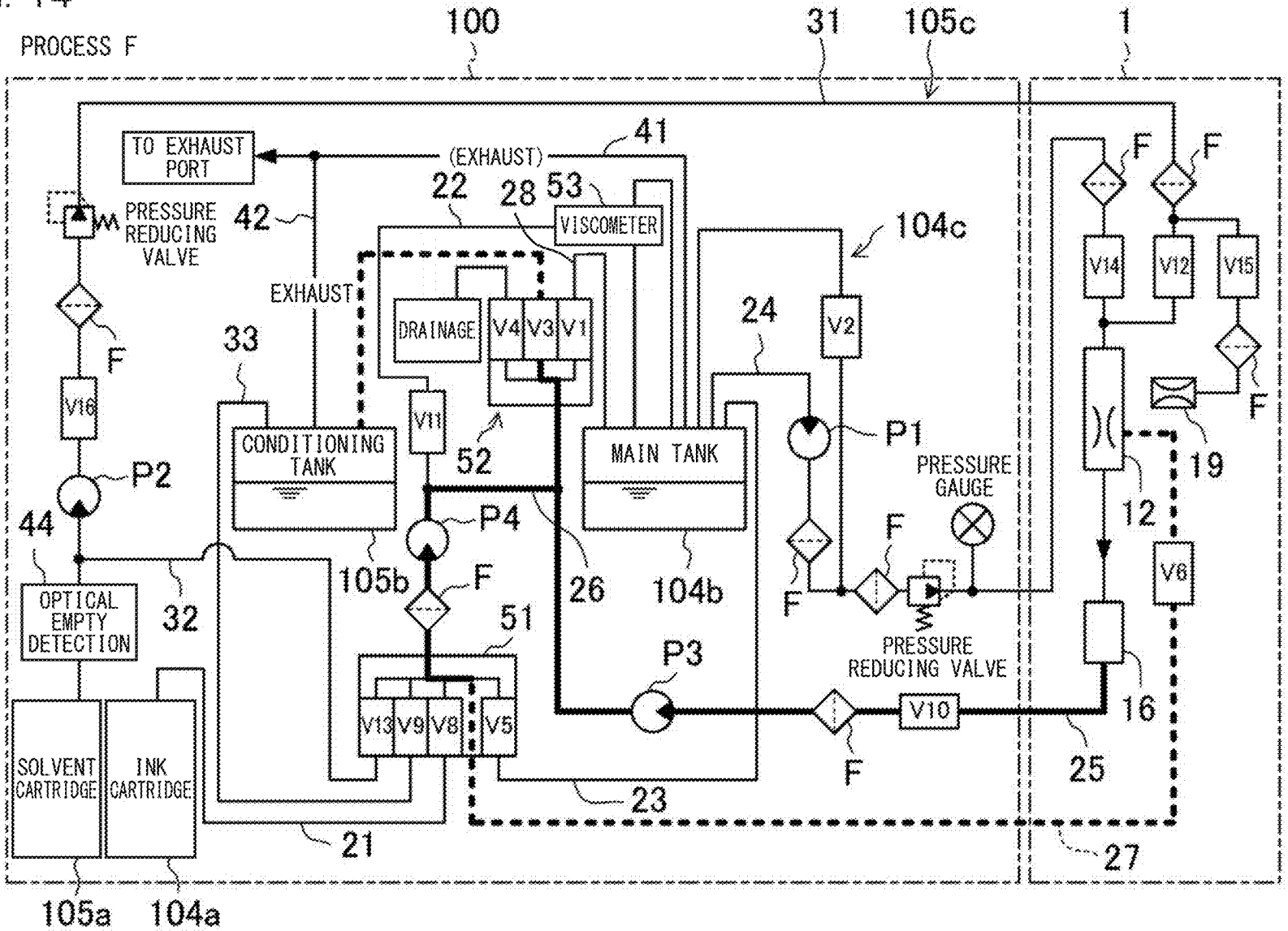
FIG. 14 is a diagram for explaining a process F in the stop processing.

FIG. 12 is a diagram for explaining a process D in the stop processing. FIG. 13 is a diagram for explaining a process E in the stop processing. FIG. 14 is a diagram for explaining a process F in the stop processing.

In step SC1, the control unit 101 stops the vibration of the ink ejected from the nozzle 12 and the voltage application to the charging electrode 13 and the deflection electrode 15 (the granulation, the charging, and the deflection of the ink: ON→OFF). Consequently, the granulation, the charging, and the deflection of the ink are stopped. An axial ink axis is ejected from the nozzle 12.

In step SC2 following step SC1, the control unit 101 stops the ejection of the ink axis (ejection stop of the ink). Specifically, in step SC2, in order to stop the ejection of the ink, the control unit 101 closes the fourteenth valve V14. Consequently, the ink is not ejected from the nozzle 12.

In step SC3 following step SC2, the control unit 101 executes intermittent ejection of the solvent (intermittent jetting of the solvent). Specifically, the control unit 101 alternately executes the process D illustrated in FIG. 12 and the process E illustrated in FIG. 13 in order to intermittently eject the solvent. By intermittently ejecting the solvent, the ink jet recording apparatus I, in particular, the nozzle 12 forming the printing head 1 can be cleaned. This operation is hereinafter referred to as "intermittent jetting operation".

In the process D illustrated in FIG. 12, the control unit 101 opens the sixteenth valve V16, the twelfth valve (referred to as solvent jetting valve as well) V12, the tenth valve V10, and the first valve V1. The solvent pump P2 and the gutter pump P3 are operated in that state, whereby the solvent stored in the solvent cartridge 105*a* is ejected from the nozzle 12 via the first solvent path 31 and collected by the gutter 16. The solvent collected by the gutter 16 is fed back to the main tank 104*b* via the fifth ink path 25 and the second dividing unit 52 (see a thick line in FIG. 12).

Immediately after the processing illustrated in FIG. 11 is started, a large amount of the ink is considered to remain in the fifth ink path 25. Therefore, the solvent in the process D illustrated in FIG. 12 is fed back to the main tank 104*b* rather than the conditioning tank 105*b*.

In the process E illustrated in FIG. 13, the control unit 101 closes the twelfth valve V12 and opens the sixth valve V6. Then, the solvent remaining in the nozzle 12 is sucked into the main tank 104*b* via the suction path 27, the first dividing unit 51, the sixth ink path 26, the first valve V1, and the eighth ink path 28 by a negative pressure applied by the circulation pump P4 (see a thick line in FIG. 13).

Note that, in the process E illustrated in FIG. 13, the twelfth valve V12 may be kept opened without being closed. In that case, while the solvent is supplied from the solvent cartridge 105*a* to the nozzle 12, the solvent supplied in that way is directly sucked from the suction path 27. Consequently, it is possible to improve a flow rate of the solvent flowing through the sixth valve V6 and more sufficiently perform the cleaning.

The process D illustrated in FIG. 12 and the process E illustrated in FIG. 13 are repeated a plurality of times (for example, in several sets). A time (for example, one second or less) in which the process D is carried out in step SC3 is shorter than a time (for example, approximately several seconds) in which the process E is carried out.

After the twelfth valve V12 is closed in the process E, the twelfth valve V12 is opened in the process D, whereby the solvent is intermittently jetted. When shifting from the process D to the process E, the twelfth valve V12 may be closed for approximately several seconds. Consequently, it is possible to increase the pressure of the solvent near the first valve V12 and, when the twelfth valve 12 is opened, powerfully eject the solvent.

In step SC4 following step SC3, the control unit 101 executes only the process D illustrated in FIG. 12 and ejects the solvent from the nozzle 12. A time in which the process D is carried out in step SC4 is, for example, approximately 30 seconds, which is longer than a time in which the process D is carried out in step SC3. By executing step SC4, the fifth ink path 25 communicating with the gutter 16 can be mainly cleaned. This operation is hereinafter referred to as "gutter cleaning operation".

In step SC5 following step SC4, the control unit 101 executes the process F illustrated in FIG. 14 and collects the solvent from the printing head 1. Specifically, in the process F, the control unit 101 opens the tenth valve V10 and the third valve V3. In that state, the gutter pump P3 operates, whereby the solvent remaining in the nozzle 12 is sucked to the conditioning tank 105*b* via the fifth ink path 25 and the second dividing unit 52 (see a thick line in FIG. 14). By executing step SC5, the solvent used for the cleaning can be collected.

Since the solvent is ejected in step SC4 before step SC5 is executed, a relatively large amount of the solvent is considered to remain in the fifth ink path 25. Accordingly, the solvent in the process F is fed back to the conditioning tank 105*b* rather than the main tank 104*b*.

When the processing illustrated in step SC5 ends, the processing is returned from the control process illustrated in FIG. 11 to the control process illustrated in FIG. 6. In step SA5 following step SA4, the power supply to the ink jet recording apparatus I is shut off. The ink jet recording apparats 1 stops the operation thereof.

Cleaning Placing Unit 200

Figure 15:
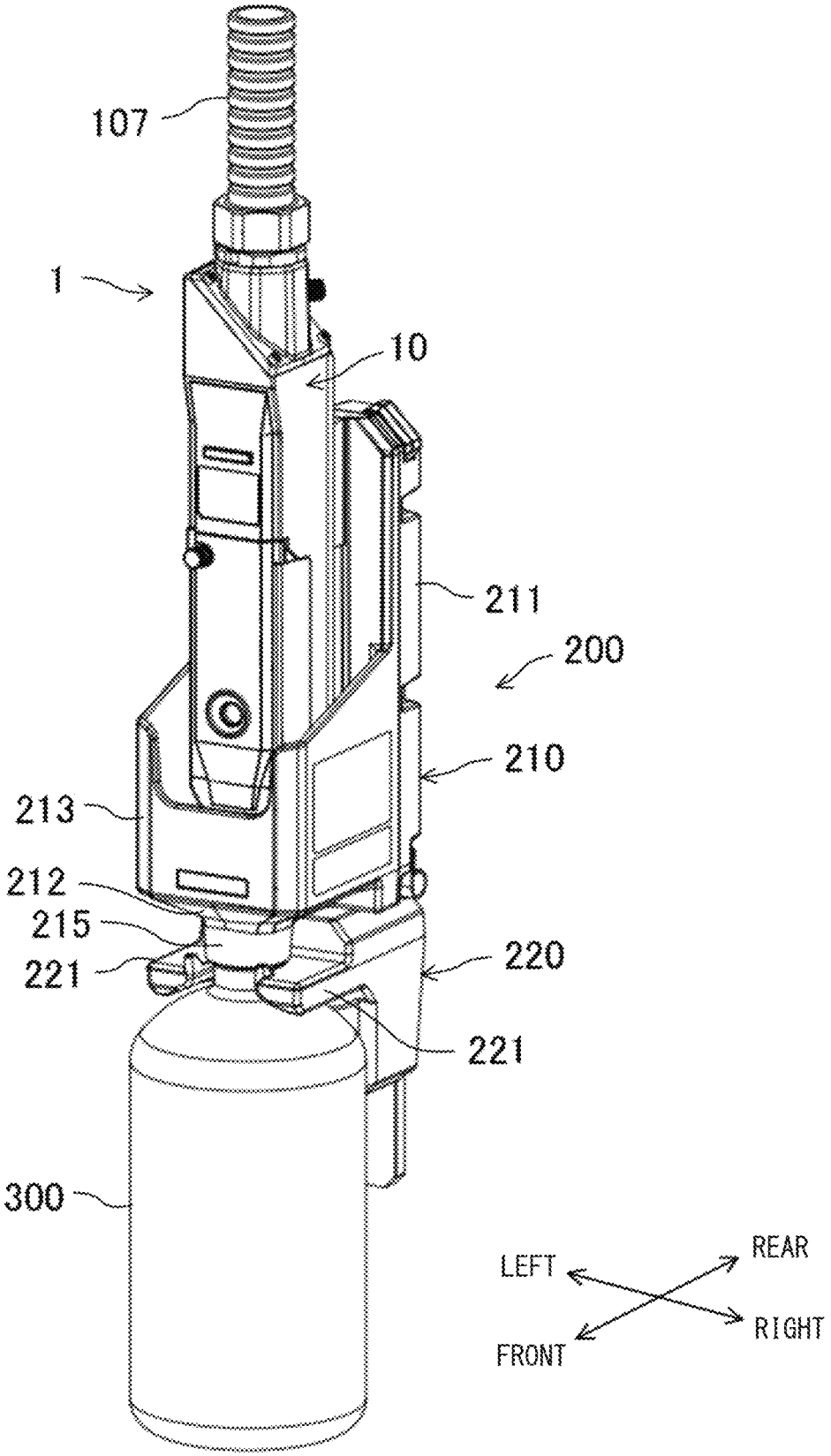
FIG. 15 is a perspective view illustrating a state in which the printing head is placed on a cleaning placing unit.

As illustrated in FIG. 1, the cleaning placing unit 200 is disposed in a place different from a setting place of the printing head 1 at the time when printing is performed by the ink jet recording apparatus I. As illustrated in FIG. 15, the cleaning placing unit 200 is configured such that the printing head 1 is placed on the cleaning placing unit 200 when the printing head 1 is cleaned using cleaning liquid. As the cleaning liquid, liquid other than the solvent can also be used.

The cleaning placing unit 200 and the printing head 1 are communicably connected. A form of the connection may be wired connection or may be wireless connection. The printing head 1 and the controller 100 are communicably connected. A form of the connection may be wired connection or may be wireless connection. Further, the controller 100 and the cleaning placing unit 200 are communicably connected. A form of the connection may be wired connection or may be wireless connection. As an example of these connection forms, a signal line capable of transmitting and receiving signals can be used.

When the setting place of the printing head 1 at the time when printing is performed by the ink jet recording apparatus I is specified as illustrated in FIG. 1, the cleaning placing unit 200 is set in a place separated from the setting place. The cleaning placing unit 200 can be set to be separated from the controller 100 but may be set in the same place as the controller 100. The cleaning placing unit 200 is a unit that performs cleaning of the printing head 1 in a state in which the printing head 1 is placed on the cleaning placing unit 200. The cleaning placing unit 200 can also be called, for example, a cleaning station, a cleaning dock, a cleaning placing device, or a cleaning unit.

Figure 16:
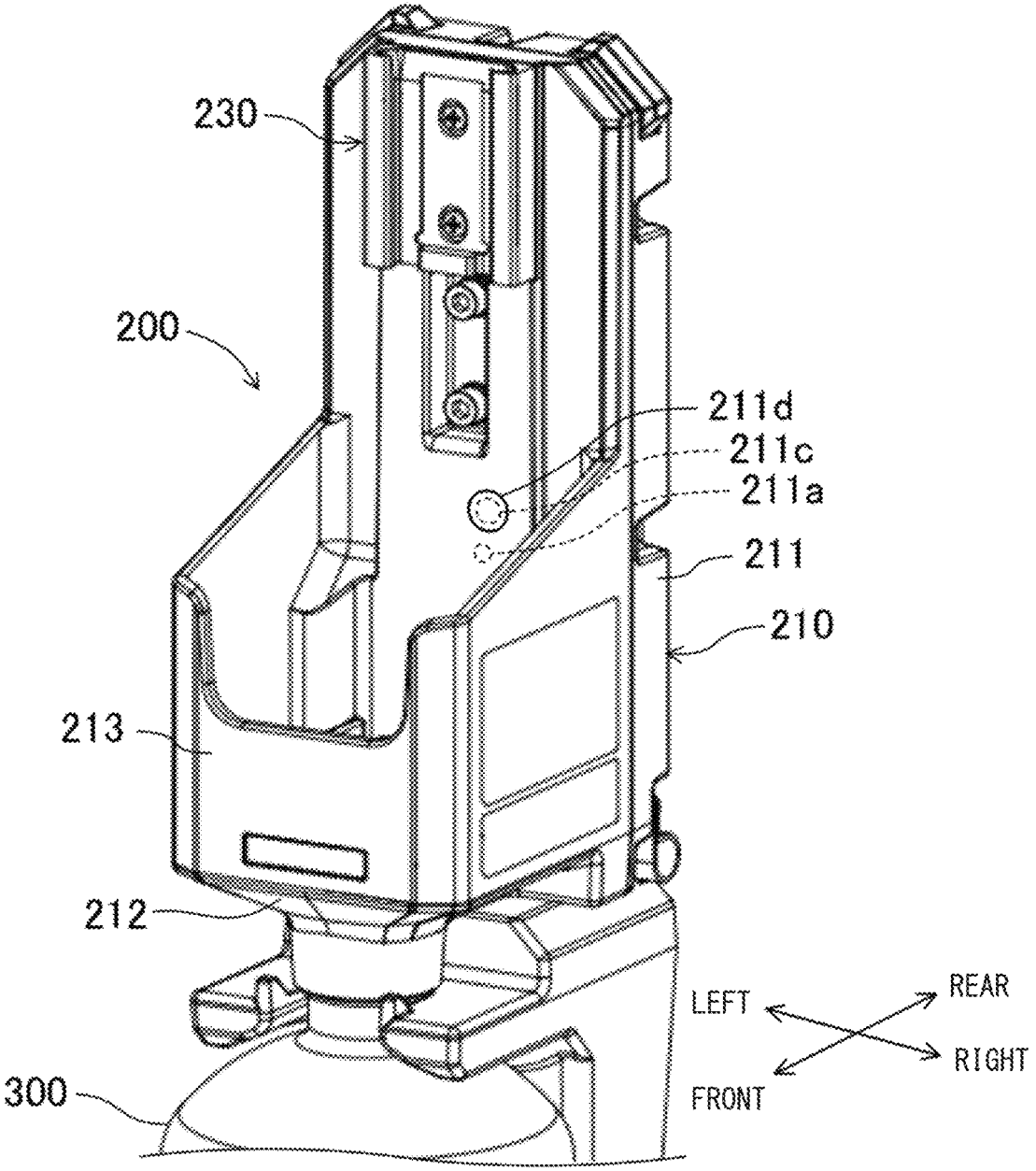
FIG. 16 is a perspective view of the cleaning placing unit.
Figure 17:
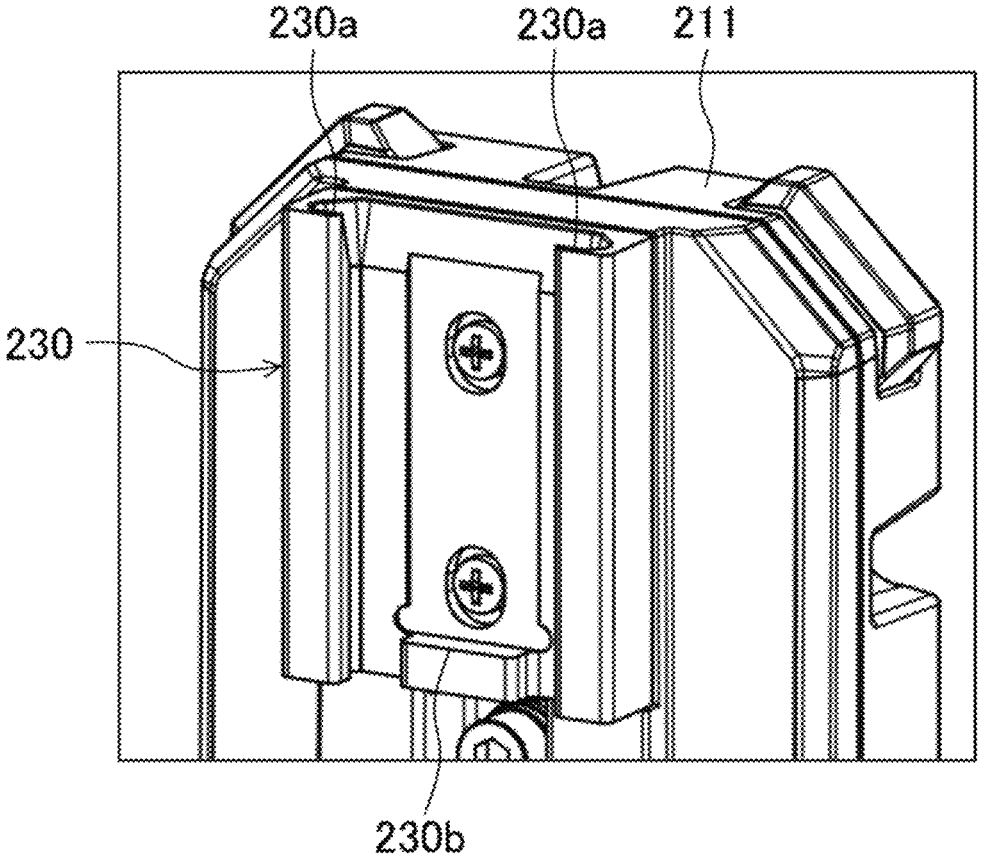
FIG. 17 is an enlarged view of an upper part of the cleaning placing unit.

As illustrated in FIG. 16, the cleaning placing unit 200 includes a main body unit 210 and a collection container 300 for collecting the cleaning liquid in the printing head 1. The main body unit 210 includes a rear plate section 211 extending in the up-down direction. A guiding and supporting member 230 that guides and supports the printing head 1 is provided in an upper part of the rear plate section 211. As illustrated in FIG. 17, the guiding and supporting member 230 includes a pair of left and right rail sections 230*a*, 230*a* and a supporting section 230*b*. The rail sections 230*a*, 230*a* are provided at an interval from each other in the left-right direction and disposed to extend in the up-down direction and project to the front side from the front surface of the rear plate section 211. The upper ends of the rail sections 230*a*, 230*a* are opened. The supporting section 230*b* is a portion that supports the printing head 1 placed in a regular position. The supporting section 230*b* is configured by a projecting section projecting to the front side from between the rail sections 230*a*, 230*a*. The supporting section 230*b* can also be called stopper section.

Figure 18:
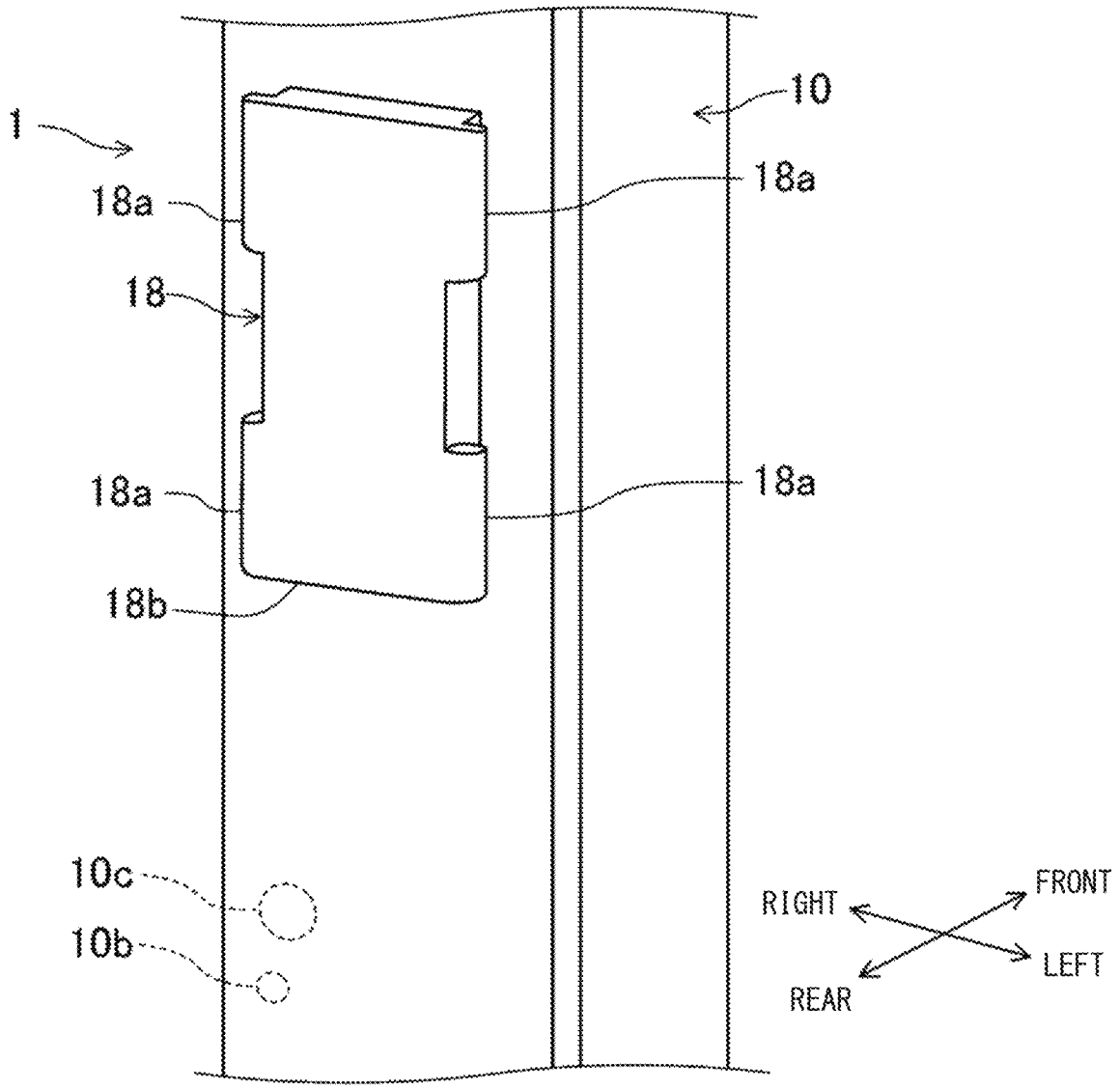
FIG. 18 is an enlarged view of a rear surface of the printing head.

On the other hand, as illustrated in FIG. 18, a guided member 18 is provided in an up-down direction middle part in the rear surface of the housing 10 of the printing head 1. The guided member 18 is configured by a plate material or the like disposed to project from the rear surface of the housing 10. On the left side of the guided member 18, guided sections 18*a* formed to fit in the rail section 230*a* on the left side of the cleaning placing unit 200 are formed to project in the left direction. On the right side of the guided member 18, the guided sections 18*a* formed to fit in the rail section 230*a* on the right side of the cleaning placing unit 200 are formed to project in the right direction.

The left and right guided sections 18*a*, 18*a* extend in the up-down direction and are formed to be insertable into the rail sections 230*a*, 230*a* of the cleaning placing unit 200 from the upper end portions of the rail sections 230*a*, 230*a*. The guided sections 18*a*, 18*a* are guided in the up-down direction by the rail sections 230*a*, 230*a* in a state in which the guided sections 18*a*, 18*a* are inserted into the rail sections 230*a*, 230*a*. At this time, a moving direction of the printing head 1 is restricted to only the up-down direction. The printing head 1 is prevented from moving in the left-right direction and the front-rear direction with respect to the cleaning placing unit 200.

The lower end face of the guided member 18 is formed as a contact surface 18*b* that comes into contact with the upper surface of the supporting section 230*b* provided in the guiding and supporting member 230 of the cleaning placing unit 200. The printing head 1 can be moved downward with respect to the cleaning placing unit 200 until the contact surface 18*b* comes into contact with the upper surface of the supporting section 230*b* illustrated in FIG. 17. In other words, the height of the printing head 1 placed on the cleaning placing unit 200 can be set according to the height of the contact surface 18*b* of the guided member 18 or the height of the upper surface of the supporting section 230*b*. In this embodiment, the height of the printing head 1 placed on the cleaning placing unit 200 is set as illustrated in FIG. 15. This position is the regular position. Note that, although not illustrated, rail sections may be provided in the printing head 1 and a guided member may be provided in the cleaning placing unit 200. Structure for positioning the printing head 1 in the regular position is not limited to the structure explained above. The printing head 1 only has to be supportable in the regular position by a part of the main body section 210.

Figure 19:
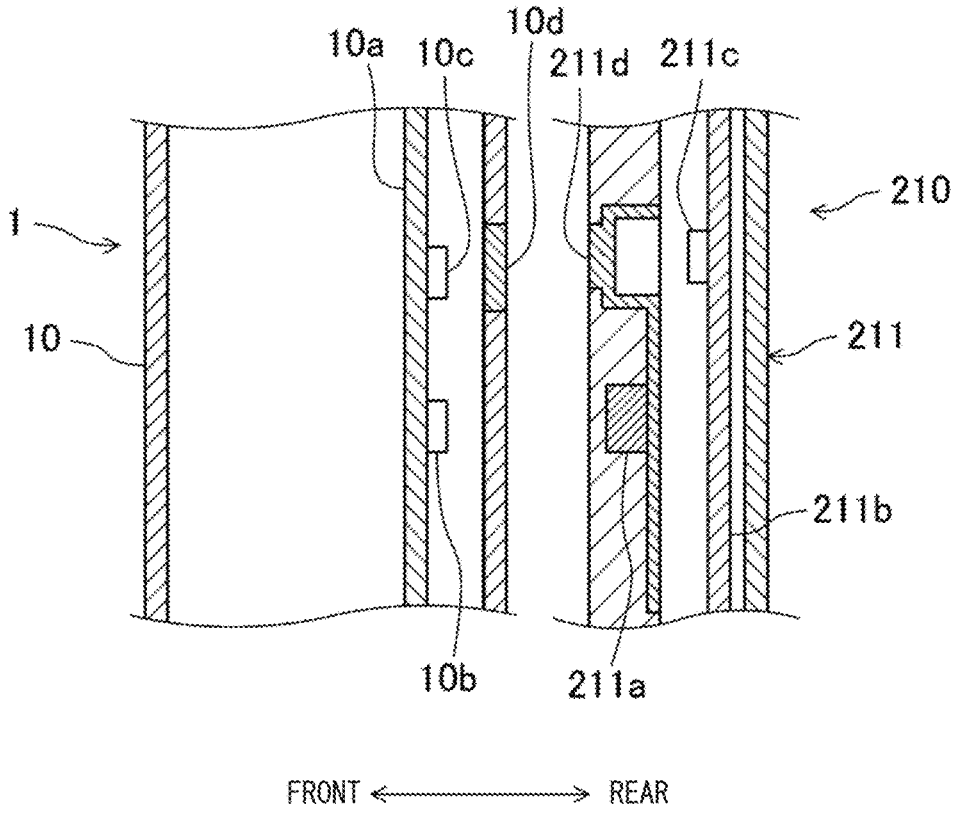
FIG. 19 is a longitudinal sectional view illustrating parts of the printing head seated in a regular position and the cleaning placing unit.
Figure 20:
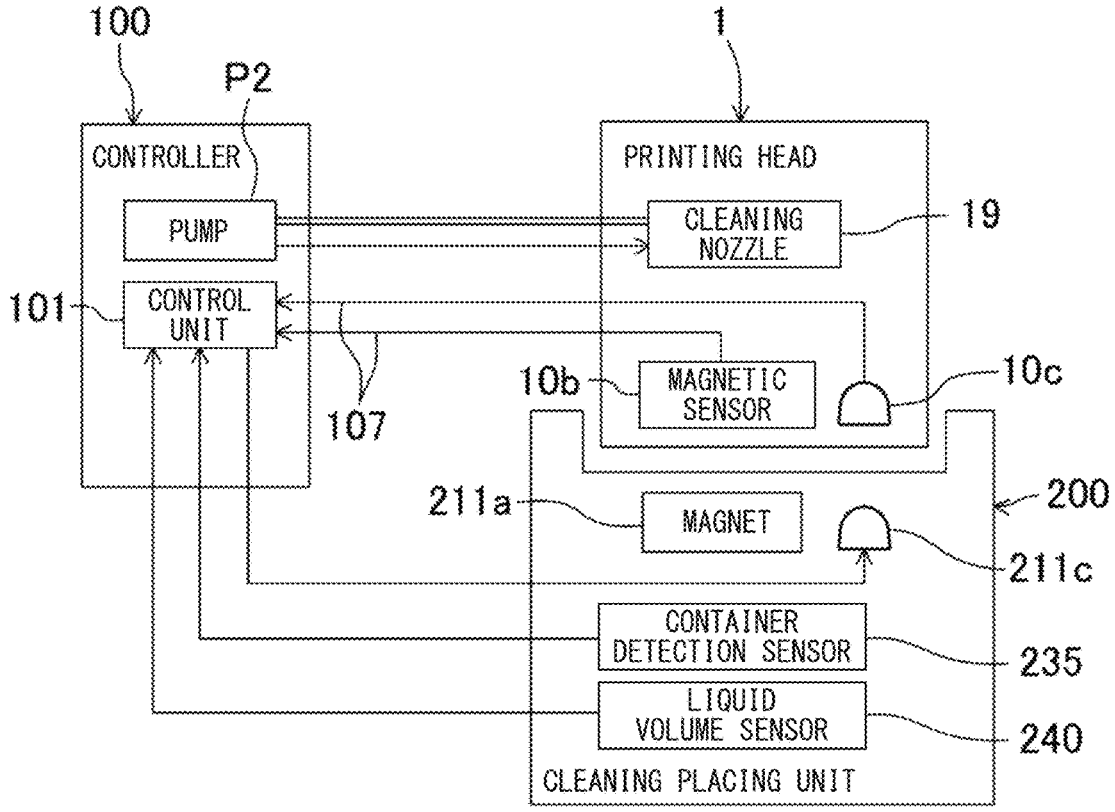
FIG. 20 is a simple block diagram of a controller, the printing head, and the cleaning placing unit.

As illustrated in FIGS. 16 and 19, a magnet 211*a* is provided on the inside of the rear plate section 211 of the cleaning placing unit 200. The magnet 211*a* is disposed such that a magnetic force is transmitted through the rear plate section 211 and acts forward. As illustrated in FIG. 19, a substrate 211*b* is provided on the inside of the rear plate section 211. Alight emitting element 211*c* that emits infrared light for performing infrared communication is mounted on the substrate 211*b*. As illustrated in FIG. 20, the light emitting element 211*c* is connected to the control unit 101 of the controller 100 and controlled by the control unit 101. As illustrated in FIG. 19, a light emitting surface of the light emitting element 211*c* faces forward. A transmitting member 211*d* that transmits the infrared light of the light emitting element 211*c* is provided in the rear plate section 211. The infrared light irradiated from the light emitting element 211*c* is transmitted through the transmitting member 211*d* and irradiated toward the front of the rear plate section 211.

On the other hand, a substrate 10*a* is provided on the inside of the housing 10 of the printing head 1. A magnetic sensor 10*b* and a light receiving element 10*c* for infrared communication are mounted on the substrate 10*a*. The magnetic sensor 10*b* is a noncontact magnetic sensor configured to, when detecting a magnetic force equal to or larger than a predetermined threshold, convert the detection of the magnetic force into an electric signal and output the electric signal. The magnetic sensor 10*b* can be configured by a Hall element or the like. The magnetic sensor 10*b* is positioned to be at substantially the same height as the magnet 211*a* of the cleaning placing unit 200 when the printing head 1 is present in the regular position. The same height as the magnet 211*a* on the front side of the magnet 211*a* is a place where the magnetic force is the largest. The magnetic sensor 10*b* is configured to output a magnetic force detection signal only when the magnetic sensor 10*b* is present in this position. Therefore, for example, when the printing sensor 1 is placed above the regular position, since the distance between the magnetic sensor 10*b* and the magnet 211*a* increases, the magnetic sensor 10*b* does not output the magnetic force detection signal. This makes it possible to detect whether the printing head 1 is placed on the cleaning placing unit 200 or whether the printing head 1 is placed in the regular position. The magnetic sensor 10*b* is connected to the control unit 101 of the controller 100 and configured to output a signal to the control unit 101. The control unit 101 may determine whether the printing head 1 is placed on the cleaning placing unit 200 or whether the printing head 1 is placed in the regular position.

A light receiving surface of the light receiving element 10*c* faces the rear side such that the light receiving element 10*c* is capable of receiving infrared light irradiated from the light emitting element 211*c* of the cleaning placing unit 200. The height of the light receiving element 10*c* is set such that the light receiving element 10*c* can receive the infrared light of the light emitting element 211*c* only when the printing head 1 is present in the regular position. The directivity of the infrared light of the light emitting element 211*c* is narrowed not to diffuse to a wide range. The directivity of the light receiving element 10*c* is also narrowed. Consequently, the light receiving element 10*c* is capable of receiving the infrared light of the light emitting element 211*c* only when the printing head 1 is present in the regular position. It is possible to detect, based on possibility of establishment of this communication, whether the printing head 1 is placed on the cleaning placing section 200 or whether the printing head 1 is placed in the regular position. The light receiving element 10*c* is connected to the control unit 101 of the controller 100 and configured to output a signal to the control unit 101. The control unit 101 may determine, based on possibility of establishment of the communication, whether the printing head 1 is placed on the cleaning placing section 200 or whether the printing head 1 is placed in the regular position. Note that a window section 10*d* that transmits the infrared light of the light emitting element 211*c* is provided in the housing 10.

The positions of the light emitting element 211*c* and the light receiving element 10*c* are not limited to the illustrated positions and only have to be in a positional relation in which, only in a state in which the printing head 1 is placed in the regular position, the light receiving element 10*c* can receive the infrared light irradiated from the light emitting element 211*c*. Similarly, the positions of the magnet 211*a* and the magnetic sensor 10*b* are not limited to the illustrated positions and only have to be in a positional relation in which, only in the state in which the printing head 1 is placed in the regular position, the magnetic sensor 10*b* outputs a magnetic force detection signal.

As explained above, the magnetic sensor 10*b* does not output the magnetic force detection signal unless the printing head 1 is placed on the cleaning placing unit 200. Therefore, the magnetic sensor 10*b* is equivalent to a placing detecting unit that detects that the printing head 1 is placed on the cleaning placing unit 200. The magnetic sensor 10*b* does not output the magnetic force detection signal unless the printing head 1 is placed in the regular position with respect to the cleaning placing unit 200. Therefore, the magnetic sensor 10*b* can also detect that the printing head 1 is placed in the regular position with respect to the cleaning placing unit 200. The magnetic force detection signal is a signal based on placement confirmation for the printing head 1.

The light receiving element 10*c* cannot receive the infrared light irradiated from the light emitting element 211*c* unless the printing head 1 is placed on the cleaning placing unit 200. Therefore, the light receiving element 10*c* is equivalent to the placing detecting unit that detects that the printing head 1 is placed on the cleaning placing unit 200. The light receiving element 10*c* cannot receive the infrared light irradiated from the light emitting element 211*c* unless the printing head 1 is placed in the regular position with respect to the cleaning placing unit 200. Therefore, the light receiving element 10*c* can also detect that the printing head 1 is placed in the regular position with respect to the cleaning placing unit 200. If the light emitting element 211*c* and the light receiving element 10*c* cannot perform the infrared communication, it can be estimated that the printing head 1 is not placed. Therefore, the control unit 101 can detect, based on an output of the light receiving element 10*c*, that the printing head 1 is placed on the cleaning placing unit 200 in a state in which the infrared communication is possible. Similarly, if the printing head 1 is not placed in the regular position with respect to the cleaning placing unit 200, the light emitting element 211*c* and the light receiving element 10*c* cannot perform the infrared communication. Therefore, the control unit 101 can detect, based on the output of the light receiving element 10*c*, that the printing head 1 is placed in the regular position with respect to the cleaning placing unit 200. The signal of the infrared communication acquired by the light receiving element 10*c* is a signal based on the placement confirmation for the printing head 1.

The magnetic force detection signal output from the magnetic sensor 10*b* and the signal of the infrared communication acquired by the light receiving element 10*c* are sent from the printing head 1 to the control unit 101 of the controller 100 via the connection cable 107.

The placement detecting unit may be, for example, a proximity sensor, a photoelectric sensor, a laser sensor, and the like besides the sensors that make use of the magnetic force detection signal and the infrared communication. When these sensors are used, it is possible to detect that, when the distance between the printing head 1 and the cleaning placing unit 200 is equal to or smaller than a predetermined distance, the printing head 1 is placed on the cleaning placing unit 200 or placed in the regular position with respect to the cleaning placing unit 200.

In this embodiment, both of the magnetic force detection signal and the infrared communication can be output as the signal based on the placement confirmation for the printing head 1. However, only one of the magnetic force detection signal and the infrared communication may be able to be output. Detection accuracy can be improved by outputting two or more kinds of signals based on the placement confirmation for the printing head 1.

As illustrated in FIG. 16, a bottom wall section 212 extending from the up-down direction middle part toward the front side and a peripheral wall section 213 extending upward from the bottom wall section 212 are provided in the rear plate section 211. A glass shape is formed by the bottom wall section 212 and the peripheral wall section 213. As indicated by an imaginary line in FIG. 24, the lower side of the printing head 1 placed in the regular position is inserted into the peripheral wall section 213. In this state, the upper side of the printing head 1 projects upward from the upper end portion of the peripheral wall section 213. The bottom wall section 212 is located in a place separated downward from the ejection port A (illustrated in FIG. 5) of the printing head 1. The solvent used during the cleaning of the printing head 1 leaks mainly from the ejection port A of the printing head 1. However, the solvent leaked from the ejection port A can be received by the bottom wall section 212 and the peripheral wall section 213. The bottom wall section 212 and the peripheral wall section 213 are distinguished and shown for explanation. However, the bottom wall section 212 and the peripheral wall section 213 may be formed in an integrated shape to make a boundary between the bottom wall section 212 and the peripheral wall section 213 undistinguishable. In short, the bottom wall section 212 and the peripheral wall section 213 only have to be formed in a bottomed cylinder shape capable of housing the lower side of the printing head 1.

Attachment Structure of the Collection Container 300

Figure 21:
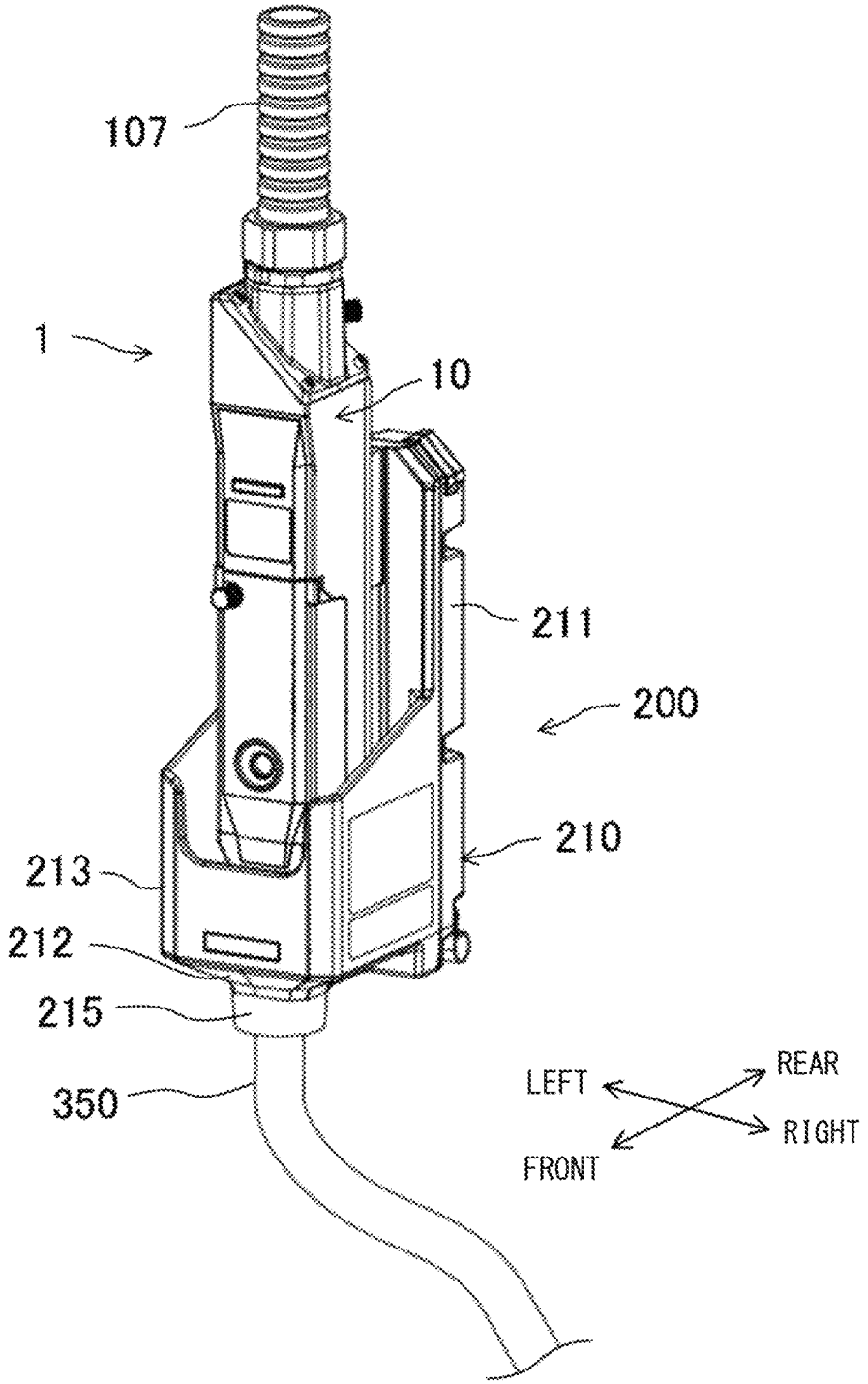
FIG. 21 is a diagram equivalent to FIG. 15 illustrating another discharging method for cleaning liquid received by the cleaning placing unit.

As illustrated in FIG. 16, the collection container 300 for collecting a cleaning agent in the printing head 1 is attached to the bottom wall section 212. The collection container 300 can be configured by a resin bottle or the like. A collection container having light transmissivity, a cleaning liquid volume on the inside of which can be grasped from the outside, or a collection container having a scale can be used. As in a modification illustrated in FIG. 21, the collection container 300 may not be directly attached to the bottom wall section 212. A pipe 350 formed by a hose, a piping member, or the like may be attached to the bottom wall section 212. The cleaning liquid may be collected in another collection container (not illustrated) via the pipe 350. In this case, the collection container can be provided in the controller 100. The pipe 350 may be a member forming a part of the collection container or may be a member forming a part of the cleaning placing unit 200. Attachment structure of the collection container 300 to the bottom wall section 212 and attachment structure of the pipe 350 to the bottom wall section 212 may be different or can be the same. The attachment structure of the collection container 300 to the bottom wall section 212 is explained in detail below.

Figure 22:
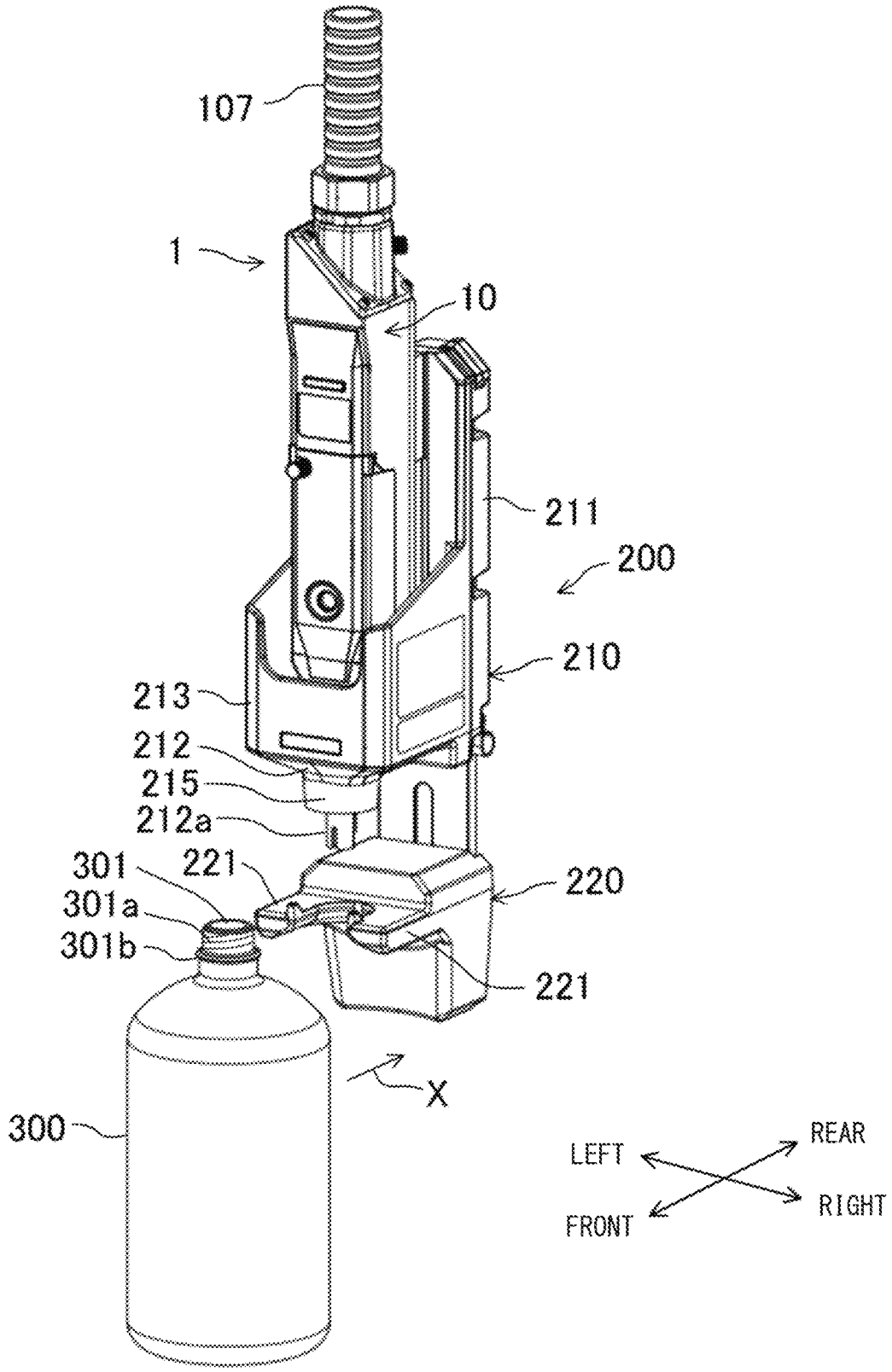
FIG. 22 is a perspective view of the cleaning placing unit illustrating a state before a collection container is held by a holding unit.

As illustrated in FIG. 22, a cylindrical mouth section 301 is provided in an upper part of the collection container 300. A thread 301*a* is formed on the outer circumferential surface of the mouth section 301. A flange section 301*b* is formed on the lower side of the thread 301*a* on the outer circumferential surface of the mouth section 301. The collection container 300 can be a member forming a part of the cleaning placing unit 200.

Figure 24:
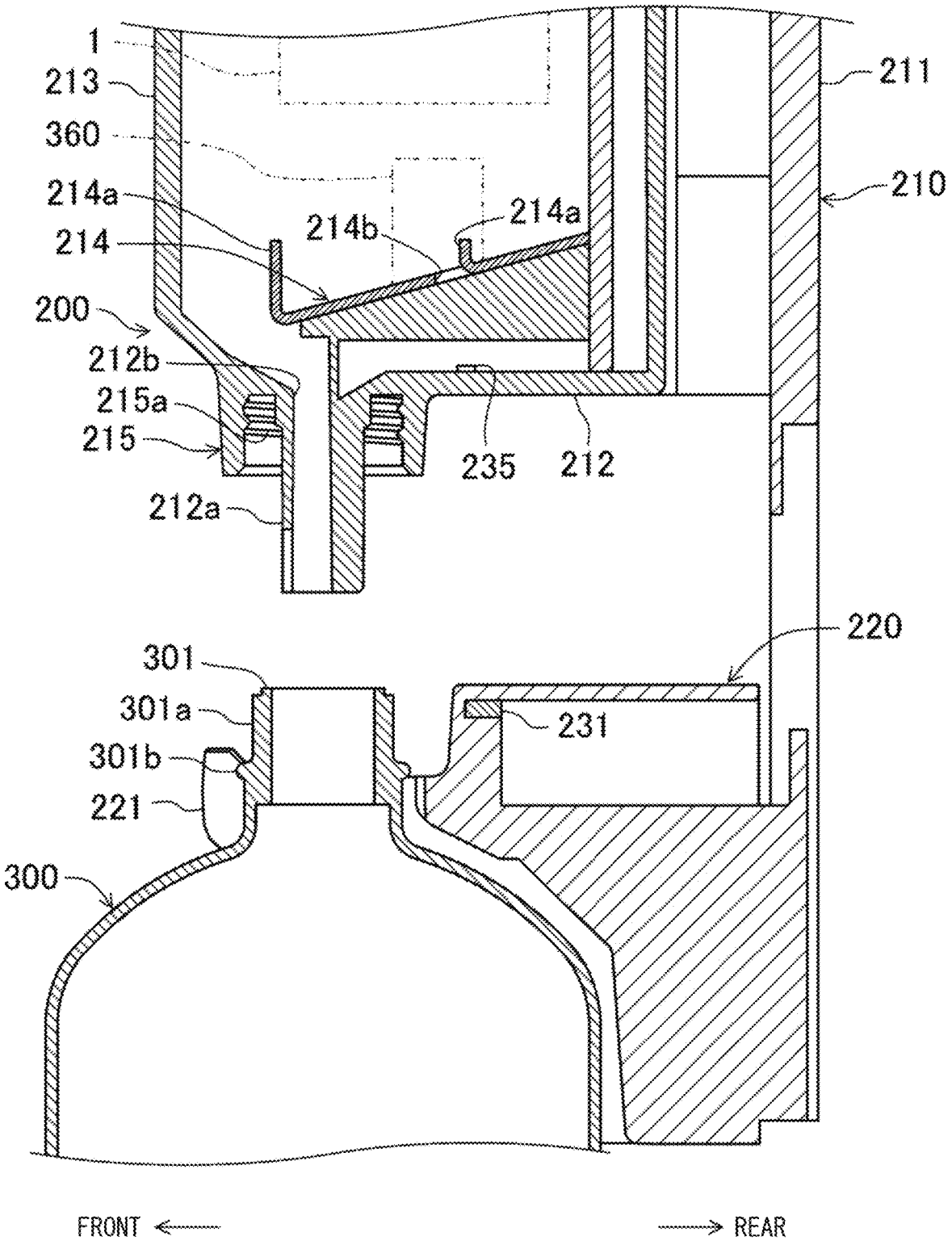
FIG. 24 is a longitudinal sectional view of the state illustrated in FIG. 23.
Figure 26:
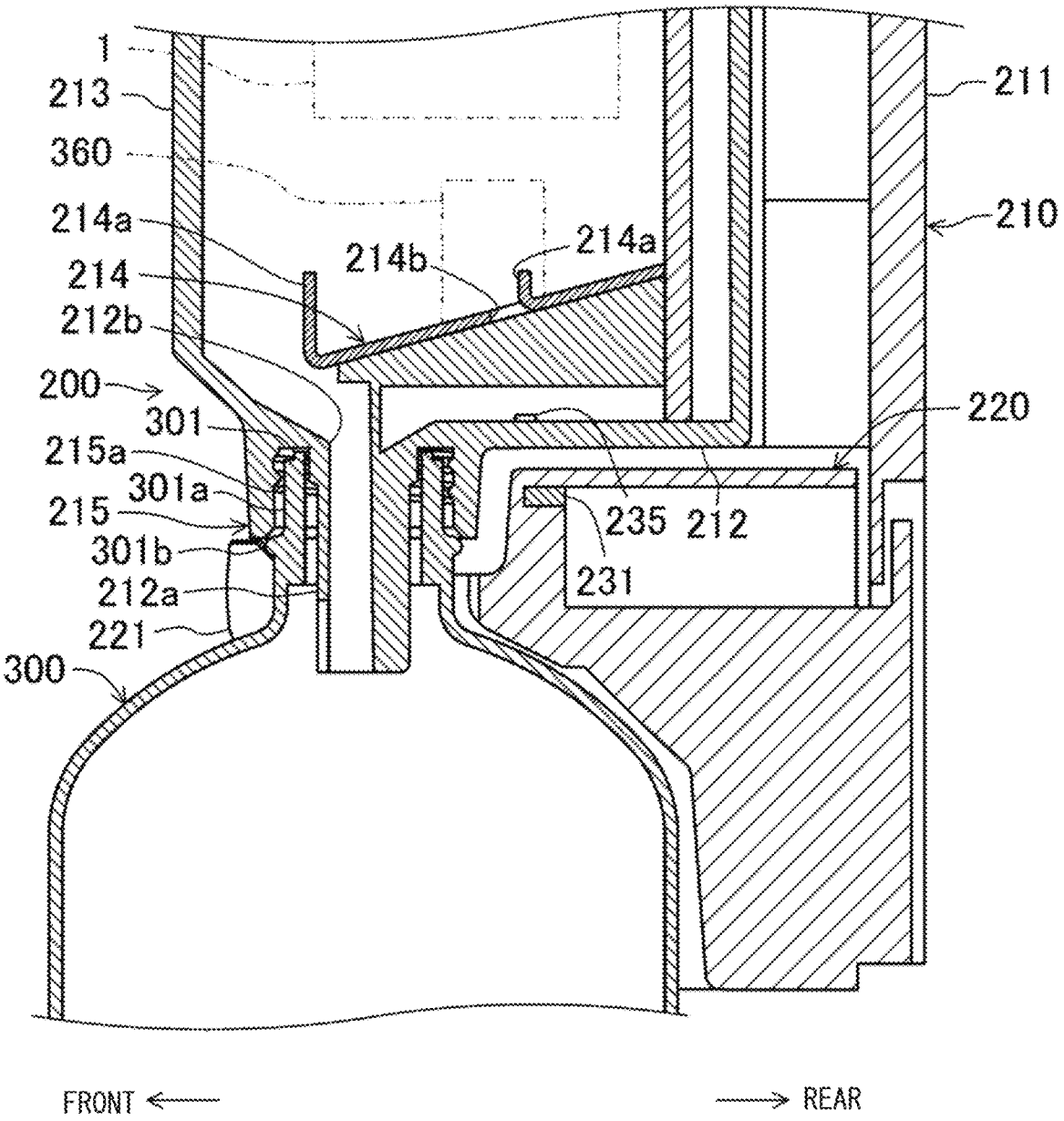
FIG. 26 is a longitudinal sectional view of a state in which the collection container is attached.

As illustrated in FIG. 24, a tubular section 212*a* projecting downward is formed in the bottom wall section 212. The outer diameter of the tubular section 212*a* is set smaller than the inner diameter of the mouth section 301 of the collection container 300. The lower end portion of the tubular section 212*a* is inserted into the inside of the collection container 300 in a state in which the collection container 300 is attached to the bottom wall section 212 as illustrated in FIG. 26. The lower end portion of the tubular section 212*a* reaches below the lower end portion of the mouth section 301.

As illustrated in FIG. 24, a passing hole 212*b*, through which the cleaning liquid for the printing head 1 passes, is formed in the tubular section 212*a* to extend in the up-down direction. The upper end portion of the passing hole 212*b* is opened in a portion close to the front on the upper surface of the bottom wall section 212. The lower end portion of the passing hole 212*b* is opened at the lower end portion of the tubular section 212*a*.

Figure 25:
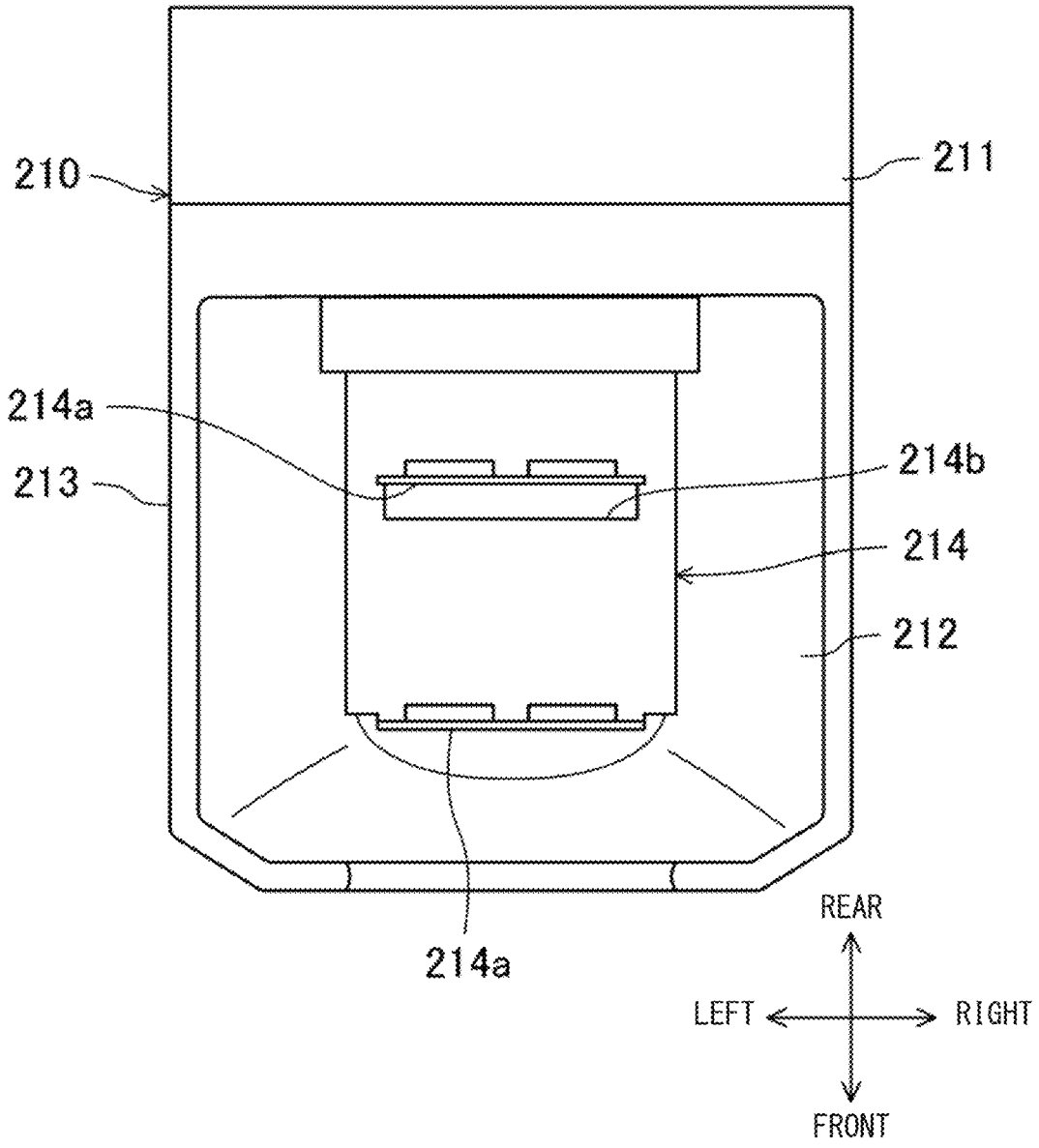
FIG. 25 is a plan view of the cleaning placing unit.

As illustrated in FIG. 25 as well, a receiving member 214 made of a metal plate material having electric conductivity is provided on the upper surface of the bottom wall section 212. The receiving member 214 is a member that receives the ink leaking from the printing head 1 and is connected to an equipotential line. The ink leaking from the printing head 1 is sometimes charged by the charging electrode and the deflection electrode 15. When the charged ink touches the receiving member 214, it is possible to allow charges of the ink to escape. Consequently, it is possible to suppress accumulation of the charges.

The receiving member 214 is disposed to be opposed to the ejection port A of the printing head 1. As illustrated in FIG. 24, the receiving member 214 is inclined to be located lower toward the front side. Consequently, the cleaning liquid received by the receiving member 214 can be guided toward the front side of the bottom wall section 212 by the receiving member 214 and fed toward the upper end opening section of the passing hole 212*b*.

Projecting plate sections 214*a* projecting upward are formed in the front end portion and the middle portion in the front-rear direction of the receiving member 214. An opening section 214*b* is also formed in the receiving member 214. The projecting plate sections 214*a* and the opening section 214*b* are not essential.

An attachment tube section 215 is formed to project downward on the lower surface of the bottom wall section 212. The attachment tube section 215 is formed larger in diameter than the tubular section 212*a* to surround the tubular section 212*a*. The lower end portion of the attachment tube section 215 is located above the lower end portion of the tubular section 212*a*. A screw groove 215*a* is formed on the inner circumferential surface of the attachment tube section 215. The thread 301*a* of the collection container 300 is screwed in the screw groove 215*a*. By screwing the thread 301*a* of the collection container 300 in the screw groove 215*a*, the collection container 300 can be attached to the bottom wall section 212 without causing a liquid leak. As illustrated in FIG. 26, in an attached state of the collection container 300, the mouth section 301 enters the attachment tube section 215 and the lower end portion of the tubular section 212*a* is disposed in the collection container 300. Note that the pipe 350 illustrated in FIG. 21 can also be attached by a screw.

As illustrated in FIGS. 16 and 22, the cleaning placing unit 200 includes a container holder 220. The container holder 220 is attached to be slidable in the up-down direction with respect to the lower side portion than the bottom wall section 212 in the rear plate section 211 of the main body section 210. The container holder 220 includes a pair of left and right engaging projecting sections 221, 221 provided to project forward. A gap, into which the mouth section 301 of the collection container 300 can be inserted in the lateral direction, is formed between the engaging projecting sections 221, 221. A separation distance in the left-right direction of the engaging projecting sections 221, 221 is set shorter than the outer diameter dimension of the flange section 301*b* of the mouth section 301. By inserting the mouth section 301 of the collection container 300 between the engaging projecting sections 221, 221 from the lateral direction (a direction indicated by an arrow X in FIG. 22), the flange section 301*b* of the mouth section 301 can be hooked and held on the engaging projecting sections 221, 221 from above.

Figure 23:
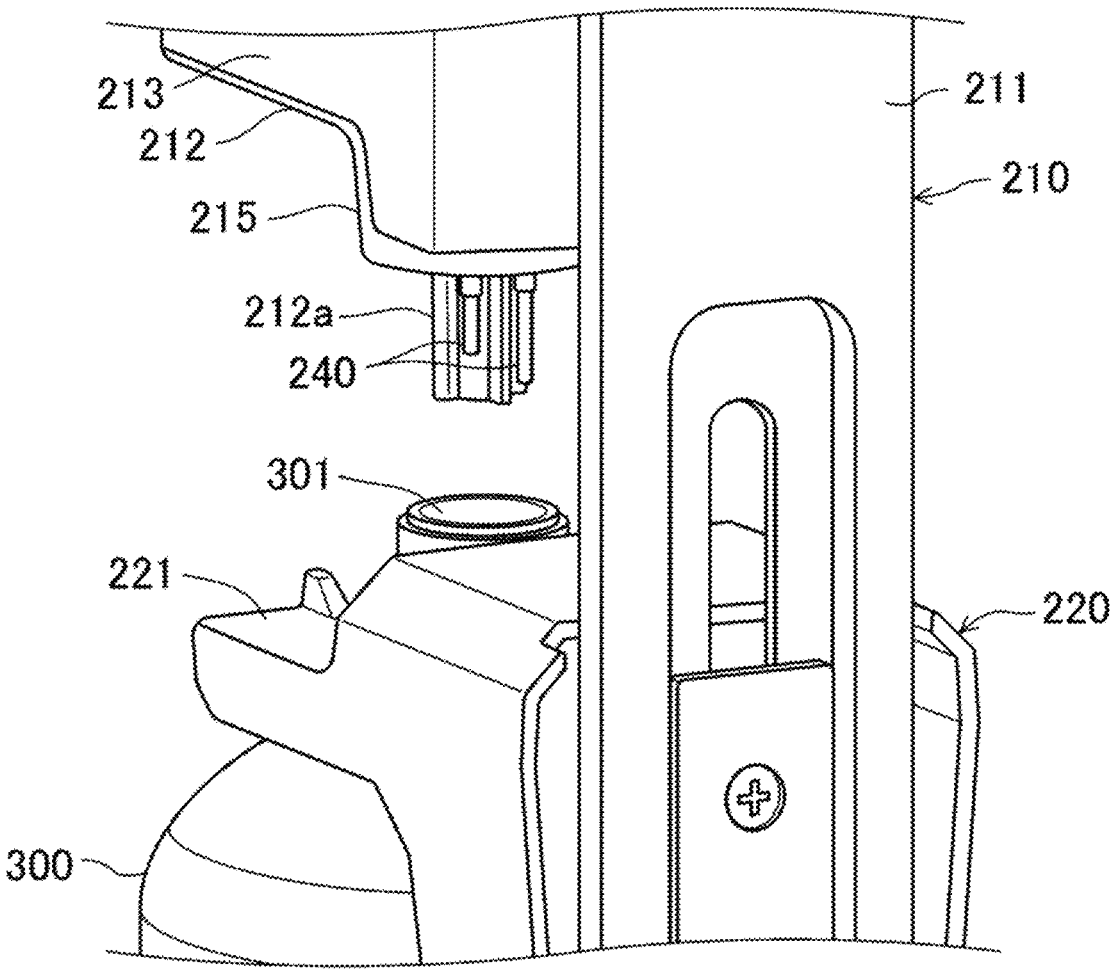
FIG. 23 is a perspective view illustrating a state before the collection container is lifted, the cleaning placing unit being viewed from a rear surface side.

The container holder 220 can be switched to an unattached position illustrated in FIGS. 22 to 24 and an attachment completed position illustrated in FIGS. 15, 16, and 26 and the like. The container holder 220 can be stopped not to move downward from the unattached position by a well-known lock mechanism, stopper, or the like. The user can easily switch the container holder 220 from the unattached position to the attachment completed position. The cleaning placing unit 200 may include an urging member such as a spring that urges the container holder 220 downward.

The unattached position is a falling end position of the container holder 220 and is a position where the collection container 300 is detached from the cleaning placing unit 200. In the unattached position, it is possible to insert the mouth section 301 of the collection container 300 between the engaging projecting sections 221, 221 and take out the mouth section inserted between the engaging projecting sections 221, 221. The container holder 220 in the unattached position can be switched to the attachment completed position by moving the container holder 220 present in the unattached position in the upward direction, that is, the longitudinal direction. In the attachment completed position, the container holder 220 is present in a rising end position. The mouth section 301 of the collection container 300 cannot be inserted between the engaging projecting sections 221, 221. The mouth section 301 of the collection container 300 held by the container holder 220 present in the attachment completed position is inserted into the attachment tube section 215. Therefore, the collection container 300 cannot be moved in the lateral direction.

After the container holder 220 holding the collection container 300 is moved to an attached position, it is possible to screw the thread 301*a* in the screw grove 215*a* and attach the collection container 300 to the bottom wall section 212 by rotating the collection container 300 in a direction in which the thread 301*a* of the mouth section 301 screws in the screw groove 215*a* of the attachment tube section 215. In a process of screwing the thread 301*a* in the screw groove 215*a*, the collection container 300 gradually moves upward. The container holder 220 is pushed upward to the attachment completed position illustrated in FIG. 26 by the collection container 300 according to the upward movement of the collection container 300 and reaches the attachment completed position. In this state, the lower end opening of the passing hole 212*b* formed in the bottom wall section 212 is disposed to face the inside of the collection container 300. Therefore, the entire amount of the cleaning liquid leaking from the printing head 1 can be collected in the collection container 300.

When the collection container 300 is detached, the collection container 300 is rotated in the opposite direction of the direction during the attachment and the mouth section 301 is separated from the attachment tube section 215. Thereafter, the mouth section 301 can be pulled out from between the engaging projecting sections 221, 221 by switching the container holder 220 to the unattached position and then moving the collection container 300 in the lateral direction.

The attachment structure of the collection container 300 is not limited to the structure explained above. The attachment structure may be, for example, structure for pressing the mouth section 301 of the collection container 300 into the attachment tube section 215. The pipe 350 illustrated in FIG. 21 may be structured to be pressed into the attachment tube section 215. The container holder 220 may be attached to the collection container 300 and guided by the main body section 210. The container holder 220 may be omitted.

Container Detection Sensor 235

As illustrated in FIG. 24, the cleaning placing unit 200 includes a container detection sensor 235 functioning as a container detecting unit that detects that the collection container 300 is attached. As the container detection sensor 235, a noncontact magnetic sensor can be used. The container detection sensor 235 can be configured by a Hall element or the like. That is, a magnet 231 is provided in the container holder 220. The magnet 231 is disposed such that a magnetic force acts upward. On the other hand, the container detection sensor 235 is provided, for example, on the inside of the bottom wall section 212 and is disposed right above the magnet 231. When the container holder 220 is present in the unattached position, the magnet 231 and the container detection sensor 235 are most apart from each other. The magnetic force of the magnet 231 cannot be detected by the container detection sensor 235. The container detection sensor 235 does not output a magnetic force detection signal. As illustrated in FIG. 26, when the thread 301*a* of the mouth section 301 is screwed in the screw groove 215*a* of the attachment tube section 215 and the container holder 220 is present in the attachment completed position, since the container holder 220 is switched to the attachment completed position, the magnet 231 and the container detection sensor 235 are closest to each other. The container detection sensor 235 is configured to output the magnetic force detection signal only at this time. That is, the container detection sensor 235 is configured to not output the magnetic force detection signal if the mouth section 301 is not connected to the attachment tube section 215 even if the collection container 300 is held by the container holder 220. The container detection sensor 235 is connected to the control unit 101 of the controller 100 and configured to output a signal to the control unit 101.

Although not illustrated, a magnet may be provided in the collection container 300. In this case as well, since the container detection sensor 235 is turned on only when the collection container 300 is switched to the attachment completed position, the container detection sensor 235 can detect that the collection container 300 is attached. When the container holder 220 is omitted, by attaching the magnet to the collection container 300, it is possible to detect that the collection container 300 is attached.

The container detecting unit may be, for example, a proximity sensor, a photoelectric sensor, a laser sensor, the sensor making use of the infrared communication, and the like besides the sensor that make use of the magnetic force detection signal. When the proximity sensor, the photoelectric sensor, and the laser sensor are used, it is possible to detect that, when the distance between the collection container 300 and the bottom wall section 212 is equal to or smaller than a predetermined distance, the collection container 300 is attached to the bottom wall section 212. In the case of the infrared communication, a light emitting element is provided in one of the collection container 300 and the bottom wall section 212 and a light receiving element is provided in the other. It is possible to determine, based on possibility of communication between the light emitting element and the light receiving element, that the collection container 300 is attached to the bottom wall section 212.

When the cleaning placing unit 200 includes the urging member that urges the container holder 220 downward, it is possible to prevent only the container holder 220 from being disposed in the rising end position in a state in which the collection container 300 is not attached. Consequently, it is possible to prevent misdetection by the container detection sensor 235.

Liquid Volume Sensor 240

Figure 27:
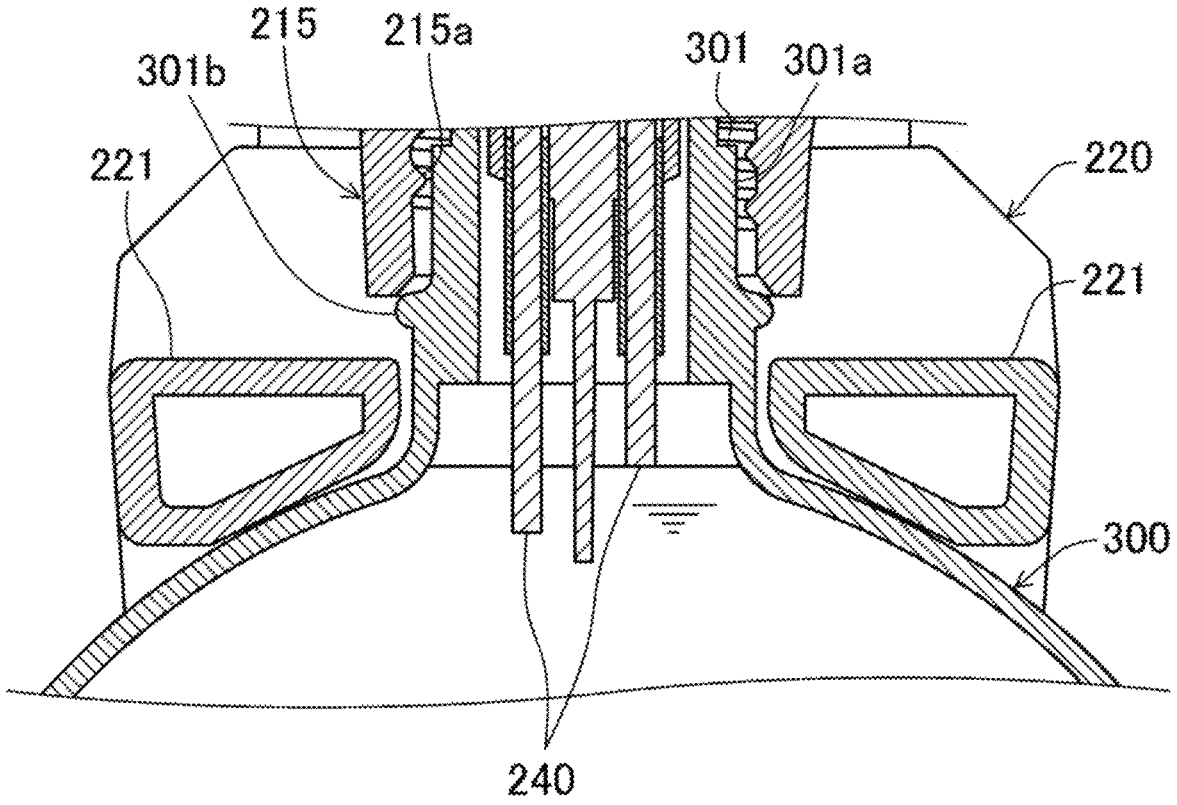
FIG. 27 is a sectional view of the collection container in a full state.

As illustrated in FIGS. 23 and 27, the cleaning placing unit 200 includes a liquid volume sensor 240 that detects a liquid volume in the collection container 300. The liquid volume sensor 240 includes two electrodes. These electrodes project downward from the lower surface of the bottom wall section 212 and are formed to reach below the mouth section 301 of the collection container 300 in the attached state from the mouth section 301. A measurement principle by the liquid volume sensor 240 is to measure the liquid volume making use of the fact that the cleaning liquid containing the ink is a conductor. Impedance between the two electrodes is measured. It is possible to detect, based on a change in the impedance, whether the liquid volume is equal to or larger than a predetermined amount. For example, the positions of the lower end portions of both the electrodes can be set to come into contact with the cleaning liquid when the liquid surface of the cleaning liquid reaches the vicinity of the mouth section 301 in the collection container 300. In this case, when the impedance between the two electrodes suddenly changes, this means that the cleaning liquid is in a full amount. The liquid volume sensor 240 can be used as a sensor that detects the full amount. The liquid volume sensor 240 can also be called overflow detection sensor that detects a state immediately before the cleaning liquid overflows. The liquid volume sensor 240 is connected to the control unit 101 of the controller 100 and configured to output a signal to the control unit 101.

When pure cleaning liquid is a nonconductor, by performing control for ejecting a small amount of the ink from the nozzle 12 before a cleaning operation, it is possible to always contain the ink in the cleaning liquid in the collection container 300. Consequently, the detection method explained above can be used.

The configuration of the liquid volume sensor 240 is not limited to the configuration explained above. The liquid volume sensor 240 may be any sensor if the sensor can directly or indirectly acquire the height of the liquid surface of the cleaning liquid in the collection container 300 and the amount and the weight of the cleaning liquid in the collection container 300. As an example of a sensor that acquires the height of the liquid surface of the cleaning liquid, there is a displacement sensor or the like. When the liquid volume is detected by the displacement sensor, presence or absence of the collection container 300 can also be detected by the displacement sensor.

The liquid volume sensor 240 may be, for example, a float sensor, a capacitance-type level sensor, or a photoelectric sensor.

Maintenance Execution Processing

Figure 28:
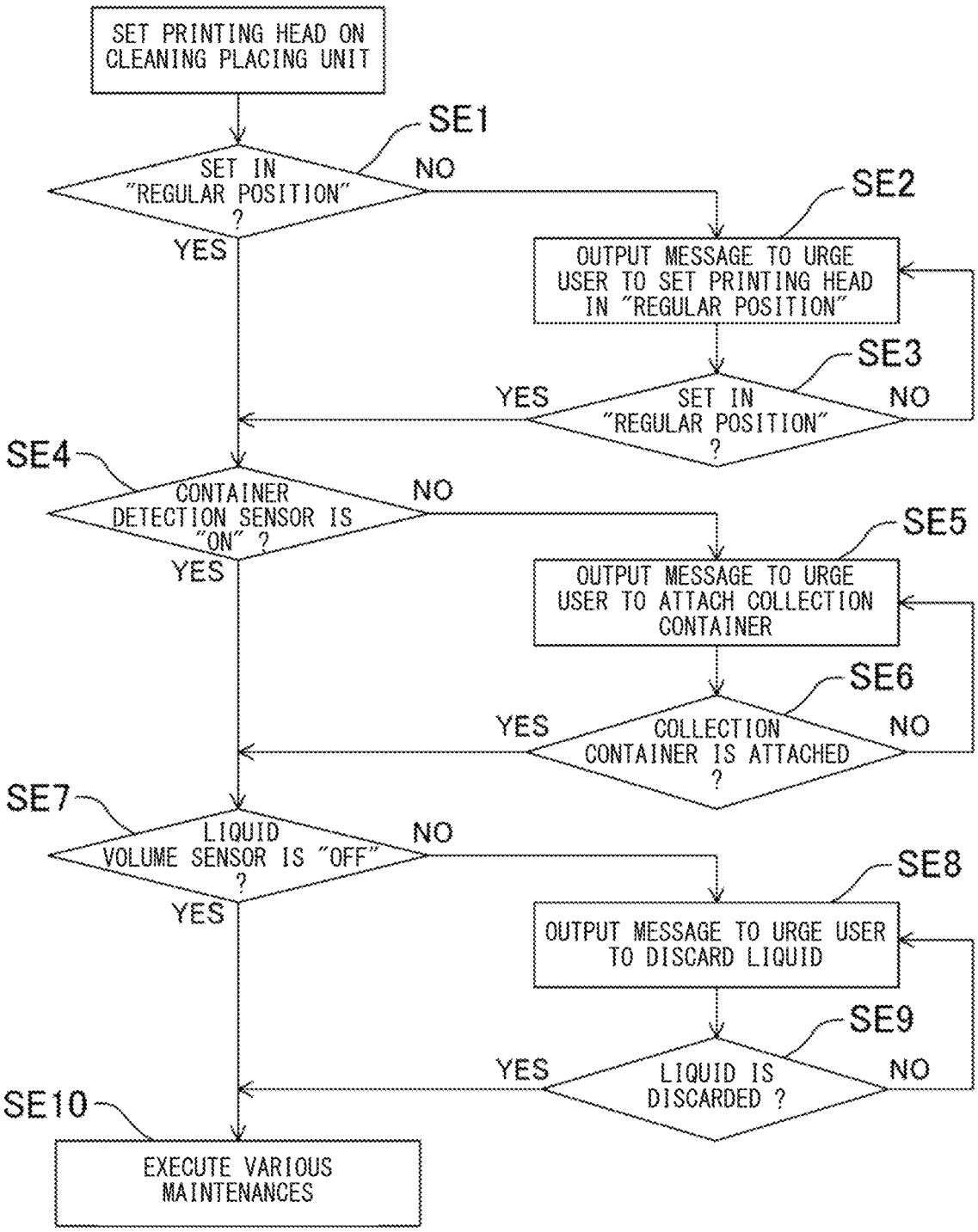
FIG. 28 is a flowchart illustrating maintenance execution processing.

FIG. 28 is a flowchart illustrating processing performed when maintenance is executed. The maintenance is, for example, a cleaning operation. Determination and control explained below can be performed by the control unit 101 of the controller 100. When the user sets the printing head 1 in the cleaning placing unit 200, in step SE1, the control unit 101 determines whether the printing head 1 is placed in the regular position with respect to the cleaning placing unit 200. An output signal of the magnetic sensor 10*b* can be used for the determination. If the magnetic force detection signal is output from the magnetic sensor 10*b*, since the printing head 1 is placed in the regular position of the cleaning placing unit 200, the control unit 101 determines YES. On the other hand, if the magnetic force detection signal is not output from the magnetic sensor 10*b*, since the printing head 1 is not placed in the regular position of the cleaning placing unit 200, the control unit 101 determines NO. In step SE1, the control unit 101 can also perform the determination based on whether the infrared communication between the light emitting element 211*c* and the light receiving element 10*c* is established. In this case, if the infrared communication between the light emitting element 211*c* and the light receiving element 10*c* is established, the control unit 101 determines YES. On the other hand, if the infrared communication between the light emitting element 211*c* and the light receiving element 10*c* is not established, the control unit 101 determines NO. In step SE1, the control unit 101 can also perform the determination based on the signal of the magnetic sensor 10*b* and the infrared communication. The control unit 101 determines NO if the magnetic force detection signal is not output from the magnetic sensor 10*b* or the infrared communication is not established. When determining YES in step SE1, the control unit 101 proceeds to step SE4.

On the other hand, when determining NO in step SE1 and proceeding to step SE2, the control unit 101 outputs a message to urge the user to place the printing head 1 in the regular position. The control unit 101 can cause, for example, the display unit 103*a* illustrated in FIG. 2 to display the message. Consequently, the control unit 101 can urge the user to confirm the position of the printing head 1. Thereafter, the control unit 101 proceeds to step SE3 and performs the same determination as the determination in step SE1. When determining NO, the control unit 101 proceeds to step SE2 and outputs the message again. When determining YES in step SE3 and the printing head 1 is placed in the regular position, the control unit 101 proceeds to step SE4.

In step SE4, the control unit 101 determines whether the container detection sensor 235 is on, that is, whether the collection container 300 is attached. When the collection container 300 is attached, the container detection sensor 235 outputs the magnetic force detection signal (the container detection sensor 235 is turned on). Therefore, in this case, the control unit 101 determines YES and proceeds to step SE7. On the other hand, when the collection container 300 is not attached, the control unit 101 determines NO in step SE4, proceeds to step SE5, and outputs a message to urge the user to attach the collection container 300. The control unit 101 can cause, for example, the display unit 103*a* illustrated in FIG. 2 to display the message. Consequently, the control unit 101 can urge the user to attach the collection container 300. Thereafter, the control unit 101 proceeds to step SE6 and performs the same determination as the determination in step SE4. When determining NO, the control unit 101 proceeds to step SE5 and outputs the message again. When determining YES in step SE6 and the collection container 300 is attached, the control unit 101 proceeds to step SE7.

In step SE7, the control unit 101 determines whether the liquid volume sensor 240 is on, that is, whether the collection container 300 is in the full amount or in a state close to the full amount. When the collection container 300 is not in the full amount or in the state close to the full amount, the liquid volume sensor 240 is turned off. Therefore, in this case, the control unit 101 determines YES and proceeds to step SE10. On the other hand, when the collection container 300 is in the full amount or in the state close to the full amount, the control unit 101 determines NO in step SE7, proceeds to step SE8, and outputs a message to urge the user to discard the cleaning liquid in the collection container 300. The control unit 101 can cause, for example, the display unit 103*a* illustrated in FIG. 2 to display the message. Consequently, the control unit 101 can urge the user to discard the cleaning liquid in the collection container 300. Thereafter, the control unit 101 proceeds to step SE9 and performs the same determination as the determination in step SE7. When determining NO, the control unit 101 proceeds to step SE8 and outputs the message again. When determining YES in step SE9 and the cleaning liquid is discarded, the control unit 101 proceeds to step SE10. In step SE10, the control unit 101 outputs a permission signal for the cleaning operation and enables various maintenances to be executed.

In this example, when receiving the signal based on the placement confirmation for the printing head 1 (the magnetic force detection signal) sent from the magnetic sensor 10*b*, which is the placement detecting unit, in step SE1 or SE3, the cleaning operation unit 101*a* of the controller 100 performs the cleaning operation for the printing head 1 placed on the cleaning placing unit 200. In other cases, the cleaning operation unit 101*a* prohibits the cleaning operation. When receiving the signal of the infrared communication (the signal based on the placement confirmation for the printing head 1) acquired by the light receiving element 10*c* in step SE1 or SE3, the cleaning operation unit 101*a* of the controller 100 performs the cleaning operation for the printing head 1 placed on the cleaning placing unit 200. In other cases, the cleaning operation unit 101*a* prohibits the cleaning operation. That is, in step SE1 or SE3, when the cleaning operation unit 101*a* does not receive the signal based on the placement confirmation for the printing head 1, the cleaning operation unit 101*a* can prohibit the cleaning operation for the printing head 1.

Connection Confirmation Processing

In the processing of the flowchart illustrated in FIG. 28 explained above, when receiving the signal based on the placement confirmation for the printing head 1, the control unit 101 performs detection of the collection container 300 and the liquid volume detection. If there is no problem in the detection of the collection container 300 and the liquid volume detection, the cleaning operation unit 101*a* performs the cleaning operation for the printing head 1. In a site where only one automatic printing system S is introduced, the printing head 1 placed on the cleaning placing unit 200 is a printing head for the automatic printing system S. Therefore, no particular problem occurs in the processing of the flowchart illustrated in FIG. 28.

Figure 29:
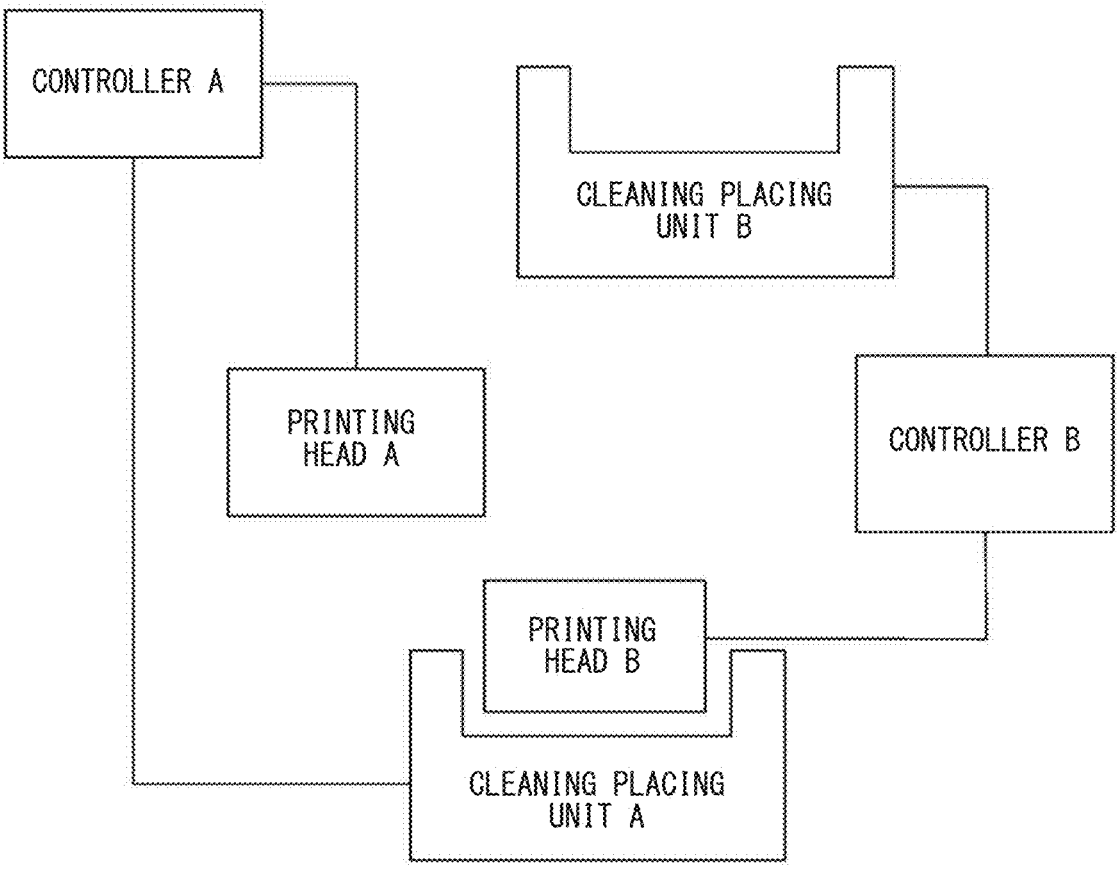
FIG. 29 is a diagram for explaining a case in which the printing head is placed on a cleaning placing unit of another system in a site where a plurality of automatic printing systems are introduced.

However, as illustrated in FIG. 29, a plurality of automatic printing systems S are sometimes introduced into one site. In this example, one automatic printing system S is configured by a first controller A, a first printing head A, and a first cleaning placing unit A. Another automatic printing system S is configured by a second controller B, a second printing head B, and a second cleaning placing unit B. The first and second printing heads A and B have the same structure and the same shape. The first and second cleaning placing units A and B have the same structure and the shame shape. Therefore, as illustrated in FIG. 29, when the user places the second printing head B connected to the second controller B on the first cleaning placing unit A by mistake, although the user intends to place the first printing head A connected to the first controller A on the first cleaning placing unit A in order to clean the first printing head A, the first printing head A is not placed on both the cleaning placing units A and B. When the automatic cleaning is performed in this state, since nothing receives the cleaning liquid leaking from the first printing head A, it is likely that the cleaning liquid contaminates an ambient environment or volatilizes to cause an unpreferable environment. That is, in the processing of the flowchart illustrated in FIG. 28, it is likely that, although the wrong placement is performed, the cleaning of the printing head is performed.

Figure 30:
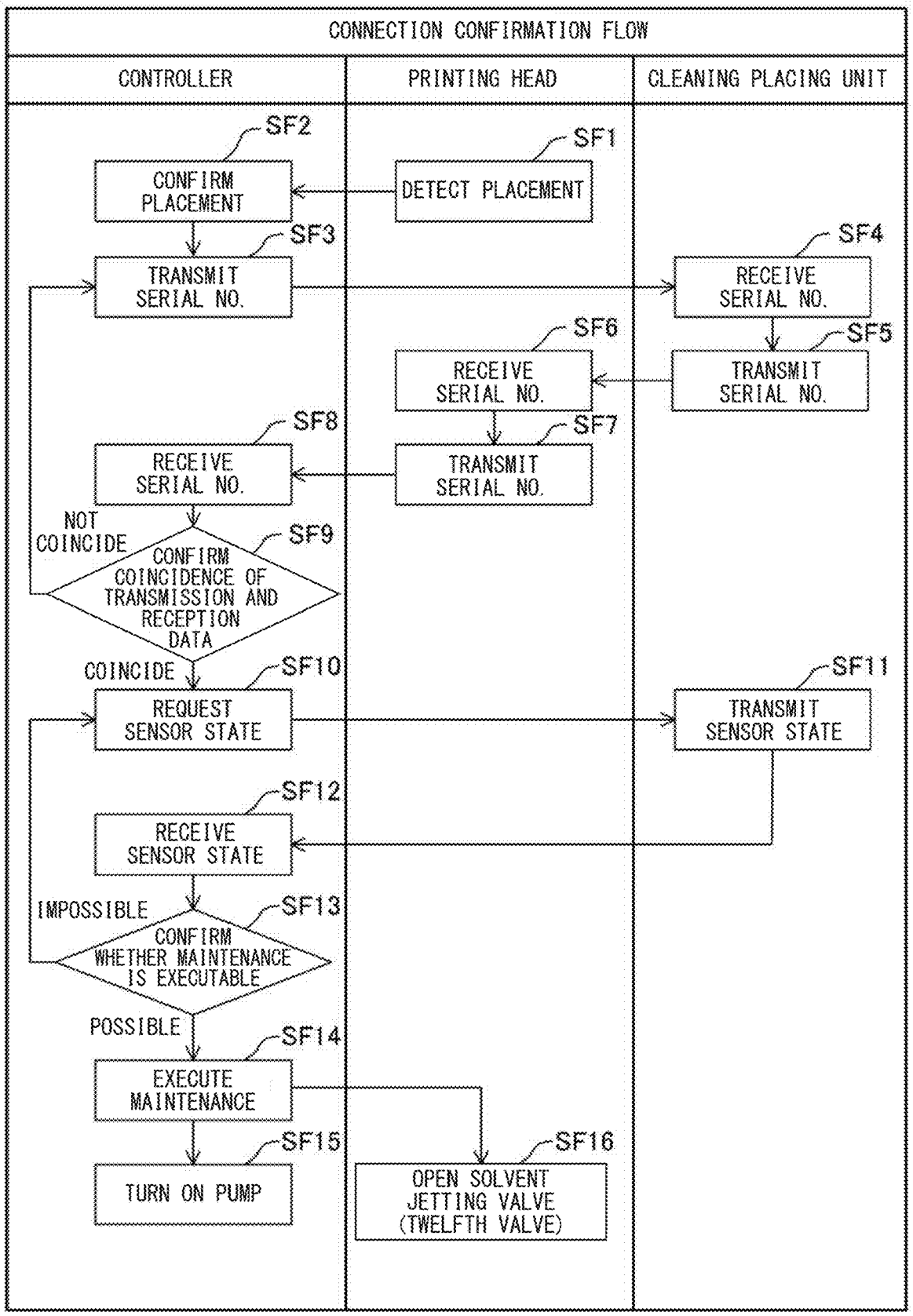
FIG. 30 is a flowchart illustrating processing for performing connection confirmation of the printing head.

In this case, processing of the flowchart illustrated in FIG. 30 can be performed. In step SF1, the control unit 101 detects a placement of the printing head 1 on the cleaning placing unit 200. This can be detected based on the magnetic force detection signal output from the magnetic sensor 10*b* or the signal of the infrared communication acquired by the light receiving element 10*c*. Thereafter, in step SF2, the cleaning operation unit 101*a* of the controller 100 confirms that the printing head 1 is placed.

In step SF3, the control unit 101 transmits a serial number, which is identification information, of the controller 100 to the cleaning placing unit 200. The identification information of the controller 100 is not limited to the serial number and can be information specific to the controller 100. The identification information can be formed by, for example, numbers, characters, signs, and the like, may be formed by any one of the numbers, the characters, the signs, and the like, or may be formed by combining any two of the numbers, the characters, the signs, and the like. The identification information of the controller 100 may be a random number.

In step SF4, the cleaning placing unit 200 receives the serial number transmitted from the controller 100. In step SF5, the cleaning placing unit 200 transmits the serial number transmitted from the controller 100 to the printing head 1. At this time, the serial number can be transmitted by the infrared communication by the light emitting element 211*c* and the light receiving element 10*c*. In step SF6, the printing head 1 receives the serial number of the controller 100 transmitted from the cleaning placing unit 200. In step SF7, the printing head 1 transmits the serial number of the controller 100 transmitted from the cleaning placing unit 200 to the controller 100. In step SF8, the controller 100 receives the serial number transmitted from the printing head 1. In step SF9, the control unit 101 of the controller 100 determines whether the serial number of the controller 100 transmitted from the printing head 1 coincides with the serial number transmitted by the controller 100 in step SF3. This processing is authentication processing for authenticating whether the printing head 1 placed on the cleaning placing unit 200 is the printing head 1 connected to the controller 100. The serial numbers not coinciding with each other means that the printing head 1 is not the printing head 1 connected to the controller 100. Therefore, the control unit 101 does not proceed to the following processing, returns to step SF3, and repeats the processing in steps SF3 to SF9. When determining in step SF9 that the serial numbers do not coincide even if the processing is repeated a predetermined time, the control unit 101 suspends the flow and informs the user or performs error display.

On the other hand, when determining in step SF9 that the serial number of the controller 100 transmitted from the printing head 1 coincides with the serial number transmitted by the controller 100 in step SF3, the control unit 101 proceeds to step SF10. In step SF10, the control unit 101 requests the cleaning placing unit 200 to output sensor states. In step SF11, the cleaning placing unit 200 transmits the sensor states, that is, states of the container detection sensor 235 and the liquid volume sensor 240 to the cleaning operation unit 101*a* of the controller 100. In step SF12, the cleaning operation unit 101*a* receives the sensor states. In step SF13, the control unit 101 confirms whether maintenance is executable.

Figure 31:
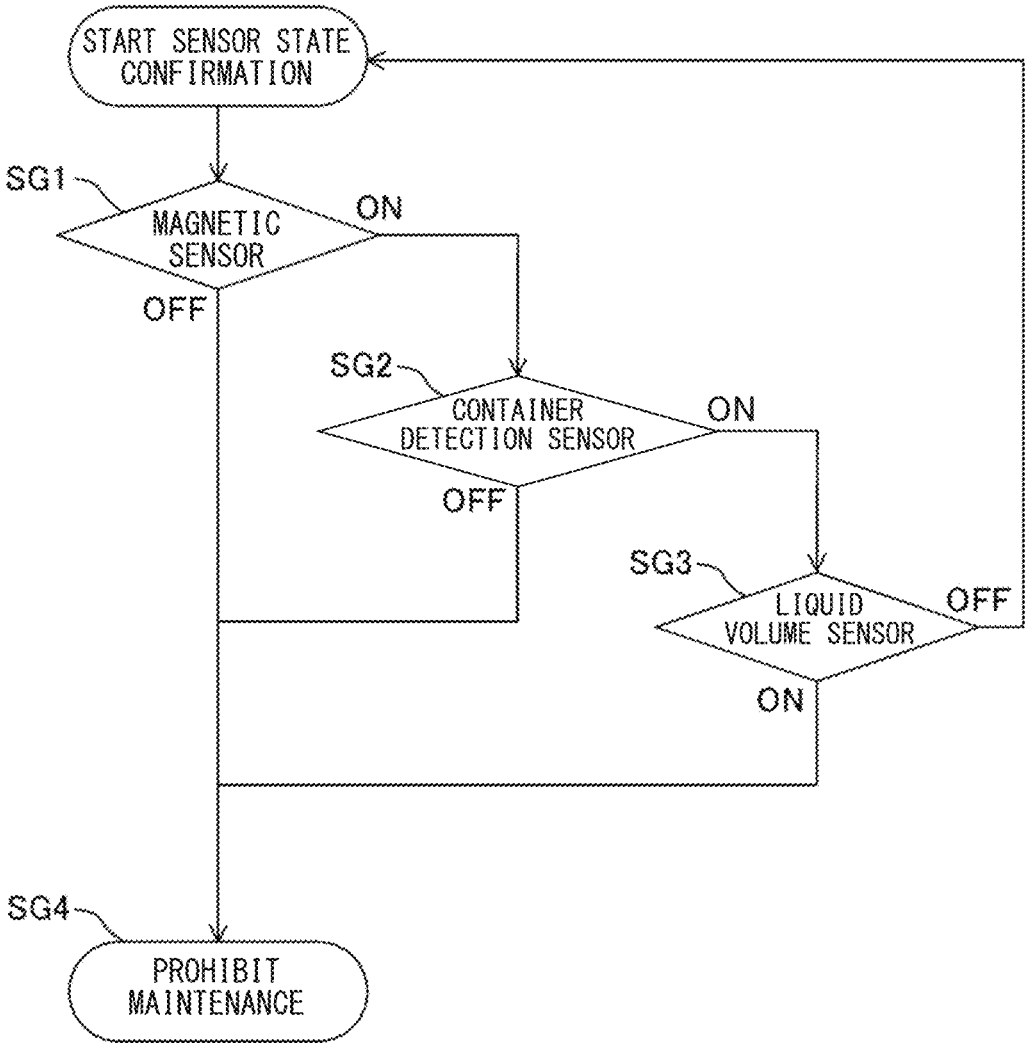
FIG. 31 is a flowchart illustrating confirmation processing for confirming whether maintenance is executable.

A flowchart during the confirmation is illustrated in FIG. 31. After starting the confirmation of the sensor states, in step SG1, the control unit 101 confirms a state of the magnetic sensor 10*b*. If the magnetic sensor 10*b* is on, that is, the magnetic sensor 10*b* outputs the magnetic force detection signal, the control unit 101 proceeds to step SG2. On the other hand, if the magnetic sensor 10*b* is off, that is, the magnetic sensor 10*b* does not output the magnetic force detection signal, the control unit 101 proceeds to step SG4. A signal of the infrared communication acquired by the light receiving element 10*c* instead of the magnetic sensor 10*b* can be used.

In step SG2, the control unit 101 confirms a state of the container detection sensor 235. If the container detection sensor 235 is on, that is, the collection container 300 is attached, the control unit 101 proceeds to step SG3. On the other hand, if the container detection sensor 235 is off, that is, the collection container 300 is not attached, the control unit 101 proceeds to step SG4. In step SG3, the control unit 101 confirms a state of the liquid volume sensor 240. If the liquid volume sensor 240 is off, that is, the amount of the cleaning agent in the collection container 300 is smaller than the full amount, the control unit 101 returns to the first step and enables maintenance to be performed. On the other hand, if the liquid volume sensor 240 is on, that is, the amount of the cleaning agent in the collection container 300 is the full amount, the control unit 101 proceeds to step SG4. In step SG4, since maintenance is prohibited, the cleaning operation unit 101*a* does not permit the cleaning operation. Unless the control unit 101 proceeds to step SG4, the cleaning operation unit 101*a* permits the cleaning operation. Therefore, the control unit 101 determines "possible" in step SF13 of the flowchart illustrate in FIG. 30 and proceeds to step SF14. When proceeding to step SG4 of the flowchart illustrated in FIG. 31, the control unit 101 determines "impossible" in step SF13 of the flowchart illustrated in FIG. 30 and returns to step SF10.

In step SF14, the cleaning operation unit 101*a* executes maintenance. Specifically, the cleaning operation unit 101*a* actuates the solvent pump P2 of the controller 100 and opens the solvent jetting valve. During the cleaning operation, the flowchart illustrated in FIG. 31 is repeatedly executed. The cleaning operation unit 101*a* suspends the cleaning operation at a point in time when the control unit 101 proceeds to step SG4.

The printing head 1 is configured to, in step SF1, transmit a signal based on the placement confirmation for the printing head 1 and transmit, to the controller 100, identification information of the controller 100 acquired in advance via the signal line in step SF7. Therefore, the cleaning operation is not executed when the printing head 1 is only placed. The cleaning operation is not executed unless the identification information of the controller 100 coincides in step SF9. For example, when the second printing head B is placed on the first cleaning placing unit A as illustrated in FIG. 29, identification information transmitted from the first controller A is received by the second controller B. As a result, since the identification information is not transmitted to the first controller A, the first controller A does not perform the cleaning operation. Accordingly, it is possible to prevent the cleaning liquid from leaking from the first printing head A.

The printing head 1 can also be configured to, when transmitting the signal based on the placement confirmation for the printing head 1 in step SF1, transmit the identification information of the printing head 1 to the controller 100. When identification information including a specific identification number is given to the printing head 1 connected to the controller 100, by confirming the identification information of the printing head 1 in the controller 100, it is possible to confirm whether the printing head 1 is the printing head 1 connected to the controller 100. The cleaning operation unit 101*a* can be configured to, when the placement confirmation for the printing head 1 is performed and it is confirmed that the printing head 1 is the printing head 1 connected to the controller 100, permit the cleaning operation of the printing head 1.

Modification 1

Figure 32:
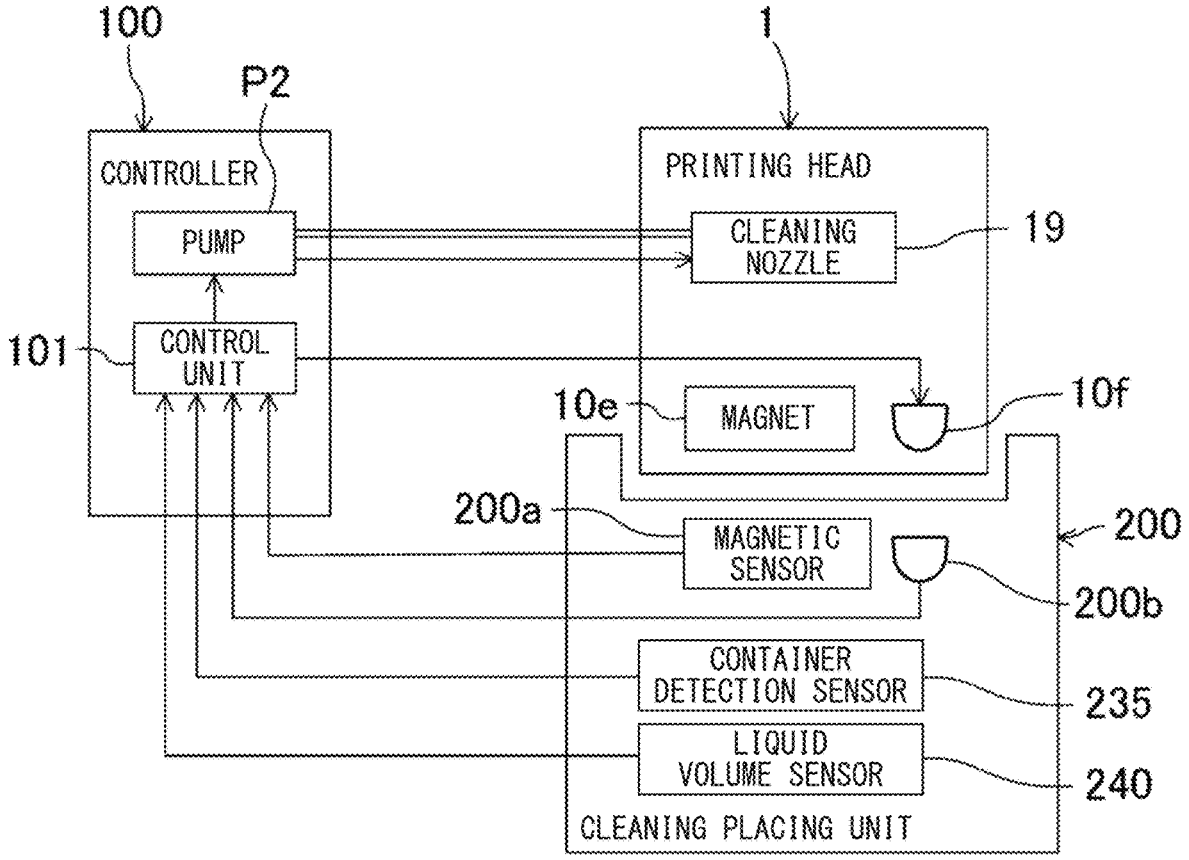
FIG. 32 is a diagram equivalent to FIG. 20 according to a modification 1.

FIG. 32 is a simple block diagram relating to a modification 1 of the embodiment. In the modification 1, a magnet 10*e* and a light emitting element 10*f* are provided in the printing head 1. The light emitting element 10*f* is controlled by the control unit 101 of the controller 100. A magnetic sensor 200*a* and a light receiving element 200*b* are provided in the cleaning placing unit 200. The magnetic sensor 200*a* of the cleaning placing unit 200 is capable of detecting a magnetic force of the magnet 10*e* of the printing head 1. The light receiving element 200*b* of the cleaning placing unit 200 is capable of receiving infrared light irradiated by the light emitting element 10*f* of the printing head 1. The magnetic sensor 200*a* and the light receiving element 200*b* are connected to the control unit 101 of the controller 100. In the modification 1, based on the infrared communication and a detection result by the magnetic sensor 200*a*, it is possible to perform the placement confirmation for the printing head 1 and accurately determine whether the printing head 1 is present in the regular position.

Figure 33:
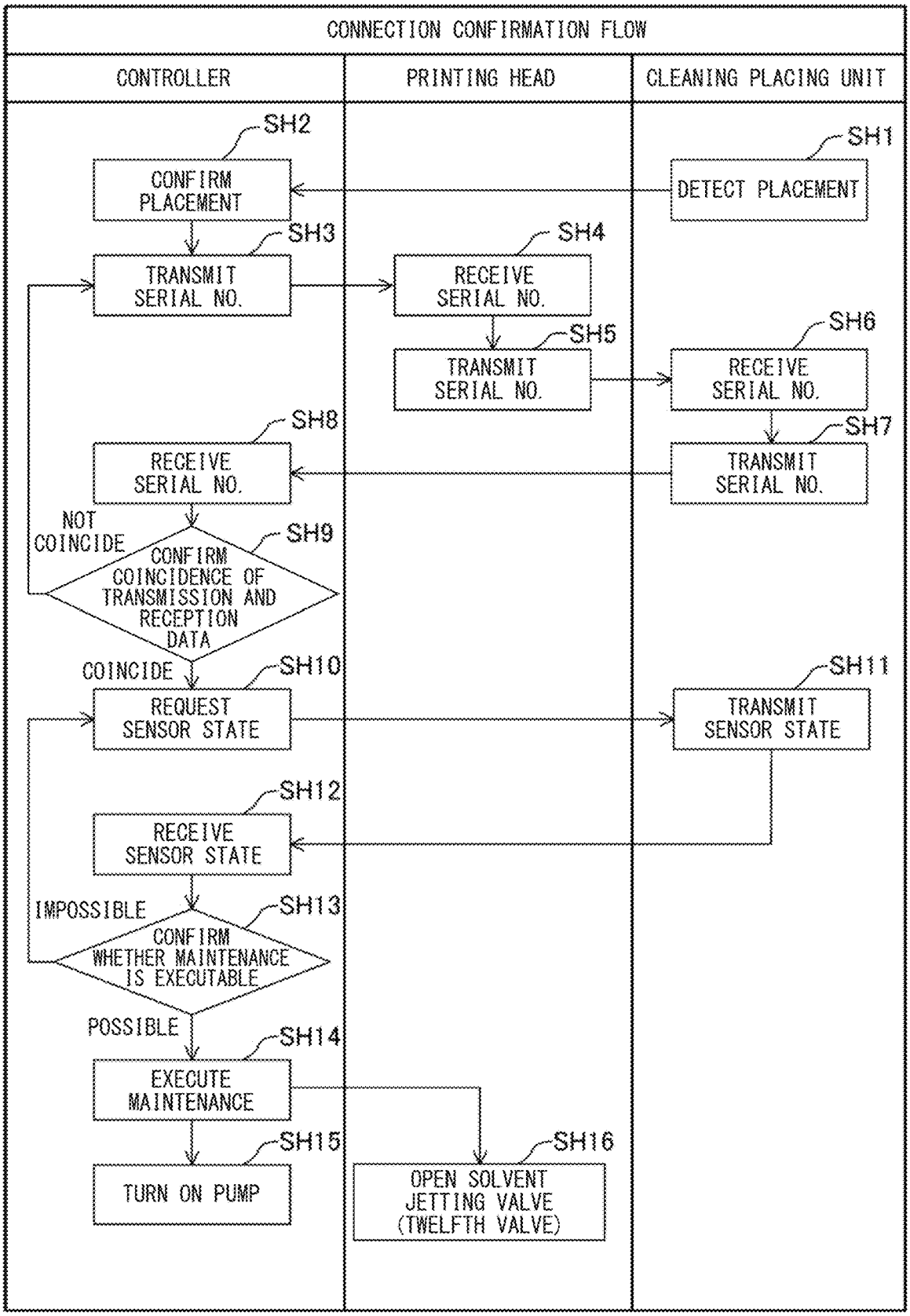
FIG. 33 is a diagram equivalent to FIG. 30 according to the modification 1.

FIG. 33 is a flowchart illustrating processing according to the modification 1 of the embodiment. In step SH1, the cleaning placing unit 200 detects a placement of the printing head 1 on the cleaning placing unit 200. This can be detected based on a magnetic force detection signal output from the magnetic sensor 200*a* or a signal of infrared communication acquired by the light receiving element 200*b*. Thereafter, in step SH2, the cleaning operation unit 101*a* of the controller 100 confirms that the printing head 1 is placed.

In step SH3, the control unit 101 transmits a serial number, which is identification information, of the controller 100 to the printing head 1. In step SH4, the printing head 1 receives the serial number transmitted from the controller 100. In step SH5, the printing head 1 transmits the serial number transmitted from the controller 100 to the cleaning placing unit 200. At this time, the serial number can be transmitted by infrared communication by the light emitting element 10*f* and the light receiving element 200*b*. In step SH6, the cleaning placing unit 200 receives the serial number of the controller 100 transmitted from the printing head 1. In step SH7, the cleaning placing unit 200 transmits the serial number of the controller 100 transmitted from the printing head 1 to the controller 100. In step SH8, the controller 100 receives the serial number transmitted from the cleaning placing unit 200. Steps SH9 to SH16 are respectively the same as steps SF9 to SF16 of the flowchart illustrated in FIG. 30. Consequently, since the cleaning operation is not executed if the serial numbers do not coincide in step SH9, the first printing head A is not cleaned in the state illustrated in FIG. 29.

Modification 2

Figure 34:
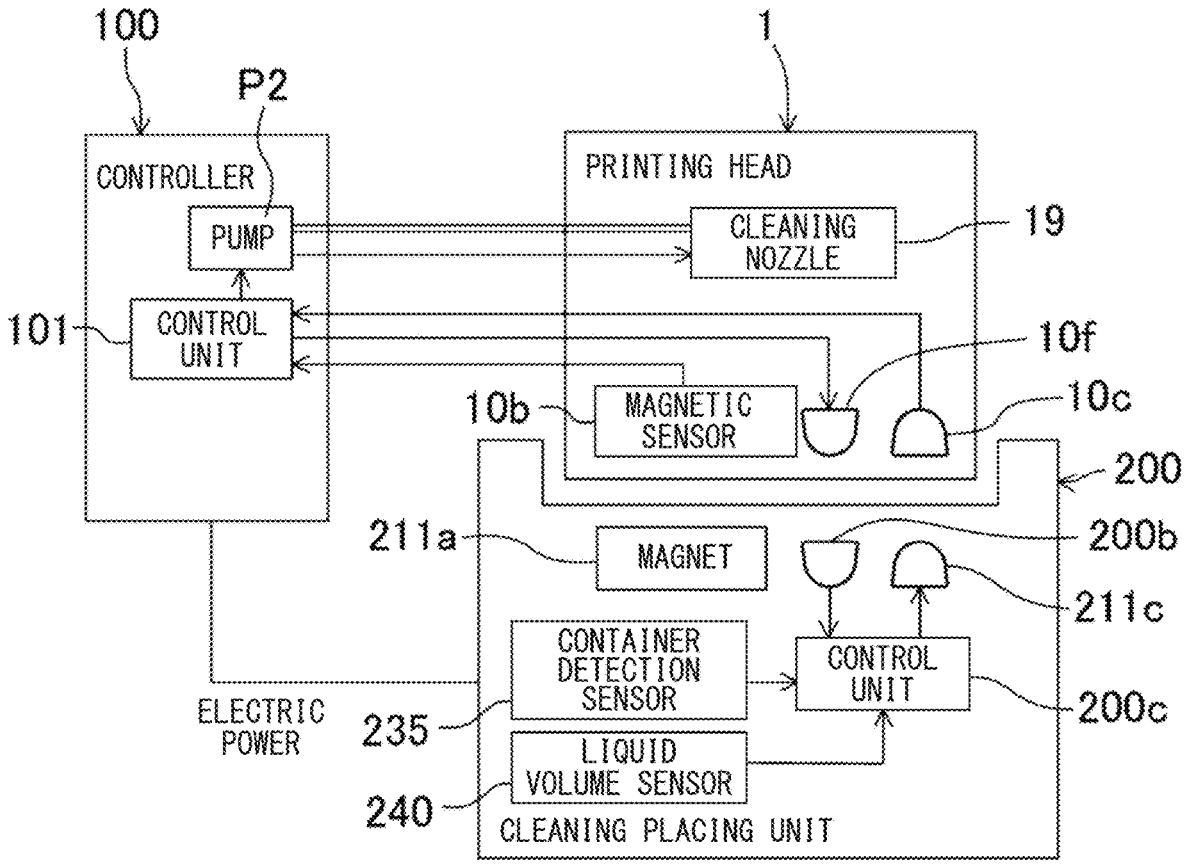
FIG. 34 is a diagram equivalent to FIG. 20 according to a modification 2.

FIG. 34 is a simple block diagram relating to a modification 2 of the embodiment. In the modification 2, not only the light receiving element 10*c* but also the light emitting element 10*f* is provided in the printing head 1. The light emitting element 10*f* is controlled by the control unit 101 of the controller 100. Not only the light emitting element 211*c* but also the light receiving element 200*b* is provided in the cleaning placing unit 200. Further, a control unit 200*c* is provided in the cleaning placing unit 200. The container detection sensor 235, the liquid volume sensor 240, the light receiving element 200*b*, and the light emitting element 211*c* are connected to the control unit 200*c*. Detection results of the container detection sensor 235 and the liquid volume sensor 240 and information received by the light receiving element 200*b* are processed by the control unit 200*c* and, thereafter, transmitted to the printing head 1 side by the light emitting element 211*c* and received by the light receiving element 10*c*. The information received by the printing head 1 is transmitted to the control unit 101 of the controller 100. In the modification 2, the controller 100 only supplies electric power to the cleaning placing unit 200 and does not perform direct communication between the controller 100 and the cleaning placing unit 200. A battery may be incorporated in the cleaning placing unit 200.

Figure 35:
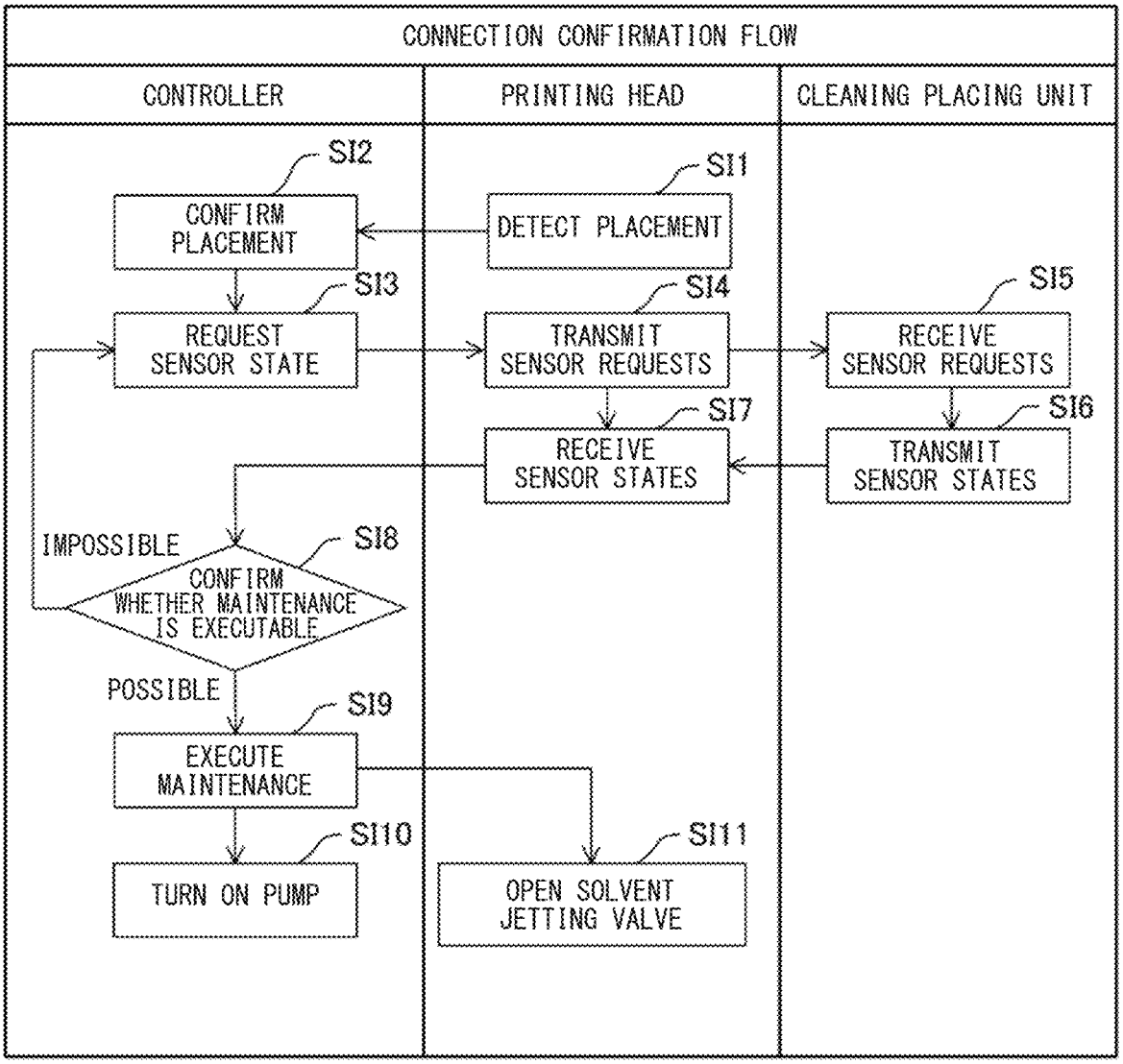
FIG. 35 is a diagram equivalent to FIG. 30 according to the modification 2.

FIG. 35 is a flowchart illustrating processing according to the modification 2 of the embodiment. In step SI1, the printing head 1 detects a placement of the printing head 1 on the cleaning placing unit 200. This can be detected based on a magnetic force detection signal output from the magnetic sensor 10*b* or a signal of infrared communication acquired by the light receiving element 10*c*. Thereafter, in step SI2, the cleaning operation unit 101*a* of the controller 100 confirms that the printing head 1 is placed.

In step SI3, the control unit 101 requests the printing head 1 to output sensor states. In step SI4, the printing head 1 requests the cleaning placing unit 200 to output the sensor states. In step SI5, the cleaning placing unit 200 receives the output request for the sensor states transmitted from the printing head 1. In step SI6, the cleaning placing unit 200 transmits states of the container detection sensor 235 and the liquid volume sensor 240 to the printing head 1. In step SI7, the printing head 1 receives the states of the container detection sensor 235 and the liquid volume sensor 240 transmitted from the cleaning placing unit 200.

In step SI8, the control unit 101 receives the states of the container detection sensor 235 and the liquid volume sensor 240 and confirms whether maintenance is executable. If the maintenance is "possible", after proceeding to step SI9, the control unit 101 proceeds to steps SI10 and SI11 and executes the cleaning operation. If the maintenance is "impossible", the control unit 101 returns to step SI3.

In the modification 2, the states of the container detection sensor 235 and the liquid volume sensor 240 can be acquired through the printing head 1. Therefore, even in the wrong placement illustrated in FIG. 29, control can be performed based on the states of the container detection sensor 235 and the liquid volume sensor 240. Safety can be guaranteed.

Modification 3

Figure 36:
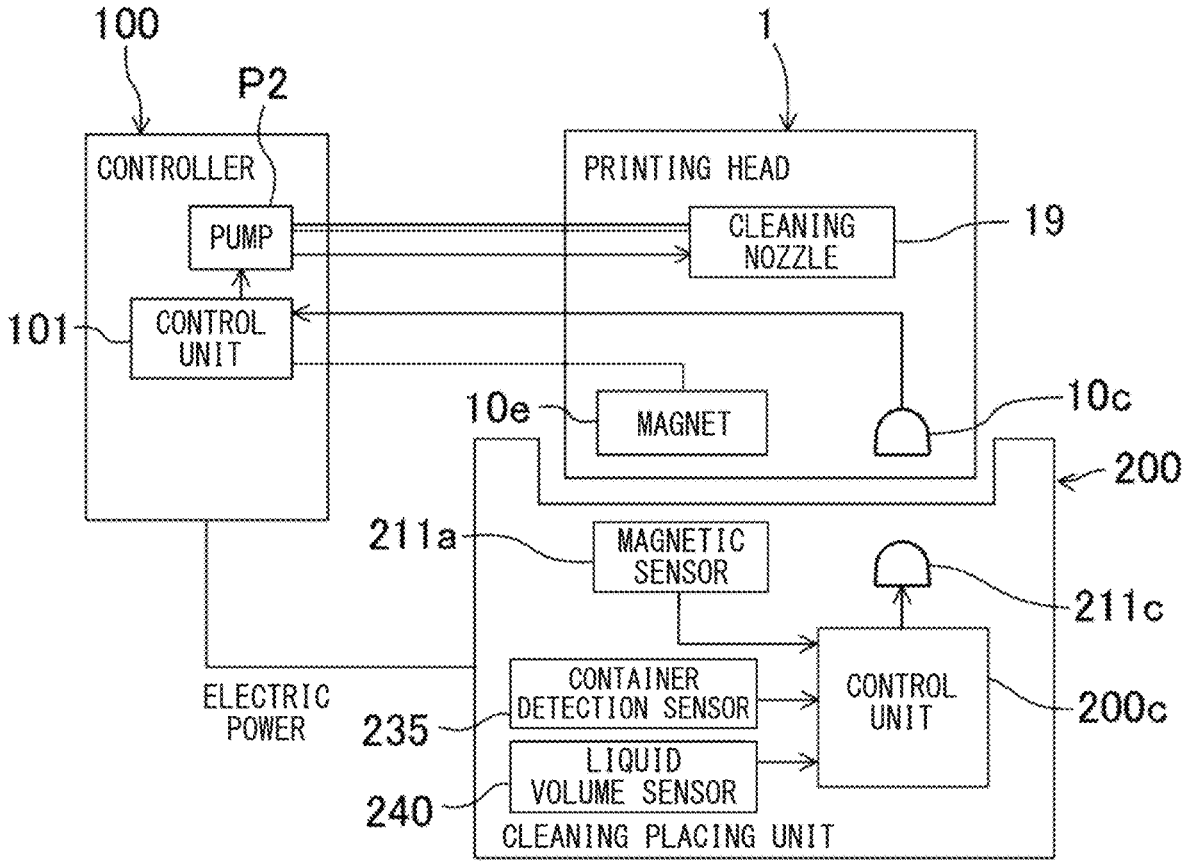
FIG. 36 is a diagram equivalent to FIG. 20 according to a modification 3.

FIG. 36 is a simple block diagram relating to a modification 3 of the embodiment. In the modification 3, the control unit 200*c* is provided in the cleaning placing unit 200. A magnetic sensor 211*a*, the container detection sensor 235, the liquid volume sensor 240, and the light emitting element 211*c* are connected to the control unit 200*c*. Detection results of the magnetic sensor 211*a*, the container detection sensor 235, and the liquid volume sensor 240 are processed by the control unit 200*c* and, thereafter, transmitted to the printing head 1 side by the light emitting element 211*c* and received by the light receiving element 10*c*. Information received by the printing head 1 is transmitted to the control unit 101 of the controller 100. In the modification 3, the controller 100 only supplies electric power to the cleaning placing unit 200 and does not perform direct communication between the controller 100 and the cleaning placing unit 200.

Figure 37:
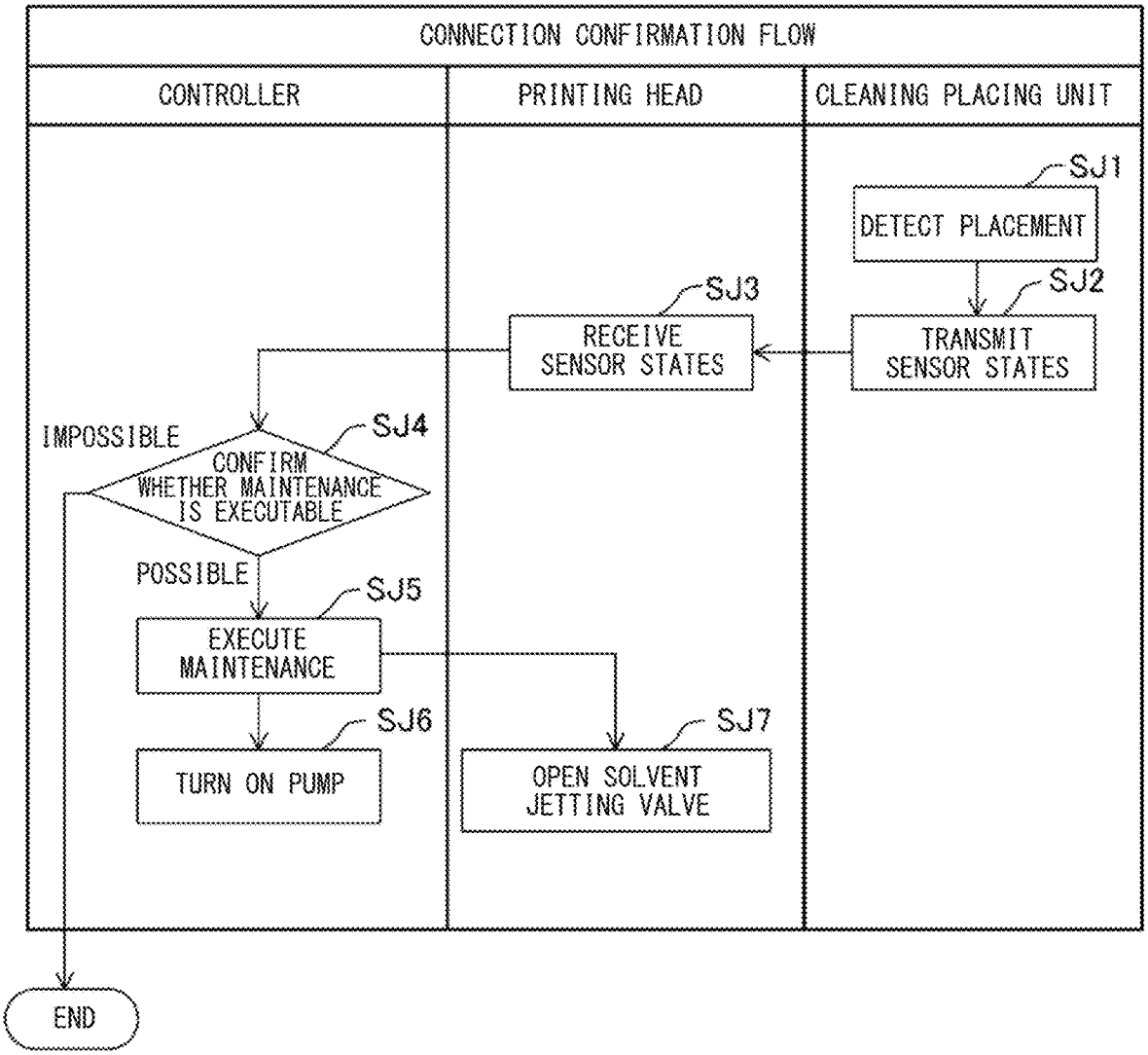
FIG. 37 is a diagram equivalent to FIG. 30 according to the modification 3.

FIG. 37 is a flowchart illustrating processing according to the modification 3 of the embodiment. In step SJ1, the cleaning placing unit 200 detects a placement of the printing head 1 on the cleaning placing unit 200. This can be detected based on a magnetic force detection signal output from the magnetic sensor 211*a*. Thereafter, in step SJ2, the cleaning placing unit 200 transmits states of the container detection sensor 235 and the liquid volume sensor 240 to the printing head 1. In step SJ3, the printing head 1 transmits the sensor states transmitted from the cleaning placing unit 200 to the controller 100.

In step SJ4, the control unit 101 receives the states of the container detection sensor 235 and the liquid volume sensor 240 and confirms whether maintenance is executable. If the maintenance is "possible", the control unit 101 proceeds to step SJ5 and, thereafter, proceeds to steps SJ6 and SJ7 and executes the cleaning operation. If the maintenance is "impossible", the control unit 101 ends this flow.

In the modification 3, rather than responding to a command from the controller 100, when the cleaning placing unit 200 detects the placement, the cleaning placing unit 200 outputs the sensor states unidirectionally. Consequently, since an infrared communication unit only has to be configured by unidirectional communication, it is possible to reduce the numbers of light emitting elements and light receiving elements.

Modification 4

Figure 38:
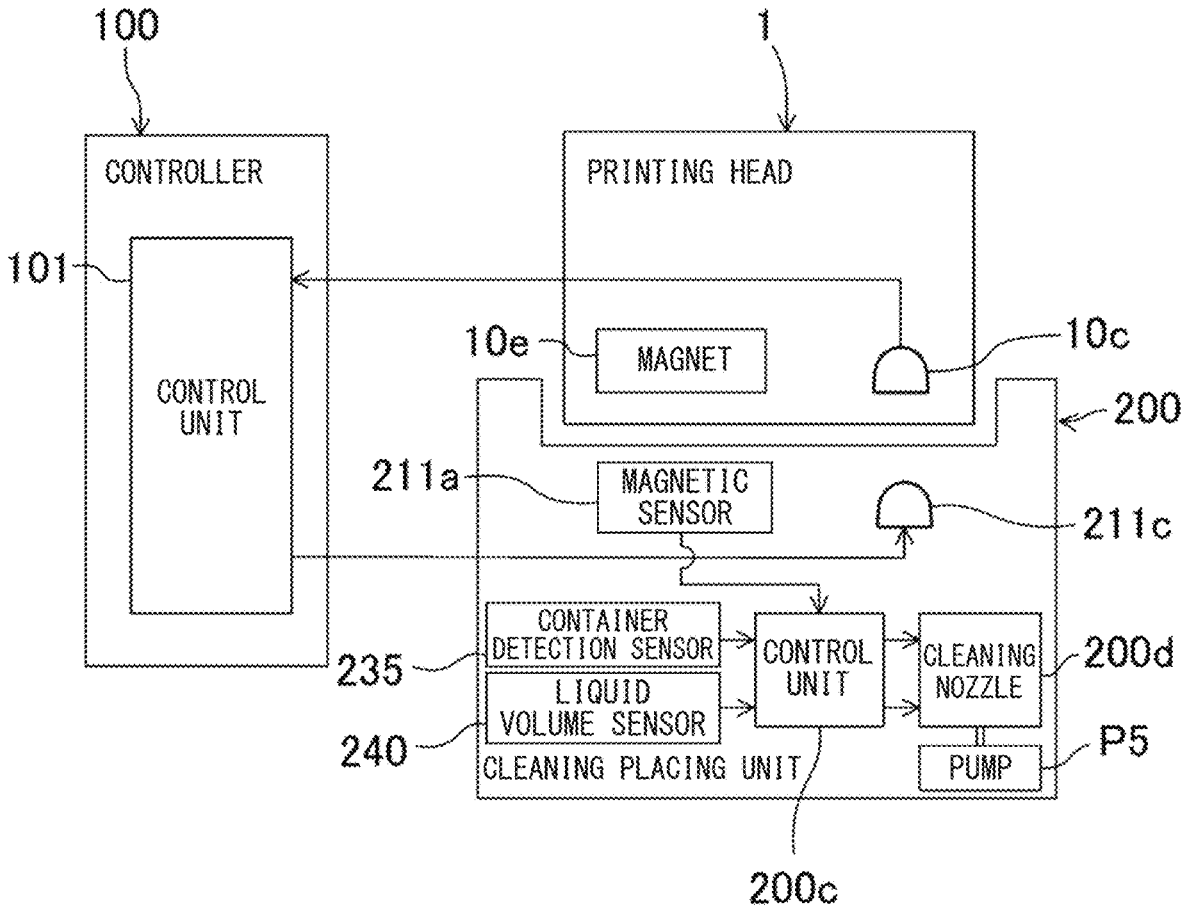
FIG. 38 is a diagram equivalent to FIG. 20 according to a modification 4.

FIG. 38 is a simple block diagram relating to a modification 4 of the embodiment. In the modification 4, a cleaning agent nozzle 200*d* and a cleaning agent pump P5 are provided in the cleaning placing unit 200 and the control unit 200*c* is also provided in the cleaning placing unit 200. A not-illustrated cleaning agent tank or a not-illustrated cleaning agent cartridge is connected to the cleaning agent pump P5. The magnetic sensor 211*a*, the container detection sensor 235, the liquid volume sensor 240, and the light emitting element 211*c* are connected to the control unit 200*c*. Detection results of the magnetic sensor 211*a*, the container detection sensor 235, and the liquid volume sensor 240 are processed by the control unit 200*c*. The control unit 200*c* can control an electromagnetic valve (a cleaning agent jetting valve) of the cleaning agent nozzle 200*d* and the cleaning agent pump P5 and execute the cleaning operation. The cleaning agent nozzle 200*d* can be disposed like the cleaning agent nozzle 360 illustrated in FIG. 24. In the modification 4, since the solvent in the controller 100 does not have to be used as the cleaning agent, water and a water-soluble cleaning agent can be used.

Figure 39:
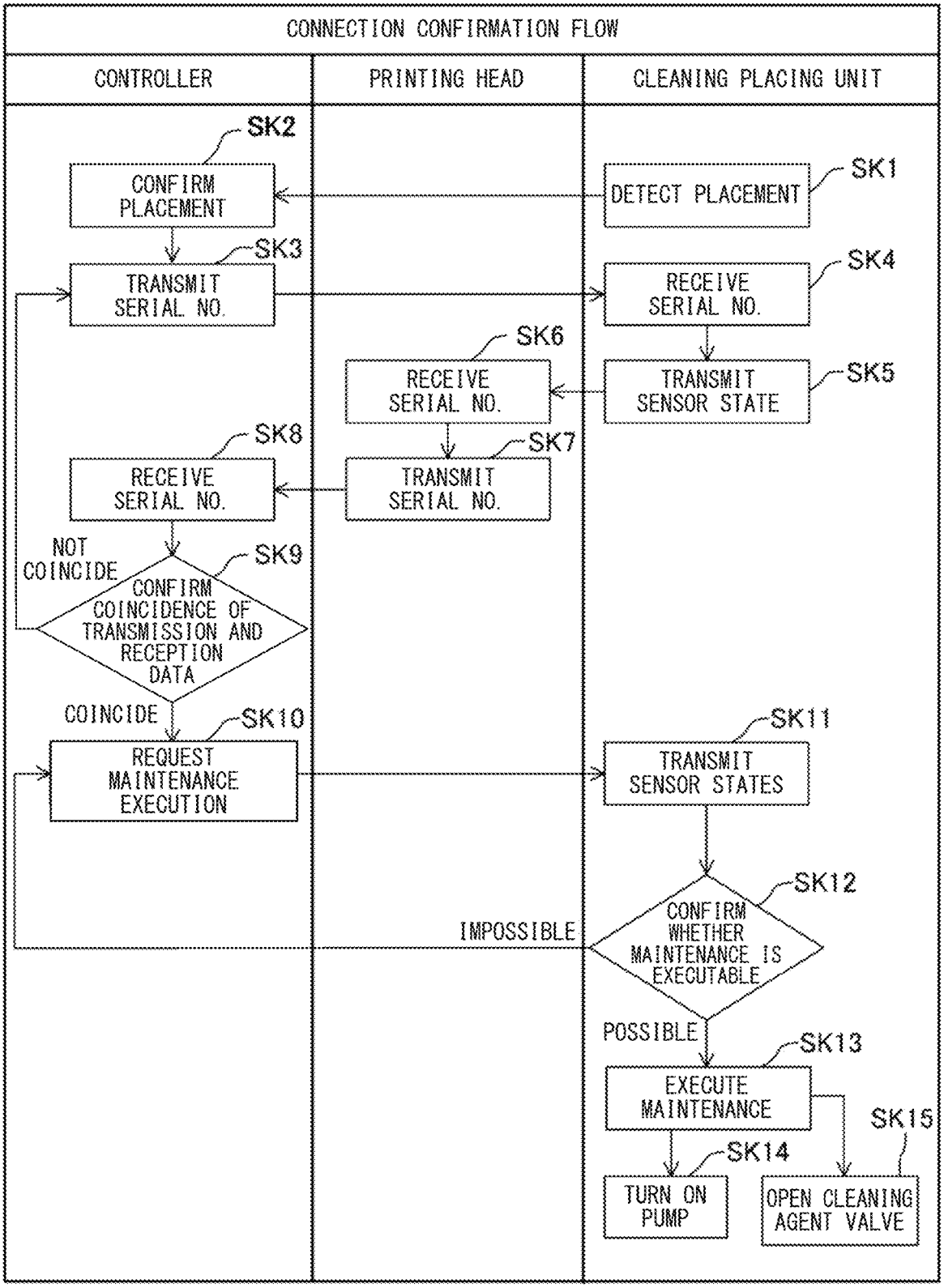
FIG. 39 is a diagram equivalent to FIG. 30 according to the modification 4.

FIG. 39 is a flowchart illustrating processing according to the modification 3 of the embodiment. In step SK1, the cleaning placing unit 200 detects a placement of the printing head 1 on the cleaning placing unit 200. This can be detected based on a magnetic force detection signal output from the magnetic sensor 211*a*. Thereafter, in step SK2, the cleaning operation unit 101*a* of the controller 100 confirms that the printing head 1 is placed.

In step SK3, the controller 100 transmits a serial number, which is identification information, of the controller 100 to the cleaning placing unit 200. In step SK4, the cleaning placing unit 200 receives the serial number transmitted from the controller 100. In step SK5, the cleaning placing unit 200 transmits the serial number transmitted from the controller 100 to the printing head 1. In step SK6, the printing head 1 receives the serial number of the controller 100 transmitted from the cleaning placing unit 200. In step SK7, the printing head 1 transmits the serial number of the controller 100 transmitted from the cleaning placing unit 200 to the controller 100. In step SK8, the controller 100 receives the serial number transmitted from the printing head 1. In step SK9, the control unit 101 determines whether the serial number of the controller 100 transmitted from the printing head 1 coincides with the serial number transmitted by the controller 100 in step SK3. When the serial numbers do not coincide, the control unit 101 returns to step SK3.

On the other hand, when determining in step SK9 that the serial number of the controller 100 transmitted from the printing head 1 coincides with the serial number transmitted from the controller 100 in step SK3, the control unit 101 proceeds to step SK10. In step SK10, the control unit 101 transmits a maintenance execution request to the cleaning placing unit 200. In step SK11, the control unit 101 transmits states of the container detection sensor 235 and the liquid volume sensor 240 to the control unit 200*c*. In step SK12, the control unit 200*c* determines, based on the states of the container detection sensor 235 and the liquid volume sensor 240, whether maintenance is executable. When the maintenance is "impossible", the control unit 101 returns to step SK10. When the maintenance is "possible", the control unit 101 proceeds to step SK13 and, thereafter, actuates the pump P5 in step SK14, and opens the cleaning agent jetting valve in step SK15.

Modification 5

Figure 40:
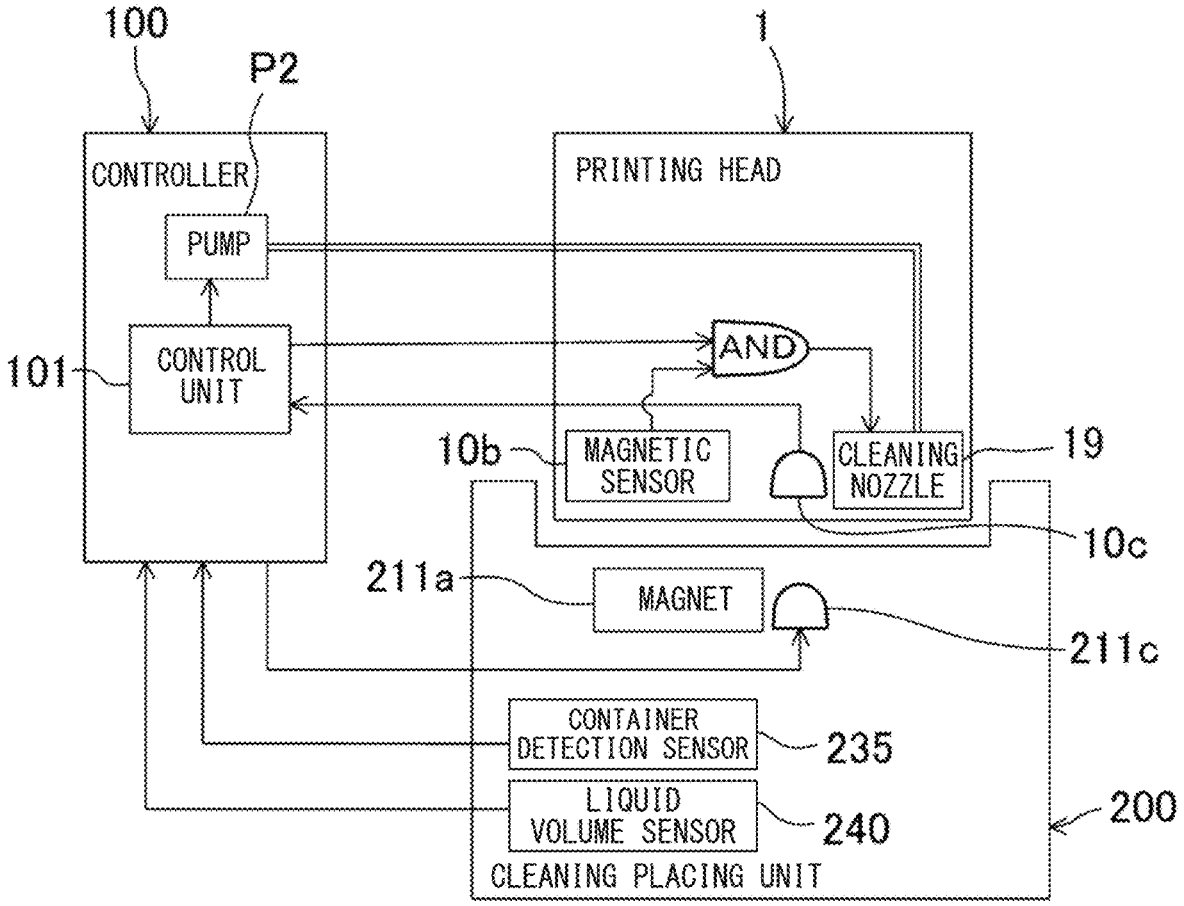
FIG. 40 is a diagram equivalent to FIG. 20 according to a modification 5.

FIG. 40 is a simple block diagram relating to a modification 5 of the embodiment. In the modification 5, the printing head 1 includes an AND circuit. The electromagnetic valve of the cleaning nozzle 19 can be controlled by the AND circuit. A control signal from the control unit 101 is input to the AND circuit and an output signal of the magnetic sensor 10*b* is input to the AND circuit. The control signal from the control unit 101 is a cleaning operation permission signal. When a magnetic force detection signal of the magnetic sensor 10*b* is input, the electromagnetic valve of the cleaning nozzle 19 can be switched from close to open to perform the cleaning operation.

Figure 41:
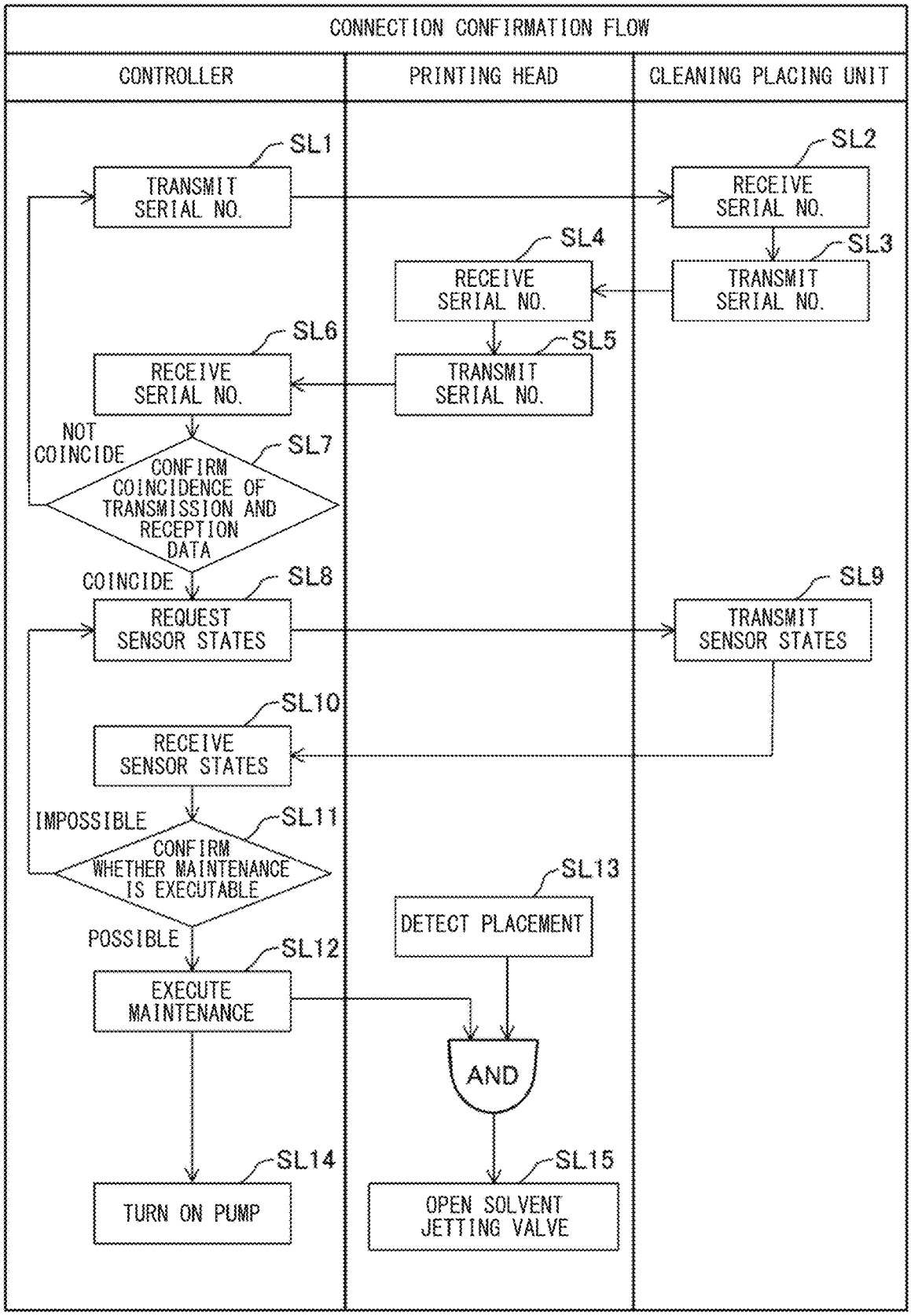
FIG. 41 is a diagram equivalent to FIG. 30 according to the modification 5.

FIG. 41 is a flowchart illustrating processing according to the modification 5 of the embodiment. In step SL1, the controller 100 transmits a serial number to the cleaning placing unit 200. In step SL2, the cleaning placing unit 200 receives the serial number transmitted from the controller 100. In step SL3, the cleaning placing unit 200 transmits the serial number received from the controller 100 to the printing head 1. In step SL4, the printing head 1 receives the serial number transmitted from the cleaning placing unit 200. In step SL5, the printing head 1 transmits the serial number received from the cleaning placing unit 200 to the controller 100. In step SL6, the controller 100 receives the serial number transmitted from the printing head 1.

In step SL7, the control unit 101 determines whether the serial number of the controller 100 transmitted from the printing head 1 coincides with the serial number transmitted by the controller 100 in step SL1. When the serial numbers do not coincide, the control unit 101 returns to step SL1. When the serial numbers coincide, the control unit 101 proceeds to step SL8 and requests the cleaning placing unit 200 to output sensor states. In step SL9, the cleaning placing unit 200 transmits states of the container detection sensor 235 and the liquid volume sensor 240 to the controller 100. In step SL10, the control unit 101 receives the states of the container detection sensor 235 and the liquid volume sensor 240. In step SL11, the control unit 101 confirms whether maintenance is executable. When the maintenance is "impossible", the control unit 101 proceeds to step SL8. When the maintenance is "possible", the control unit 101 proceeds to step SL12 and executes the maintenance. In this case, the control unit 101 actuates the pump in step SL14. On the other hand, the printing head 1 acquires a result of the placement detection for the printing head 1 based on an output signal of the magnetic sensor 10*b* and, only when AND conditions of a signal of the placement detection and a maintenance execution permission signal are satisfied, the printing head 1 proceeds to step SL15 and opens the solvent jetting valve.

In the modification 5, the valve can be controlled according to AND of the signals of the container detection sensor 235, the liquid volume sensor 240, and the placement detection. The signal of the placement detection is not transmitted to the control unit 101. The cleaning control unit in the modification 5 can be configured to include an AND circuit of the printing head 1.

Sleep Mode

In this modification, the automatic printing system S is configured to be capable of executing, when an operation stop period of the automatic printing system S lasts for a long period, a sleep mode for periodically performing automatic cleaning for preventing a deficiency due to adhesion of the ink from easily occurring. As illustrated in FIG. 2, the control unit 101 of the controller 100 includes a mode operation unit 101*b*. The mode operation unit 101*b* is a portion that, when the placement detecting unit (the magnetic sensor 10*b*, the light receiving element 10*c*, and the like) detects that the printing head 1 is placed on the cleaning placing unit 200, operates a sleep mode for automatically performing the cleaning operation of the printing head 1 at a predetermined interval during an operation stop of the ink jet recording apparatus I to which external power is supplied. In order to operate the sleep mode, electric power is supplied to the ink jet recording apparatus I from a commercial power supply 700 or the like as illustrated in FIG. 2.

Figure 42:
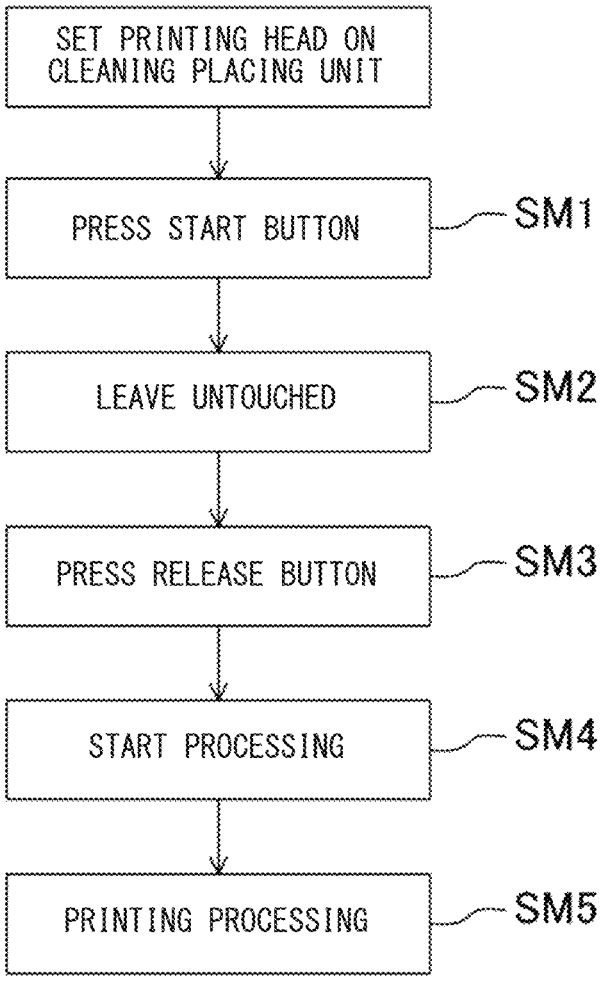
FIG. 42 is a flowchart illustrating an example of operation in a sleep mode.

FIG. 42 is a flowchart illustrating an example of the operation of the sleep mode. After a start, when the mode operation unit 101*b* detects that the printing head 1 is placed on the cleaning placing unit 200, this flow is started. When the flow is started, the mode operation unit 101*b* generates a user interface for maintenance 400 illustrated in FIG. 43 and causes the display unit 103*a* illustrated in FIG. 2 to display the user interface for maintenance 400. In the user interface for maintenance 400, a start button 400*a* operated when starting the sleep mode and a display region 400*b* for displaying explanatory notes and explanatory drawings concerning the sleep mode are provided. When the start button 400*a* is pressed in step SM1 in FIG. 42, the mode operation unit 101*b* detects the pressing of the start button 400*a* and operates the sleep mode. The mode operation unit 101*b* generates a state display user interface 401 illustrated in FIG. 44 and causes the display unit 103*a* illustrated in FIG. 2 to display the state display user interface 401. In the state display user interface 401, a release button 401*a* operated when releasing (ending) the sleep mode, a state display region 401*b* for displaying an ink residual amount and the like, and a display region 401*c* for displaying explanatory notes and explanatory drawings are provided. During the sleep mode, the state display user interface 401 can be kept displayed.

Step SM2 in FIG. 42 indicates that the automatic printing system S is left untouched for a long period of several weeks to several months or more. In this period, the cleaning operation unit 101*a* automatically starts the ink jet recording apparatus I and performs the cleaning operation for supplying the solvent to the nozzle 12 with the solvent supply unit 105 and ejecting the solvent from the nozzle 12. Besides the cleaning operation for supplying the solvent to the nozzle 12 and ejecting the solvent from the nozzle 12, for example, the cleaning operation may be a cleaning operation for jetting the solvent from the cleaning nozzle 19 or may be a cleaning operation for supplying the ink from the ink supply unit 104 to a nozzle and ejecting the ink from the nozzle. Among these plurality of cleaning operations, two or more cleaning operations can also be performed. The nozzle for cleaning is not limited to the cleaning nozzle 19 and may be a cleaning agent nozzle 360 provided in the cleaning placing unit 200 as indicated by, for example, an imaginary line in FIG. 24. The cleaning agent can be supplied to the cleaning agent nozzle 360 from the controller 100 in the same manner as being supplied to the cleaning nozzle 19. The cleaning agent nozzle 360 can jet the cleaning agent to the nozzle 12, the charging electrode 13, and the like.

Figure 43:
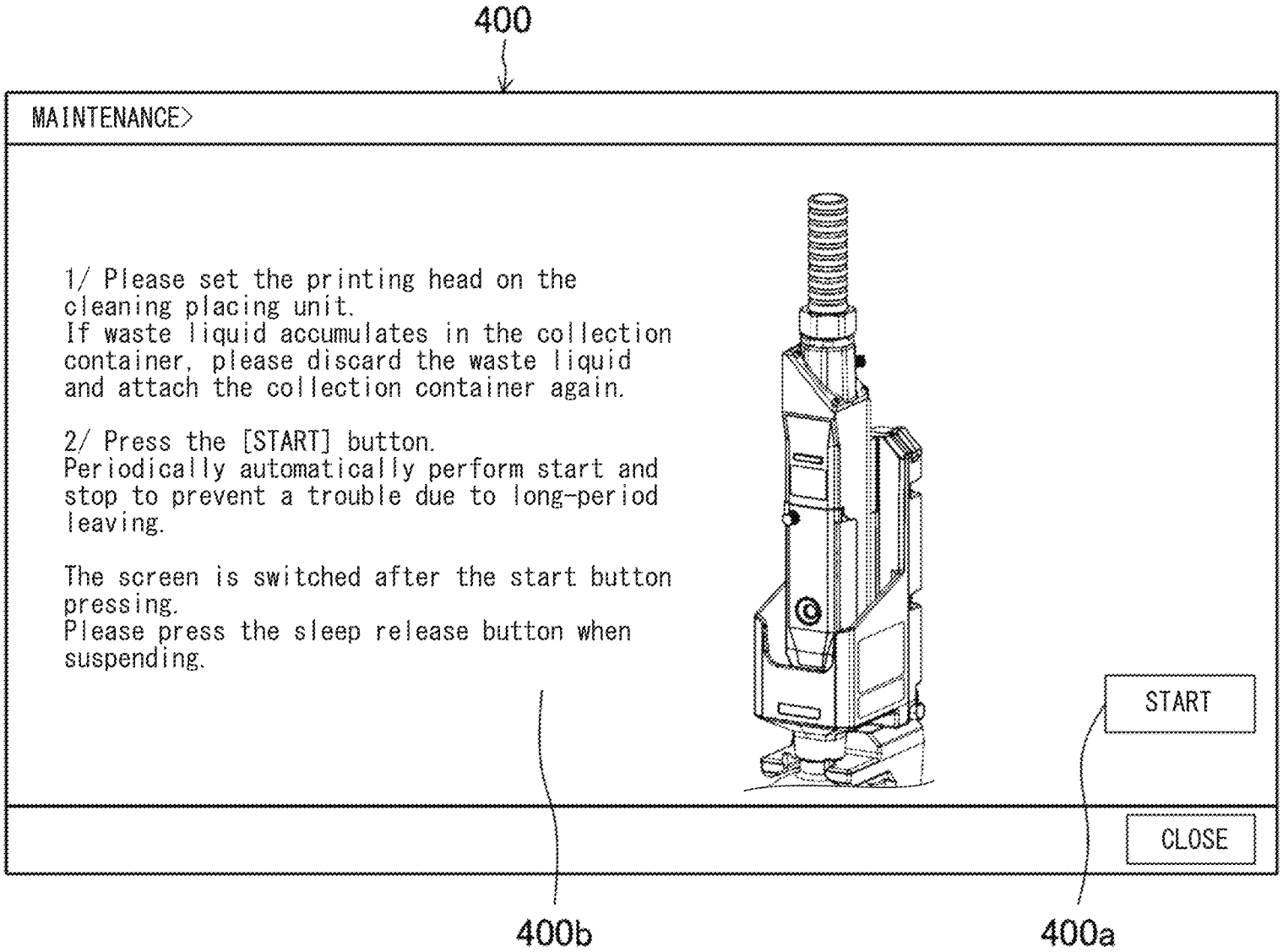
FIG. 43 is a diagram illustrating an example of a user interface for maintenance.

As illustrated in FIG. 2, the control unit 101 of the controller 100 includes a time measuring unit 101*c* that measures a time in which the ink jet recording apparatus I is performing a sleep mode operation. The time measuring unit 101*c* is a so-called timer. The time measuring unit 101*c* can be configured to start clocking from the time when the start button 400*a* of the user interface for maintenance 300 illustrated in FIG. 43 is pressed or can be configured to start clocking from the time when the mode operation unit 101*b* operates the sleep mode.

When detecting that the mode operation unit 101*b* operates the sleep mode, the cleaning operation unit 101*a* acquires the time of the sleep mode operation measured by the time measuring unit 101*c*. When the time of the sleep mode operation measured by the time measuring unit 101*c* reaches a predetermined time, the cleaning operation unit 101*a* performs the cleaning operation.

Figure 44:
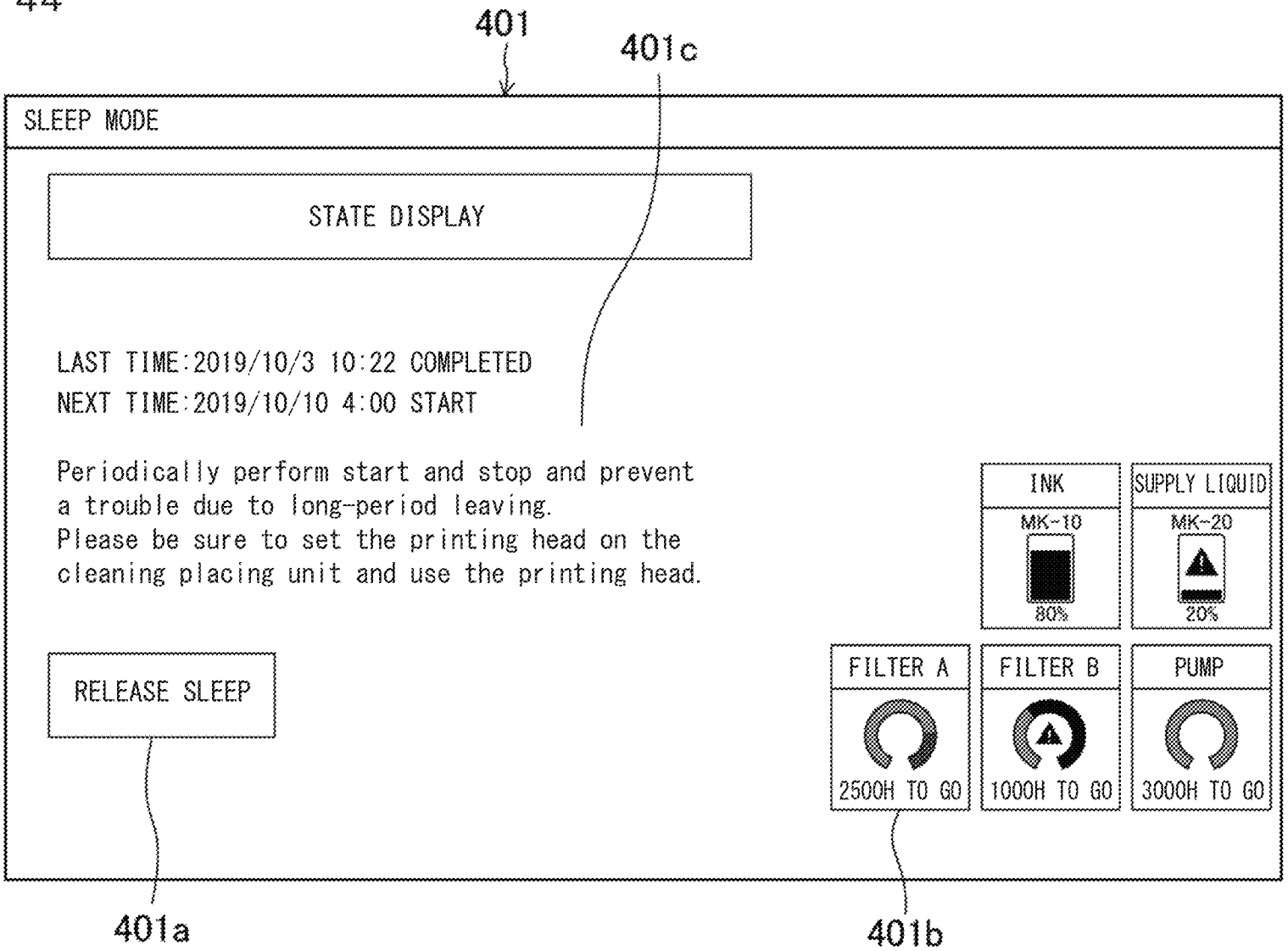
FIG. 44 is a diagram illustrating an example of a state display user interface.

When the release button 401*a* of the state display user interface 401 illustrated in FIG. 44 is pressed in step SM3 illustrated in FIG. 42, the mode operation unit 101*b* detects the pressing of the release button 401*a* and releases the sleep mode. When detecting that the mode operation unit 101*b* releases the sleep mode, the control unit 101 executes start processing in step SM4 and, thereafter, executes printing processing in step SM5.

In the example explained above, the sleep mode is operated without confirming an abnormality on the cleaning placing unit 200 side. However, not only this, but it is also possible to operate the sleep mode while confirming an abnormality on the cleaning placing unit 200 side.

Figure 45:
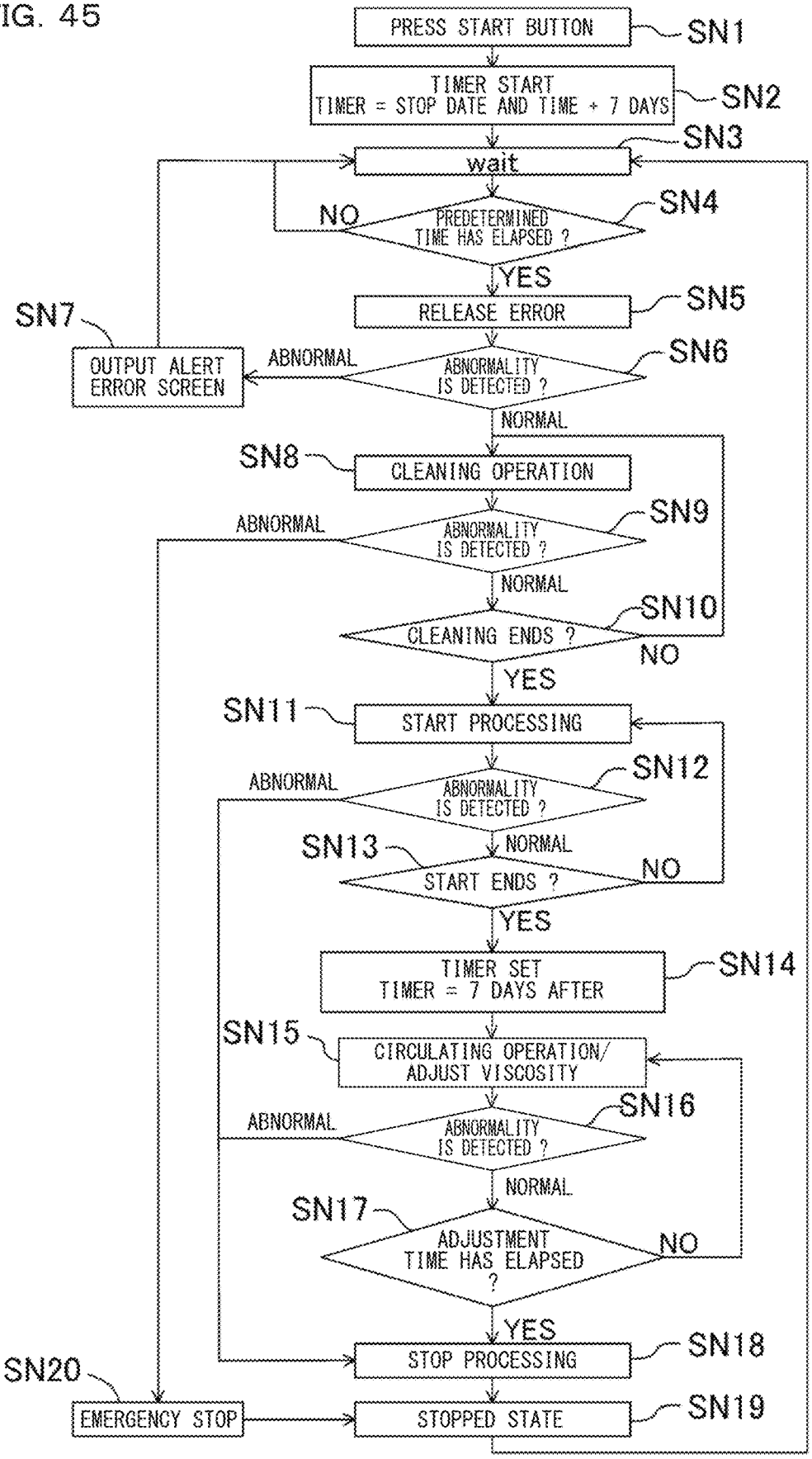
FIG. 45 is a flowchart of processing for operating the sleep mode while confirming an abnormality on the cleaning placing unit side.

FIG. 45 is a flowchart of processing for operating the sleep mode while confirming an abnormality on the cleaning placing unit 200 side. When the start button 400*a* illustrated in FIG. 43 is pressed in step SN1, the mode operation unit 101*b* detects the pressing of the start button 400*a* and operates the sleep mode. In step SN2, the time measuring unit 101*c* starts clocking and performs processing for adding "seven days" to date and time when the ink jet recording apparatus I is stopped. The "seven days" is a period when it is determined that the cleaning operation is necessary and is not limited to the "seven days". The time measuring unit 101*c* may perform processing for adding time instead of the number of days.

After waiting in step SN3, the control unit 101 proceeds to step SN4 and determines whether a predetermined time (in this example, the seven days) has elapsed. When determining NO in step SN4 and seven days have not elapsed, the control unit 101 proceeds to step SN3 and waits and performs the determination in step SN4 again. When determining YES in step SN4 and seven days have elapsed since the ink jet recording apparatus I is stopped, the control unit 101 proceeds to step SN5 and performs error release processing. An error is explained below.

Thereafter, the control unit 101 proceeds to step SN6 and performs abnormality detection determination. Abnormality detection can be performed according to the flowchart illustrated in FIG. 31. That is, when the magnetic sensor 10*b*, which is the placement detecting unit, is off, since the printing head 1 is absent in the regular position, this is detected as an abnormality in step SN6 in FIG. 45. When the container detection sensor 235 is off, since the collection container 300 is not attached, this is detected as an abnormality in step SN6 in FIG. 45. Further, when the liquid volume sensor 240 is ON, since the cleaning agent in the collection container 300 is in the full amount or in a state close to the full amount, this is detected as an abnormality in step SN6 in FIG. 45.

The cleaning operation unit 101*a* is configured to execute, when the time of the sleep mode operation reaches the predetermined time and before the cleaning operation is performed, in step SN6, placement confirmation processing for confirming whether the placement detecting unit detects that the printing head 1 is placed on the cleaning placing unit 200.

When at least one is detected among the plurality of abnormalities, the control unit 101 determines "abnormal" in step SN6 and proceeds to step SN7. In step SN7, the control unit 101 outputs an alert, causes the display unit 103*a* or the like to display an error screen and records an error. That is, the cleaning operation unit 101*a* is configured to perform an error output in step SN7 when it is determined according to an execution result of the placement confirmation processing in step SN6 that a placement of the printing head 1 on the cleaning placing unit 200 is not detected by the placement detecting unit. The error output may be a form of performing error display on the display unit 103*a*, may be a form of generating error sound from a speaker or the like (not illustrated), or may be a form of outputting an error signal to an external device.

When determining "normal" in step SN6, the control unit 101 proceeds to step SN8 and the cleaning operation unit 101*a* performs the cleaning operation. Consequently, it is possible to improve a start success rate.

After starting the cleaning operation, the control unit 101 proceeds to step SN9 and performs the same abnormality detection determination as step SN6. In step SN9, the cleaning operation unit 101*a* executes placement confirmation processing for confirming whether the placement detecting unit detects that the printing head 1 is placed on the cleaning placing unit 200 during the cleaning operation. When the cleaning operation unit 101*a* determines "abnormal" in step SN9, the control unit 101 proceeds to step SN20 and, after emergently stopping the cleaning operation, proceeds to step SN19. Therefore, the cleaning operation unit 101*a* is configured to stop the cleaning operation when it is determined, according to the execution result of the placement confirmation processing in step SN9, that the placement detecting unit does not detect that the printing head 1 is placed on the cleaning placing unit 200.

Figure 46:
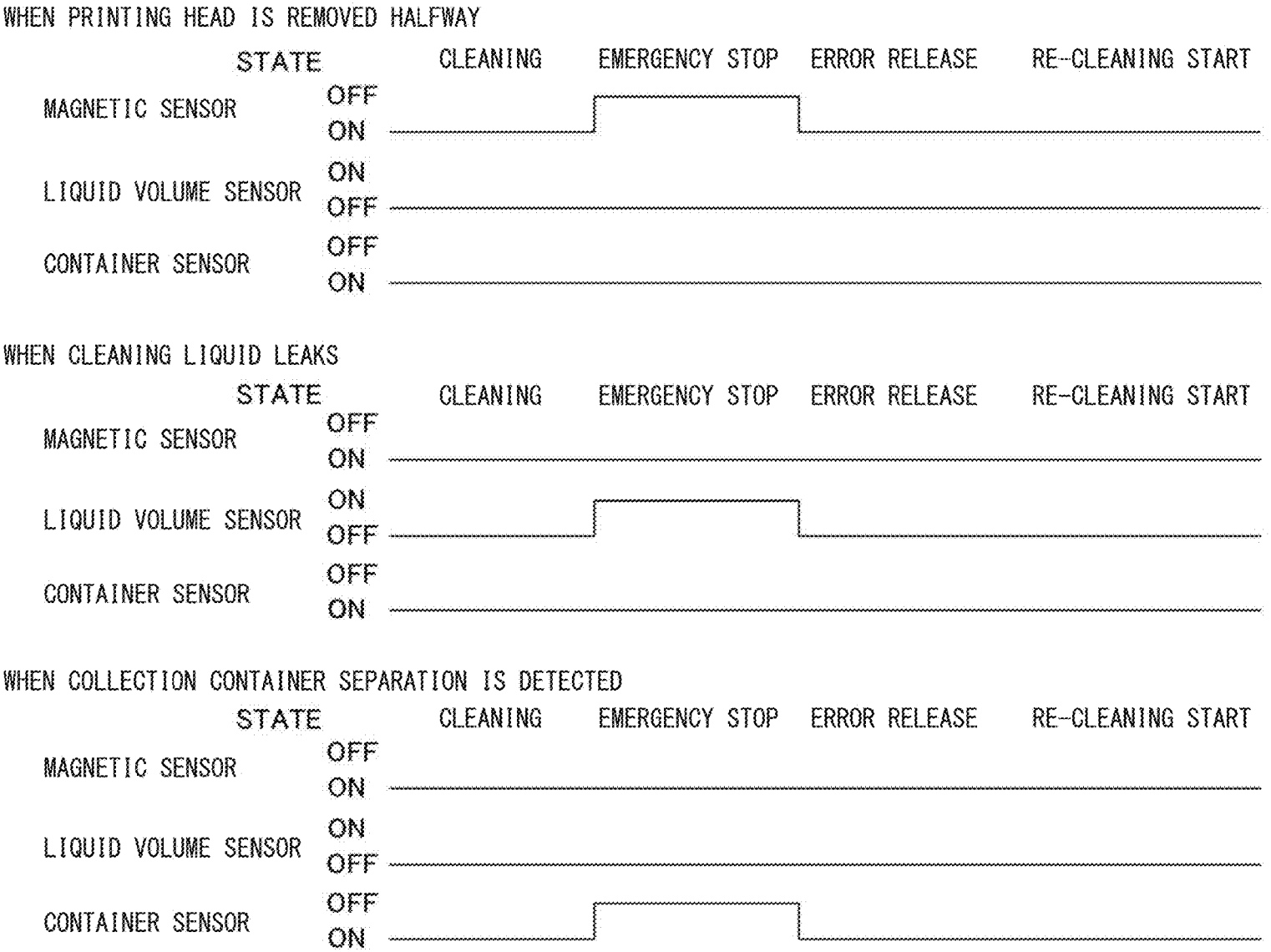
FIG. 46 is a timing chart of abnormality detection during the start processing.

For example, as illustrated in FIG. 46, when the printing head 1 is removed during the cleaning operation, the magnetic sensor 10*b* is turned off and the cleaning operation is emergently stopped. When the liquid volume sensor 240 detects overflow of the cleaning agent from the collection container 300 during the cleaning operation, the cleaning operation is emergently stopped. When the container detection sensor 235 detects that the collection container 300 is separated during the cleaning operation, the cleaning operation is emergently stopped.

When the cleaning operation unit 101*a* determines "normal" in step SN9, the control unit 101 proceeds to step SN10 and determines whether the cleaning operation ends. When determining NO in step SN10 and the cleaning operation does not end, the control unit 101 continues the cleaning operation. When determining YES in step SN 10 and the cleaning operation ends, the control unit 101 proceeds to step SN11 and executes the start processing. After executing the start processing, the control unit 101 proceeds to step SN12 and performs the same abnormality detection determination as step SN6. When determining "abnormal" in step SN12, the control unit 101 proceeds to step SN18 and immediately executes the stop processing. When determining "normal" in step SN12, the control unit 101 proceeds to step SN13 and determines whether the start processing ends. When determining NO in step SN13 and the start processing does not end, the control unit 101 continues the start processing. When determining YES in step SN13 and the start processing ends, the control unit 101 proceeds to step SN14. The time measuring unit 101*c* starts clocking anew and performs processing for adding "seven days" to the present date and time.

Thereafter, the control unit 101 proceeds to step SN15, circulates the ink, and performs viscosity adjustment for the ink, whereby adhesion of the ink is suppressed. Subsequently, the control unit 101 proceeds to step SN16 and performs the same abnormality detection determination as step SN6. When determining "abnormal" in step SN16, the control unit 101 proceeds to step SN18 and immediately executes the stop processing. When determining "normal" in step SN16, the control unit 101 proceeds to step SN17 and determines whether a prescribed adjustment time for the ink has elapsed. If the adjustment time has not elapsed, the control unit 101 continuously performs step SN15.

When determining YES in step SN17 and the adjustment time for the ink elapses, the control unit 101 proceeds to step SN18 and executes the stop processing. Thereafter, the control unit 101 proceeds to step SN19, changes the ink jet recording apparatus I to a stopped state, and then proceeds to step SN 3. In step SN5 to which the control unit 101 proceeds thereafter, the error is released.

Modification of the Sleep Mode

Figure 47:
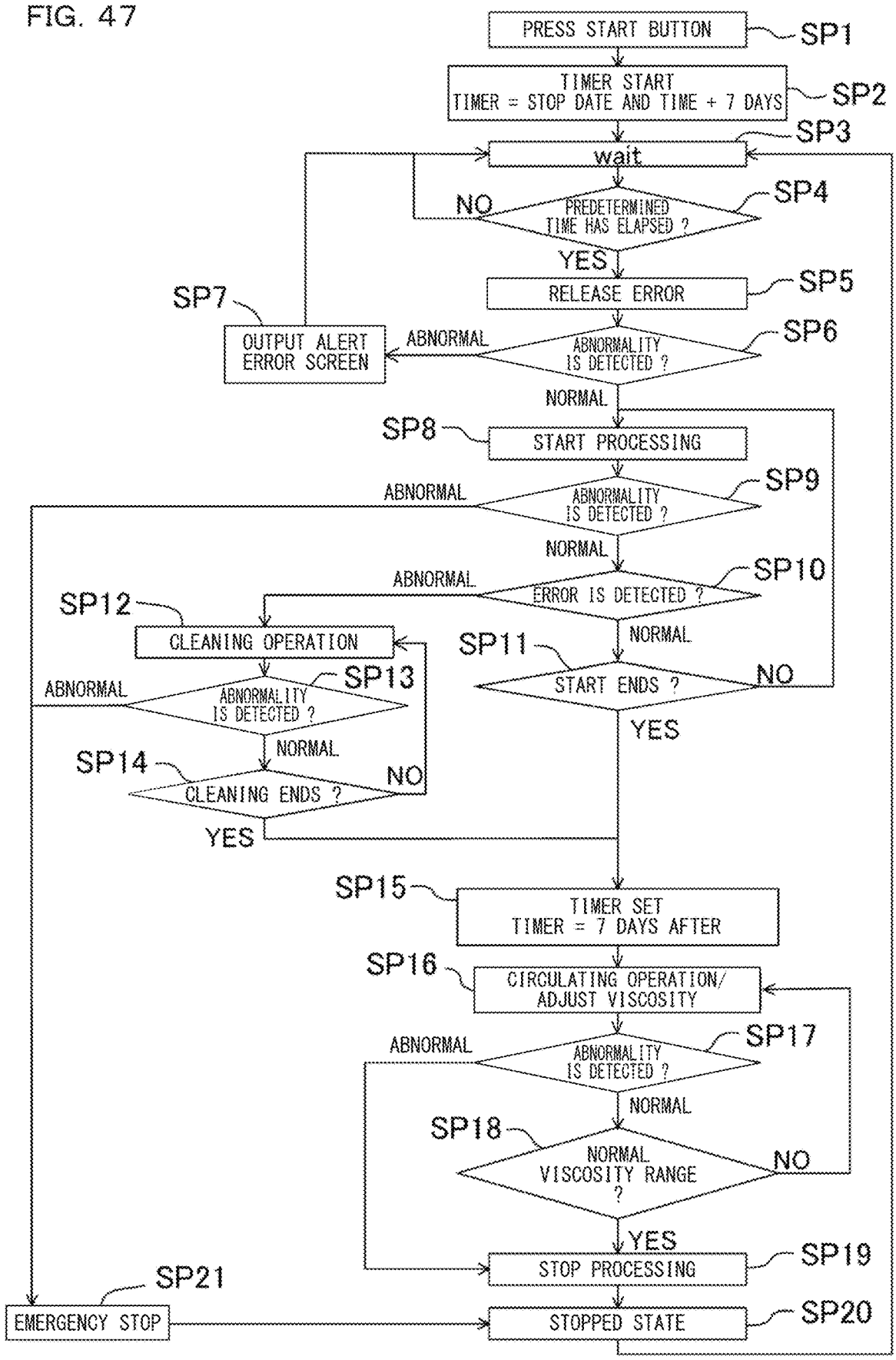
FIG. 47 is a diagram equivalent to FIG. 45 illustrating processing according to a modification of the sleep mode.

FIG. 47 is a flowchart illustrating a modification of the sleep mode. This modification is different from the processing illustrated in FIG. 45 in that a consumption amount of the cleaning agent can be reduced. Steps SP1 to SP7 are the same as steps SN1 to SN7 of the flowchart illustrated in FIG. 45. In step SP8, the control unit 101 performs the start processing and proceeds to step SP9. In step SP9, the control unit 101 performs the abnormality detection determination as in step SN6 in FIG. 45. When determining "abnormal" in step SP9, the control unit 101 proceeds to step SP21 and, after emergently stopping the start processing, proceeds to step SP20.

When determining "normal" in step SP9, the control unit 101 proceeds to step SP10 and determines whether an error is detected. The error is different from the error by the abnormality detection determination and is, for example, an error at the time when clogging or the like of the nozzle 12 occurs. When determining "normal" in step SP10, the control unit 101 proceeds to step SP11 and determines whether the start processing ends. When determining NO in step SP11 and the start processing does not end, the control unit 101 continues the start processing.

On the other hand, when the control unit 101 determines "abnormal" in step SP10, clogging or the like of the nozzle 12 has occurred and necessity of the cleaning operation is high. Therefore, the control unit 101 proceeds to step SP12 and executes the cleaning operation. That is, in this modification, the cleaning operation is executed only when it is determined that the necessity of the cleaning operation is high. Therefore, it is possible to suppress a consumption amount of the cleaning agent.

When proceeding from step SP12 to step SP13, the control unit 101 performs the abnormality detection determination as in step SP9. When determining "abnormal" in step SP13, the control unit 101 proceeds to step SP21 and, after emergently stopping the cleaning operation, proceeds to step SP20. When determining "normal" in step SP13, the control unit 101 proceeds to step SP14 and determines whether the cleaning operation ends. When determining NO in step SP14 and the cleaning operation does not end, the control unit 101 continues the cleaning operation.

When determining YES in step SP14 and the cleaning operation ends, the control unit 101 proceeds to step SP15. The time measuring unit 101*c* starts clocking anew and performs processing for adding "seven days" to the present date and time.

Thereafter, the control unit 101 proceeds to step SP16, circulates the ink, and performs viscosity adjustment for the ink. Subsequently, the control unit 101 proceeds to step SP17 and performs the same abnormality detection determination as step SP9. When determining "abnormal" in step SP17, the control unit 101 proceeds to step SP19 and immediately executes the stop processing. When determining "normal" in step SP17, the control unit 101 proceeds to step SP18 and determines whether the viscosity of the ink is within a normal viscosity range. When determining NO in step SP18, the control unit 101 performs the viscosity adjustment until the viscosity of the ink falls within the normal viscosity range. When determining YES in step SN18, the control unit 101 proceeds to step SN19 and executes the stop processing. Thereafter, the control unit 101 proceeds to step SP20, changes the ink jet recording apparatus I to the stopped state, and then proceeds to step SP3.

Sleep Mode Shift Determination

The control unit 101 may automatically shift to the sleep mode after the stop processing. After the stop processing, the mode operation unit 101*b* may generate a user interface for period selection 402, cause the display unit 103*a* illustrated in FIG. 2 to display the user interface for period selection 402, and determine possibility of a shift according to a result of the period selection.

Figure 48:
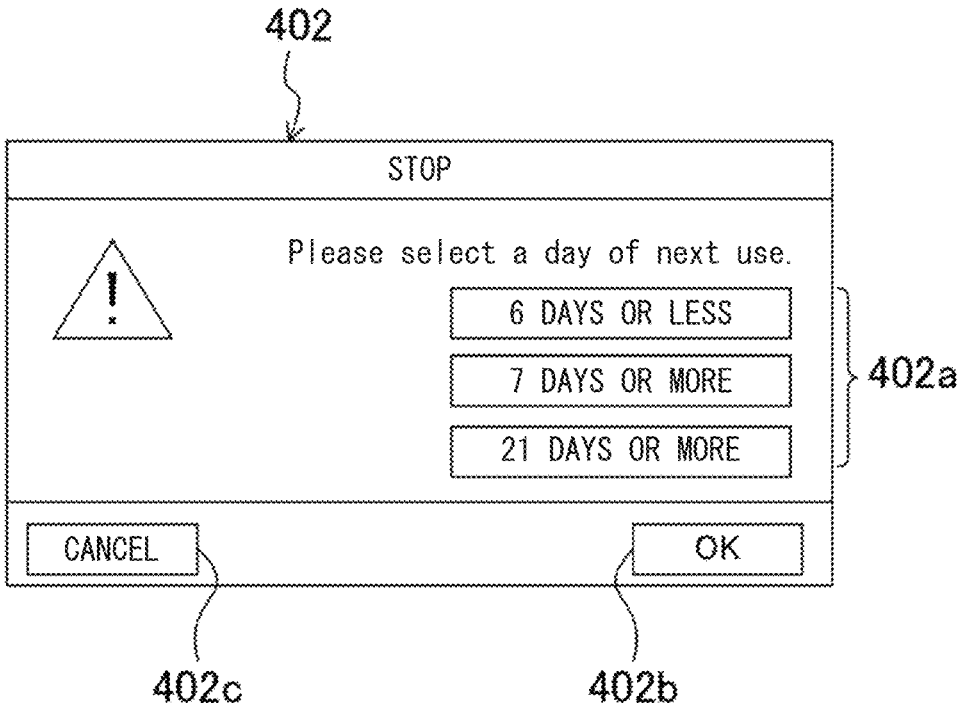
FIG. 48 is a diagram illustrating an example of a user interface for period selection displayed during a stop.

In the user interface for period selection 402 illustrated in FIG. 48, an input unit 402*a* capable of inputting information concerning a period from an operation stop to a next operation before the operation of the ink jet recording apparatus I is stopped, an OK button 402*b*, and a cancel button 402*c* are provided. In the input unit 402*a*, selection buttons for selecting six days or less, seven days or more, and twenty-one days or more as the period from the operation stop to the next operation of the ink jet recording apparatus I are provided. The user can input the period by operating the selection buttons. Note that the user may input the number of days from the operation stop to the next operation of the ink jet recording apparatus I. In this case, the input number of days is information concerning the period from the operation stop to the next operation. The user may be able to input year, month, and day of the next operation from a calendar or the like. In this case, the input year, month, and day is the information concerning the period from the operation stop to the next operation. In all the cases, the period until the next operation can be acquired.

Figure 49:
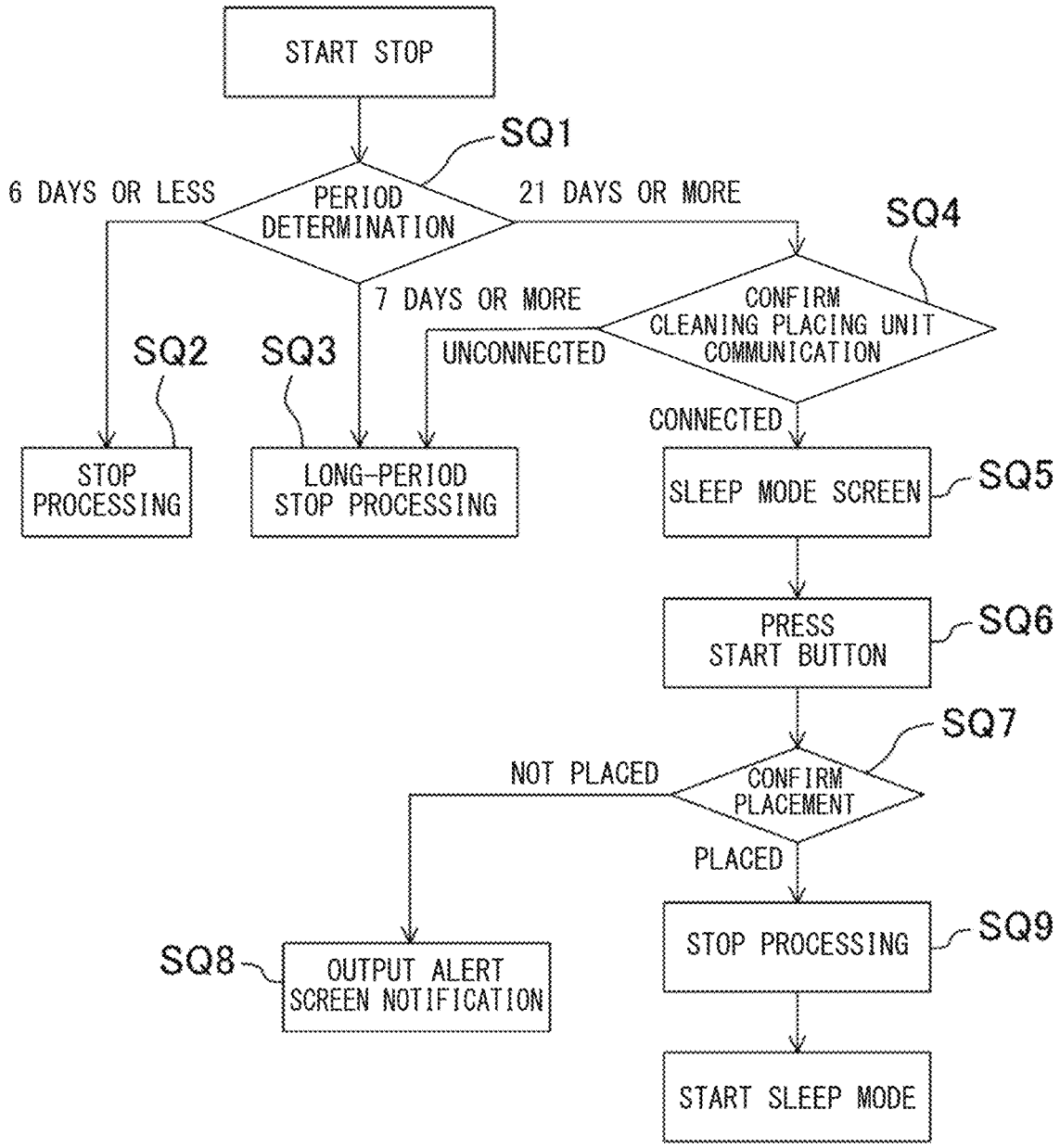
FIG. 49 is a flowchart illustrating an example of sleep mode shift determination processing.

FIG. 49 is a flowchart illustrating an example of sleep mode shift determination processing. This flow is started by a start of the stop processing after the print processing is finished by the ink jet recording apparatus I. The start of the stop processing can be detected by operation of a start button (not illustrated) for the stop processing by the user.

In step SQ1, the control unit 101 performs period determination based on information concerning a period input to the input unit 402*a* of the user interface for period selection 402 illustrated in FIG. 48. If the period is six days or less, the control unit 101 proceeds to step SQ2 and performs normal stop processing. If the period is seven days or more, the control unit 101 proceeds to step SQ3 and performs long-period stop processing. In the long-period stop processing, an ejection time of the cleaning agent is set to a long time, an ejection amount of the cleaning agent is set to be large, or the number of times of ejection of the cleaning agent is set to be large compared with the normal stop processing.

As a result of the period determination in step SQ1, if the period is twenty-one days or more, the control unit 101 proceeds to step SQ4. In step SQ4, the control unit 101 performs communication confirmation between the controller 100 and the cleaning placing unit 200. As a result of the confirmation, when the controller 100 and the cleaning placing unit 200 are unconnected, the control unit 101 proceeds to step SQ3. On the other hand, when the controller 100 and the cleaning placing unit 200 are connected, the control unit 101 proceeds to step SQ5 and causes the display unit 103*a* illustrated in FIG. 2 to display the user interface for maintenance 400 illustrated in FIG. 43. When the start button 400*a* is pressed in step SQ6, the mode operation unit 101*b* detects the pressing of the start button 400*a* and operates the sleep mode. The control unit 101 proceeds to step SQ7. In step SQ7, the control unit 101 performs placement confirmation processing for confirming whether a placement of the printing head 1 on the cleaning placing unit 200 is detected by the placement detecting unit.

When determining "not placed" in step SQ7 and the printing head 1 is not placed on the cleaning placing unit 200, the control unit 101 proceeds to step SQ8, outputs an alert, and displays the alert on the display unit 103*a*. On the other hand, when determining "placed" in step SQ7, the control unit 101 proceeds to step SQ9 and performs the stop processing. Thereafter, the mode operation unit 101*b* operates the sleep mode. Therefore, the mode operation unit 101*b* is configured to determine, in step SQ1, based on the information concerning the period input to the input unit 402*a* of the user interface for period selection 402 illustrated in FIG. 48, whether a period until the next operation is a predetermined period or more and, when the period until the next operation is the predetermined period or more, proceed to steps SQ4 to SQ7 and SQ9, operate the sleep mode. Therefore, it is possible to automatically perform maintenance corresponding to the operation stop period. On the other hand, when determining that the period until the next operation is less than the predetermined period, the control unit 101 proceeds to step SQ2 or SQ3. Therefore, the mode operation unit 101*b* does not operate the sleep mode.

Sleep Mode Automatic Shift

Figure 50:
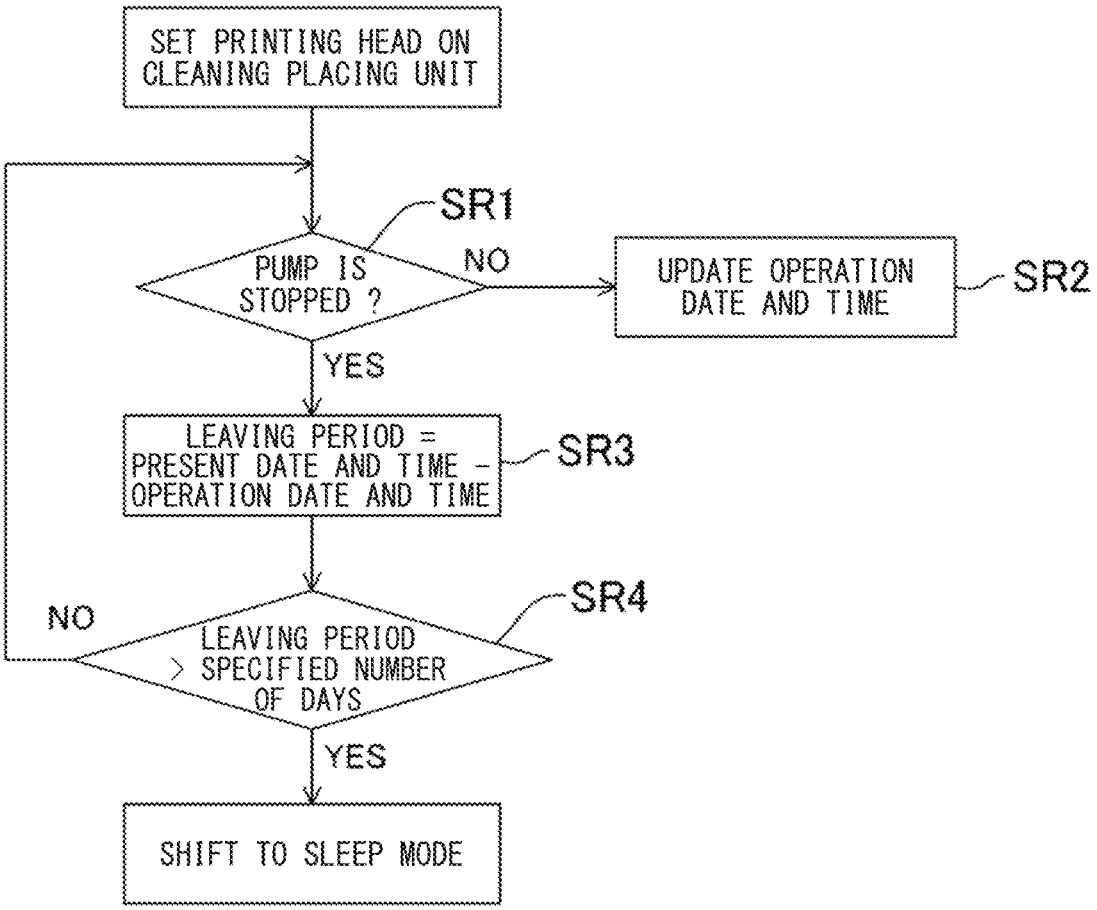
FIG. 50 is a flowchart illustrating an example of sleep mode automatic shift determination processing.

FIG. 50 is a flowchart illustrating an example of sleep mode automatic shift processing. This flow is started when it is detected that the printing head 1 is placed on the cleaning placing unit 200. In step SR1, the control unit 101 determines whether the pumps of the controller 100 are stopped. When determining NO in step SR1, since the pumps are considered operating, the control unit 101 proceeds to step SR2 and updates and stores operation date and time. During the operation, that is, if the pumps are operating as at the time when the printing processing is performed, the operation date and time is updated and rewritten at any time. On the other hand, when determining YES in step SR1, the control unit 101 proceeds to step SR3 and calculates a leaving period. The leaving period is obtained by subtracting the operation date and time from the present date and time.

In step SR4, the mode operation unit 101*b* determines whether the leaving period is longer than a specified number of days. The specified number of days can be set to, for example, approximately several weeks. In this embodiment, the specified number of days is set to twenty-one. When the mode operation unit 101*b* determines NO in step SR4 and the leaving period is less than the specified number of days, the control unit 101 returns to step SR1. On the other hand, when the mode operation unit 101*b* determines YES and the leaving period is longer than the specified number of days, the mode operation unit 101*b* operates the sleep mode.

In this example, without displaying the user interface for period selection 402 illustrated in FIG. 48, the ink jet recording system S automatically determines, based on the leaving period of the ink jet recording system S, whether the ink jet recording system S should shift to the sleep mode. If necessary, the ink jet recording system S shifts to the sleep mode. Therefore, even if the user forgets to set the ink jet recording system S in the sleep mode, the ink jet recording system S can perform the cleaning operation.

Action Effects of the Embodiment

As explained above, according to this embodiment, when the printing head 1 is placed on the cleaning placing unit 200, it is possible to detect that the printing head 1 is placed on the cleaning placing unit 200. A signal based on the placement confirmation for the printing head 1 is transmitted to the controller 100 connected to the printing head 1 placed on the cleaning placing unit 200. Consequently, the controller 100 can confirm that the printing head 1 connected to the controller 100 is placed on the cleaning placing unit 200. Therefore, the controller 100 can determine that cleaning of the printing head 1 can be performed.

Therefore, since the printing head 1 placed on the cleaning placing unit 200 can be cleaned, the cleaning liquid leaking from the printing head 1 can be received by the cleaning placing unit 200. Contamination of an ambient environment is prevented.

The sleep mode can be operated by the mode operation unit 101*b* during the operation stop of the ink jet recording apparatus I. When the time of the sleep mode operation reaches the predetermined time, the cleaning operation unit 101*a* automatically starts the ink jet recording apparatus I and performs the cleaning operation. Consequently, when long-period storage is assumed until reoperation, a deficiency due to adhesion of the ink less easily occurs.

The embodiment explained above is only illustration in all aspects and should not be limitedly interpreted. Further, all of modifications and changes belonging to the scope of equivalents of the claims are within the scope of the present invention.

As explained above, the present invention can be used, for example, when printing is performed on various works.

What is claimed is:

1. An ink jet recording system comprising:

an ink jet recording apparatus including a printing head configured to house, on an inside, a nozzle that ejects ink, a charging electrode that charges particulate ink ejected from the nozzle, and a deflection electrode that deflects a flying direction of the ink charged by the charging electrode and eject, to an outside, the ink deflected by the deflection electrode and a controller including an ink supply unit connected to the printing head and configured to supply the ink to the printing head, a solvent supply unit connected to the printing head and configured to supply a solvent to the printing head, and a control unit configured to control ink supply from the ink supply unit to the printing head and control solvent supply from the solvent supply unit to the printing head, the ink jet recording apparatus performing printing on work using the ink supplied from the ink supply unit;

a cleaning placing unit disposed in a place different from a setting place of the printing head at a time when the printing is performed by the ink jet recording apparatus, the printing head being placed on the cleaning placing unit when the printing head is cleaned using the solvent supplied from the solvent supply unit; and a placement detecting unit configured to be capable of detecting that the printing head is placed on the cleaning placing unit and, when detecting that the printing head is placed, send a signal based on placement confirmation for the printing head to the control unit connected to the printing head placed on the cleaning placing unit.

2. The ink jet recording system according to claim 1, wherein the controller includes a cleaning operation unit configured to, when the control unit receives the signal based on the placement confirmation for the printing head sent by the placement detecting unit, perform a cleaning operation for the printing head placed on the cleaning placing unit, and the placement detecting unit sends the signal based on the placement confirmation for the printing head to the control unit as a permission signal for permitting the cleaning operation by the cleaning operation unit.

3. The ink jet recording system according to claim 2, wherein the placement detecting unit sends the signal based on the placement confirmation for the printing head to the control unit as a non-permission signal for not permitting the printing on the work by the printing head and the control unit.

4. The ink jet recording system according to claim 2, wherein the cleaning operation unit is configured to prohibit the cleaning operation for the printing head when the signal based on the placement confirmation for the printing head is not received.

5. The ink jet recording system according to claim 1, wherein the placement detecting unit is configured to send the signal based on the placement confirmation for the printing head to the control unit via a cable that connects the printing head and the controller.

6. The ink jet recording system according to claim 1, wherein the printing head and the controller are connected by a cable, the controller and the cleaning placing unit are connected by a wired or wireless signal line different from the cable, and the placement detecting unit is configured to send the signal based on the placement confirmation for the printing head to the control unit via the signal line.

7. The ink jet recording system according to claim 1, wherein the controller and the cleaning placing unit are connected by a wired or wireless signal line capable of transmitting identification information of the controller to the cleaning placing unit and is configured to send the signal based on the placement confirmation for the printing head and the identification information of the controller acquired in advance via the signal line to the control unit.

8. The ink jet recording system according to claim 7, wherein the signal based on the placement confirmation for the printing head and the identification information of the controller are sent to the control unit via the signal line.

9. The ink jet recording system according to claim 1, wherein, when an identification information of the printing head placed on the cleaning placing unit is acquired and the signal based on the placement confirmation for the printing head is sent, identification information of the printing head is also sent to the control unit.

10. The ink jet recording system according to claim 1, wherein the control unit and the cleaning placing unit are communicably connected, the cleaning placing unit and the printing head are communicably connected, the printing head and the control unit are communicably connected, the control unit transmits authentication information to the cleaning placing unit, the cleaning placing unit transmits the authentication information transmitted from the control unit to the printing head, the printing head transmits the authentication information transmitted from the cleaning placing unit to the control unit, and the control unit executes, based on the authentication information transmitted to the cleaning placing unit and the authentication information received from the printing head, authentication processing for authenticating whether the printing head is connected to the control unit.

* * * * *